US009080116B2

(12) United States Patent
Jensen et al.

(10) Patent No.: US 9,080,116 B2
(45) **Date of Patent: *Jul. 14, 2015**

(54) SYSTEM AND METHOD FOR PROCESSING MATERIAL TO GENERATE SYNGAS USING WATER INJECTION

(75) Inventors: Robert Christian Jensen, Augusta Township (CA); Graham Campbell Houze, Elizabethtown Township (CA)

(73) Assignee: RESPONSIBLE ENERGY INC., Brockville (CA)

( * ) Notice: Subject to any disclaimer, the term of this patent is extended or adjusted under 35 U.S.C. 154(b) by 1284 days.

This patent is subject to a terminal disclaimer.

(21) Appl. No.: 12/914,974

(22) Filed: Oct. 28, 2010

(65) Prior Publication Data

US 2012/0018294 A1 Jan. 26, 2012

Related U.S. Application Data

(63) Continuation of application No. PCT/CA2010/001663, filed on Oct. 22, 2010.

(60) Provisional application No. 61/366,327, filed on Jul. 21, 2010.

(51) Int. Cl.
*C10J 3/72* (2006.01)
*C10J 3/18* (2006.01)
(Continued)

(52) U.S. Cl.
CPC .. *C10J 3/726* (2013.01); *C10J 3/18* (2013.01); *C10J 3/30* (2013.01); *C10J 3/32* (2013.01);
(Continued)

(58) Field of Classification Search
USPC ..... 422/186.21
See application file for complete search history.

(56) References Cited

U.S. PATENT DOCUMENTS 5,069,765 A 12/1991 Lewis
5,451,738 A 9/1995 Alvi et al.
(Continued)

FOREIGN PATENT DOCUMENTS

CA 2481412 A1 8/2003
CA 2625706 A1 4/2006
(Continued)

OTHER PUBLICATIONS

Written Opinion of the International Searching Authority and International Search Report mailed on Apr. 21, 2011 in connection with PCT patent application PCT/CA2010/001663.
(Continued)

*Primary Examiner* — Kishor Mayekar
(74) *Attorney, Agent, or Firm* — Sean Murray; Murray IP Consulting Inc

(57) ABSTRACT

The present invention is directed to system and method for processing material to generate syngas. A reactor chamber is implemented with a plurality of electrodes that can generate an arc within the chamber when electricity is applied to them. The arc can be used to create free radicals which along with the heat and light of the arc breakdown material comprising carbonaceous material, such as Municipal Solid Waste (MSW), into gas components that form syngas. The syngas can be extracted from the reactor chamber and be used for various commercial purposes. The reactor chamber may comprise a material feed system operable to move material from a material input opening in the reactor chamber towards the electrodes at a controlled rate. Further, the reactor chamber may comprise a water injection system within the reactor chamber operable to inject water into the reactor chamber while electricity is applied to the electrodes. Yet further, the reactor chamber may comprise a gas removal system within the reactor chamber operable to extract gas generated from breakdown of the material from a plurality of gas removal locations. The gas removal system may be integrated within the material feed system.

20 Claims, 45 Drawing Sheets

(51) Int. Cl.

| | |
|---|---|
| ***C10J 3/30*** | (2006.01) |
| ***C10J 3/32*** | (2006.01) |
| ***C10K 1/04*** | (2006.01) |

(52) U.S. Cl.

CPC ..... *C10K 1/04* (2013.01); *C10J 2200/12* (2013.01); *C10J 2200/158* (2013.01); *C10J 2300/0906* (2013.01); *C10J 2300/0973* (2013.01); *C10J 2300/1238* (2013.01)

(56) References Cited

U.S. PATENT DOCUMENTS

| | | | | |
|---|---|---|---|---|
| 5,484,465 | A | 1/1996 | Hilliard et al. | |
| 5,573,559 | A | 11/1996 | Hilliard et al. | |
| 6,333,015 | B1 | 12/2001 | Lewis | |
| 7,302,897 | B2 | 12/2007 | Pallett et al. | |
| 8,574,325 | B2 * | 11/2013 | Jensen et al. | 48/61 |
| 2002/0048545 | A1 * | 4/2002 | Lewis | 423/418.2 |
| 2007/0099038 | A1 | 5/2007 | Galloway | |
| 2007/0289509 | A1 | 12/2007 | Vera | |
| 2008/0295405 | A1 | 12/2008 | Davis et al. | |
| 2009/0064581 | A1 | 3/2009 | Nielsen et al. | |
| 2009/0241420 | A1 | 10/2009 | Rokhvarger et al. | |
| 2010/0043446 | A1 | 2/2010 | Shirvanian et al. | |

FOREIGN PATENT DOCUMENTS

| | | | |
|---|---|---|---|
| CA | 2610806 | A1 | 12/2006 |
| CA | 2682952 | | 10/2008 |
| CA | 2644846 | A1 | 5/2009 |
| WO | WO-01/05910 | A1 | 1/2001 |
| WO | WO 2007/037768 | A1 | 4/2007 |
| WO | WO 2007/081296 | A1 | 7/2007 |
| WO | WO 2009/151180 | A2 | 12/2009 |
| WO | WO-2010/017945 | A2 | 2/2010 |
| WO | WO 2010/039165 | A1 | 4/2010 |

OTHER PUBLICATIONS chemeurope.com, Plasma arc waste disposal, http://www.chemeurope.com/en/encyclopedia/Plasma_arc_waste_disposal.html, 1997-2011, downloaded Jun. 14, 2011, 3 pages.

* cited by examiner

SYSTEM AND METHOD FOR PROCESSING MATERIAL TO GENERATE SYNGAS USING WATER INJECTION

CROSS-REFERENCE TO RELATED APPLICATION

The present application claims the benefit under 35 U.S.C. §120, as a continuation of PCT Patent Application Ser. No. PCT/CA2010/001663, filed on Oct. 22, 2010 entitled "SYSTEM AND METHOD FOR PROCESSING MATERIAL TO GENERATE SYNGAS" by Robert JENSEN et al., hereby incorporated by reference herein, which in turn claims priority to U.S. Provisional Patent Application Ser. No. 61/366,327, filed on Jul. 21, 2010 by Robert JENSEN et al.

FIELD OF THE INVENTION

The invention relates generally to material processing and, more particularly, to system and method for processing material to generate syngas using water injection.

BACKGROUND

Disposal of Municipal Solid Waste (MSW) and Municipal Solid Sludge (MSS) are significant issues throughout the world, and especially in the developed world. The traditional techniques of either burying or incinerating MSW and MSS are resulting in significant problems. Landfills are increasingly running out of space and there is becoming a large requirement to truck huge amounts of MSW/MSS to distant locations due to the public's unwillingness to have landfills in their neighborhood.

The environmental impact of dumping the MSW and MSS and/or incinerating it in a traditional fashion are enormous with toxins leaching into the soil surrounding landfills and potentially carcinogenic elements entering the air during incineration. The public interest in environmentally acceptable solutions is growing and the push has been in most developed countries to Reduce, Reuse and Recycle in order to limit the MSW that makes it to the landfills and reduce the energy used in dealing with it.

In some situations, benefits have been gained during the processing of MSW and MSS. During incineration, there is often reuse of the heat generated in order to create electricity or heat one or more facilities. In landfills, there have been successful attempts to capture methane that is released in the breakdown of the MSW over time.

This methane can then be used in a combustion chamber to create heat energy or within a chemical process to form more complicated compounds. The problem is these solutions do not solve the underlying environmental problems and do not come close to properly capturing the energy within the MSW and MSS.

One technology that has been developed to better process MSW is called plasma arc gasification. In plasma arc gasification, a plasma arc is generated with electrical energy in order to reduce complex carbon-containing molecules into smaller constituent molecules. This molecular breakdown occurs without the presence of oxygen, ensuring that combustion does not occur. The process uses pyrolysis to molecularly breakdown the complex carbon compounds into simpler gas compounds, such as carbon monoxide CO and carbon dioxide $CO_2$, and solid waste (slag). The process has been intended to reduce the volumes of MSW being sent to landfill sites and to generate syngas, a useful gas mixture, as an output.

Syngas describes a gas mixture that contains varying amounts of hydrogen $H_2$, carbon monoxide CO, and carbon dioxide $CO_2$, generated through the gasification of a carbon-containing compound. Syngas is combustible, though with typically less than half the energy density of natural gas. It is used as a fuel source or as an intermediate product for the creation of other chemicals. When used as fuel, coal is often used as the source of carbon by the following reactions:

$$C+O_2 \rightarrow CO_2$$

$$CO_2+C \rightarrow 2CO$$

$$C+H_2O \rightarrow CO+H_2$$

This is a mature technology that has seen a renewed interest as a cleaner method of combusting coal than the traditional use of solid coal. When used as an intermediate product in the production of other chemicals such as ammonia, natural gas is typically used as the feed material, since methane has four hydrogen atoms which are desirable for syngas production and methane makes up more than 90% of natural gas. The following steam reforming reaction is used commercially:

$$CH_4+H_2 \rightarrow CO+3H_2$$

The traditional syngas generation technologies using coal and natural gas as feed inputs differ from plasma arc gasification in that they occur within a controlled oxygen environment whereas the plasma arc gasification occurs in an oxygen-free environment. Though designated oxygen-free, through the molecular breakdown of input material, there will be the production of small quantities of oxygen within the process. Further, the coal and natural gas techniques use consistent input materials which results in consistent syngas composition, while plasma arc gasification implementations to date typically use MSW as input material in which feedstock variability leads to syngas variability.

Unfortunately, thus far, there have been no municipal scale implementations of plasma arc gasification due to a number of limiting aspects of the technology. Firstly, most implementations of the technology have not been designed to manage the high flow rate of MSW that would be required in a commercial facility. Further, the pyrolysis techniques used have led to high levels of contaminant compounds such as tars, rather than the full conversion to hydrogen $H_2$, carbon monoxide CO, carbon dioxide $CO_2$ and hydrocarbons (C1 to C4s). The inconsistent nature of the MSW input material has led to high variability in the quality of the generated syngas. Yet further, high levels of energy are consumed in the creation of the plasma arc and, in some instances, in drying the MSW prior to processing due to moisture limits on the input materials, while the generated syngas has a low calorific value, typically less than half of the BTU content of natural gas. These concerns have limited this technology, despite the significant benefits of converting MSW into a valuable product such as syngas.

Against this background, there is a need for solutions that will mitigate at least one of the above problems, particularly enabling the generation of syngas from input material such as MSW and/or MSS in an efficient manner.

SUMMARY OF THE INVENTION

The present invention is directed to system and method for processing material to generate syngas. In various embodiments of the present invention, a reactor chamber is implemented with a plurality of electrodes that can generate an arc within the reactor chamber when electricity is applied. The arc can be used to create free radicals which along with the heat and light of the arc breakdown material comprising carbonaceous material, such as MSW, into gas components that form syngas. The syngas can be extracted from the reactor chamber and be used for various commercial purposes. The reactor chamber may comprise a material feed system operable to move material from a material input opening in the reactor chamber towards the electrodes at a controlled rate. Further, the reactor chamber may comprise a water injection system within the reactor chamber operable to inject water into the reactor chamber while electricity is applied to the electrodes. Yet further, the reactor chamber may comprise a gas removal system within the reactor chamber operable to extract gas generated from breakdown of the material from a plurality of gas removal locations. The gas removal system may be integrated within the material feed system.

According to a first broad aspect, the present invention is a system comprising: a reactor chamber operable to receive material; a plurality of electrodes at least partially protruding into the reactor chamber; a water injection system within the reactor chamber and a gas removal system within the reactor chamber. The electrodes are operable to generate an arc within the reactor chamber when electricity is applied to them. The water injection system is operable to inject water into the reactor chamber while electricity is applied to the electrodes. The gas removal system is operable to extract gas generated from breakdown of the material.

In an embodiment of the present invention, the water injection system is operable to inject water into the reactor chamber at a controlled rate. In some cases, the system comprises a control system operable to control the rate at which water is injected into the reactor chamber by the water injection system based upon a monitored aspect of the gas extracted by the gas removal system. The monitored aspect of the gas may be a level of moisture within the gas extracted by the gas removal system, a level of one or more component parts of syngas within the gas extracted by the gas removal system, and/or a level of contaminants within the gas extracted by the gas removal system. The system may further comprise a material feed system within the reactor chamber operable to move material from a material input opening within the reactor chamber towards the electrodes. The water injection system may be integrated within the material feed system. The water injection system may also be coupled to a water source operable to heat water that is to be provided to the water injection system; for example, using heat from the gas extracted from the reactor chamber.

According to a second broad aspect, the present invention is a method for generating gas within a reactor chamber. The reactor chamber comprises a plurality of electrodes at least partially protruding into the reactor chamber, the electrodes operable to generate an arc within the reactor chamber when electricity is applied to them. The method comprises: causing insertion of material into the reactor chamber, the material comprising carbonaceous material; causing injection of water into the reactor chamber while electricity is applied to the electrodes; and causing extraction of gas generated from the breakdown of the material from the reactor chamber.

In an embodiment of the present invention, the causing injection of water into the reactor chamber is at a controlled rate. In some cases, the method further comprises: monitoring the gas extracted from the reactor chamber; and controlling the rate at which water is injected into the reactor chamber based at least partially upon results from the monitoring. In some cases, the method further comprises causing heating of the water to be injected into the reactor chamber using the gas extracted from the reactor chamber.

According to a third broad aspect, the present invention is a system comprising: a reactor chamber operable to receive material; a plurality of electrodes at least partially protruding into the reactor chamber; a tar injection element within the reactor chamber; and a gas removal system within the reactor chamber. The electrodes are operable to generate an arc within the reactor chamber when electricity is applied to them. The tar injection element is operable to inject tar into the reactor chamber while electricity is applied to the electrodes. The gas removal system is operable to extract gas generated from breakdown of the material and the injected tar within the reactor chamber.

In an embodiment of the present invention, the system further comprises a water injection system within the reactor chamber operable to inject water into the reactor chamber while electricity is applied to the electrodes. The tar injection element may be operable to inject tar into the reactor chamber proximate to the plurality of electrodes and/or the water injection system may be operable to inject water proximate to the plurality of electrodes. In some cases, the water injection system is operable to inject water into the reactor at a controlled rate. The rate of injection of water into the reactor chamber by the water injection system may be at least partially based upon a rate of injection of tar into the reactor chamber by the tar injection element. In an embodiment of the present invention, the system further comprises a $CO_2$ injection element within the reactor chamber operable to inject $CO_2$ into the reactor chamber while electricity is applied to the electrodes. The $CO_2$ injection element may be operable to inject $CO_2$ into the reactor chamber proximate to the plurality of electrodes.

According to a fourth broad aspect, the present invention is a method for generating gas within a reactor chamber. The reactor chamber comprises a plurality of electrodes at least partially protruding into the reactor chamber, the electrodes operable to generate an arc within the reactor chamber when electricity is applied to them. The method comprises: causing insertion of material into the reactor chamber, the material comprising carbonaceous material; causing injection of tar into the reactor chamber while electricity is applied to the electrodes; and causing extraction of gas generated from the breakdown of the material and the tar from the reactor chamber.

In an embodiment of the present invention, the method further comprises causing injection of water into the reactor chamber while electricity is applied to the electrodes. The causing injection of water into the reactor chamber may be at a controlled rate. The rate of injection of water into the reactor chamber may be at least partially based upon a rate of injection of tar into the reactor chamber. In some cases, the method further comprises causing injection of $CO_2$ into the reactor chamber while electricity is applied to the electrodes.

According to a fifth broad aspect, the present invention is a system comprising: a reactor chamber operable to receive material; a plurality of electrodes at least partially protruding into the reactor chamber; a $CO_2$ injection element within the reactor chamber; and a gas removal system within the reactor chamber. The electrodes are operable to generate an arc within the reactor chamber when electricity is applied to them. The $CO_2$ injection element is operable to inject $CO_2$ into the reactor chamber while electricity is applied to the electrodes. The gas removal system is operable to extract gas generated from breakdown of the material and the injected $CO_2$ within the reactor chamber.

In an embodiment of the present invention, the system further comprises a water injection system within the reactor chamber operable to inject water into the reactor chamber while electricity is applied to the electrodes. The $CO_2$ injection element may be operable to inject $CO_2$ into the reactor chamber proximate to the plurality of electrodes and/or the water injection system may be operable to inject water proximate to the plurality of electrodes. In some cases, the water injection system is operable to inject water into the reactor at a controlled rate. The rate of injection of water into the reactor chamber by the water injection system may be at least partially based upon a rate of injection of $CO_2$ into the reactor chamber by the $CO_2$ injection element. In an embodiment of the present invention, the system further comprises a tar injection element within the reactor chamber operable to inject tar into the reactor chamber while electricity is applied to the electrodes. The tar injection element may be operable to inject tar into the reactor chamber proximate to the plurality of electrodes.

According to a sixth broad aspect, the present invention is a method for generating gas within a reactor chamber. The reactor chamber comprises a plurality of electrodes at least partially protruding into the reactor chamber, the electrodes operable to generate an arc within the reactor chamber when electricity is applied to them. The method comprises: causing insertion of material into the reactor chamber, the material comprising carbonaceous material; causing injection of $CO_2$ into the reactor chamber while electricity is applied to the electrodes; and causing extraction of gas generated from the breakdown of the material and the $CO_2$ from the reactor chamber.

In an embodiment of the present invention, the method further comprises causing injection of water into the reactor chamber while electricity is applied to the electrodes. The causing injection of water into the reactor chamber may be at a controlled rate. The rate of injection of water into the reactor chamber may be at least partially based upon a rate of injection of $CO_2$ into the reactor chamber. In some cases, the method further comprises causing injection of tar into the reactor chamber while electricity is applied to the electrodes.

These and other aspects of the invention will become apparent to those of ordinary skill in the art upon review of the following description of certain embodiments of the invention in conjunction with the accompanying drawings.

BRIEF DESCRIPTION OF THE DRAWINGS

A detailed description of embodiments of the invention is provided herein below, by way of example only, with reference to the accompanying drawings, in which.

It is to be expressly understood that the description and drawings are only for the purpose of illustration of certain embodiments of the invention and are an aid for understanding. They are not intended to be a definition of the limits of the invention.

DETAILED DESCRIPTION OF EMBODIMENTS

The present invention is directed to system, apparatus and method for processing material to generate syngas. As will be described herein below, the system of the present invention includes a number of different distinct mechanical elements that together allow for an efficient process flow from material input to syngas output. The system, according to some embodiments of the present invention, is designed to allow for processing of material in a controlled manner through management of various aspects of the process including, but not limited to, free radical generation, material movement rate, arc electrical power and syngas extraction locations.

The key material input needed to generate syngas is carbonaceous material (i.e. material containing carbon-based molecules). In various embodiments, the input material may be a wide range of carbonaceous materials or carbonaceous material mixed with extraneous non-carbonaceous material. In the case that it is a mixture of material, the extraneous material may be sorted out or processed into a waste output as will be described. In some embodiments, the input material may be Municipal Solid Waste (MSW) and/or Municipal Solid Sludge (MSS). In other embodiments, the input material may comprise construction waste (ex. wood, plywood, chip board, shingles, etc.), agricultural waste (ex. wood chips, plant matter, mulch, other biomass, etc.), rubber tires, medical waste, coal, oil, waxes, tars, liquids such as water containing carbonaceous material and/or gases such as carbon dioxide. In some embodiments, there may be limits on the proportion of the material that can comprise liquids and/or gases. Although examples of input material are provided, it should be understood that the scope of the present invention should not be limited by these example materials. Other material may be used as an input to the system of the present invention including, but not limited to, solid carbonaceous material and semi-solid carbonaceous material.

In the case of the input material being MSW or another input material that may have a mixture of carbonaceous material and extraneous material, a pre-sort may be performed. For instance, recyclable materials (ex. metals, glass, useable plastics, etc) and hazardous materials (ex. radioactive materials, batteries, fluorescent light bulbs, etc.) may be pre-sorted out. Extraneous material that is input to the system as will be described will effectively result in additional waste. For example, as will be described, metals may be melted and form pellets and other non-organic material (ex. glass, ceramics, etc.) may be melted and form vitrified granular material that may encapsulate heavy metals.

Figure 1A:
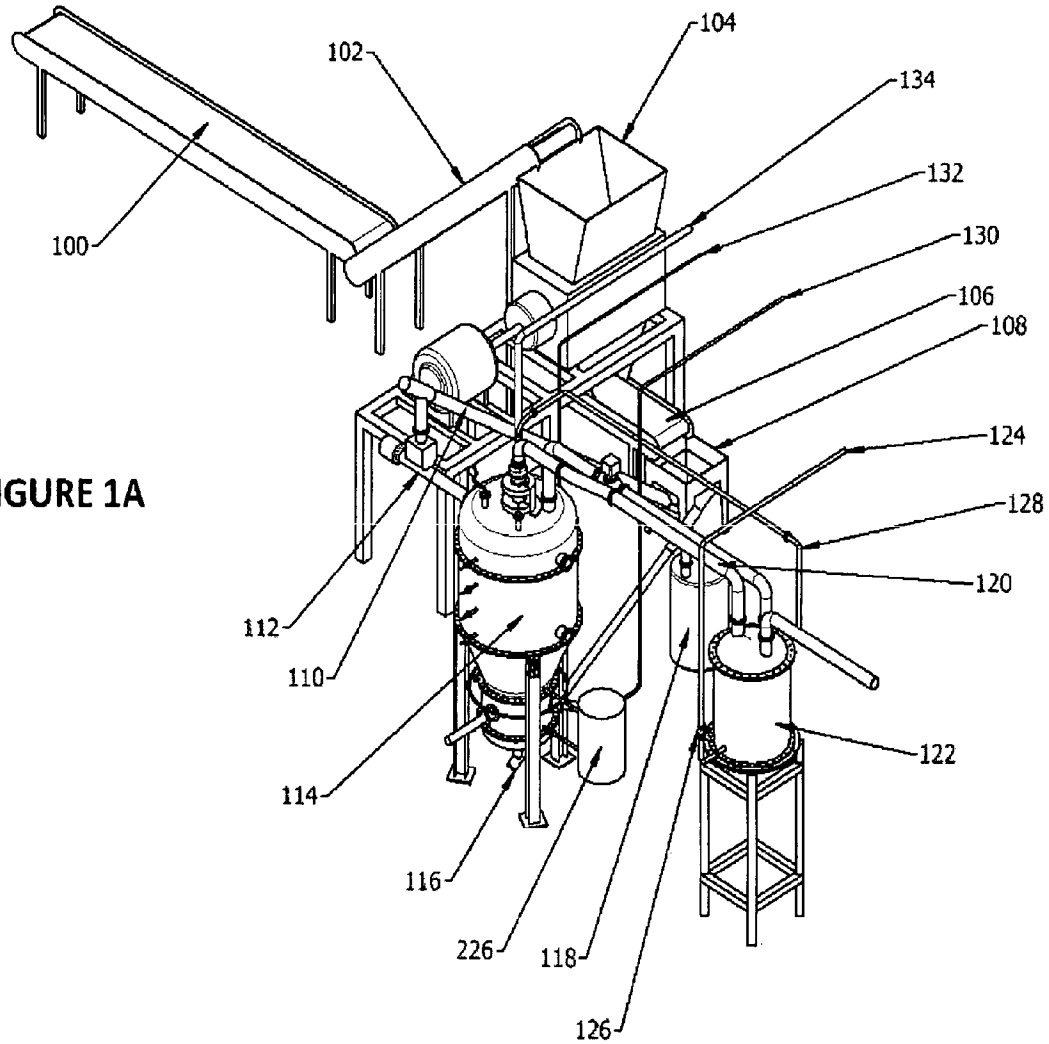
FIGS. 1A and 1B are first and second perspective views respectively of a material processing system according to an embodiment of the present invention.
Figure 1B:
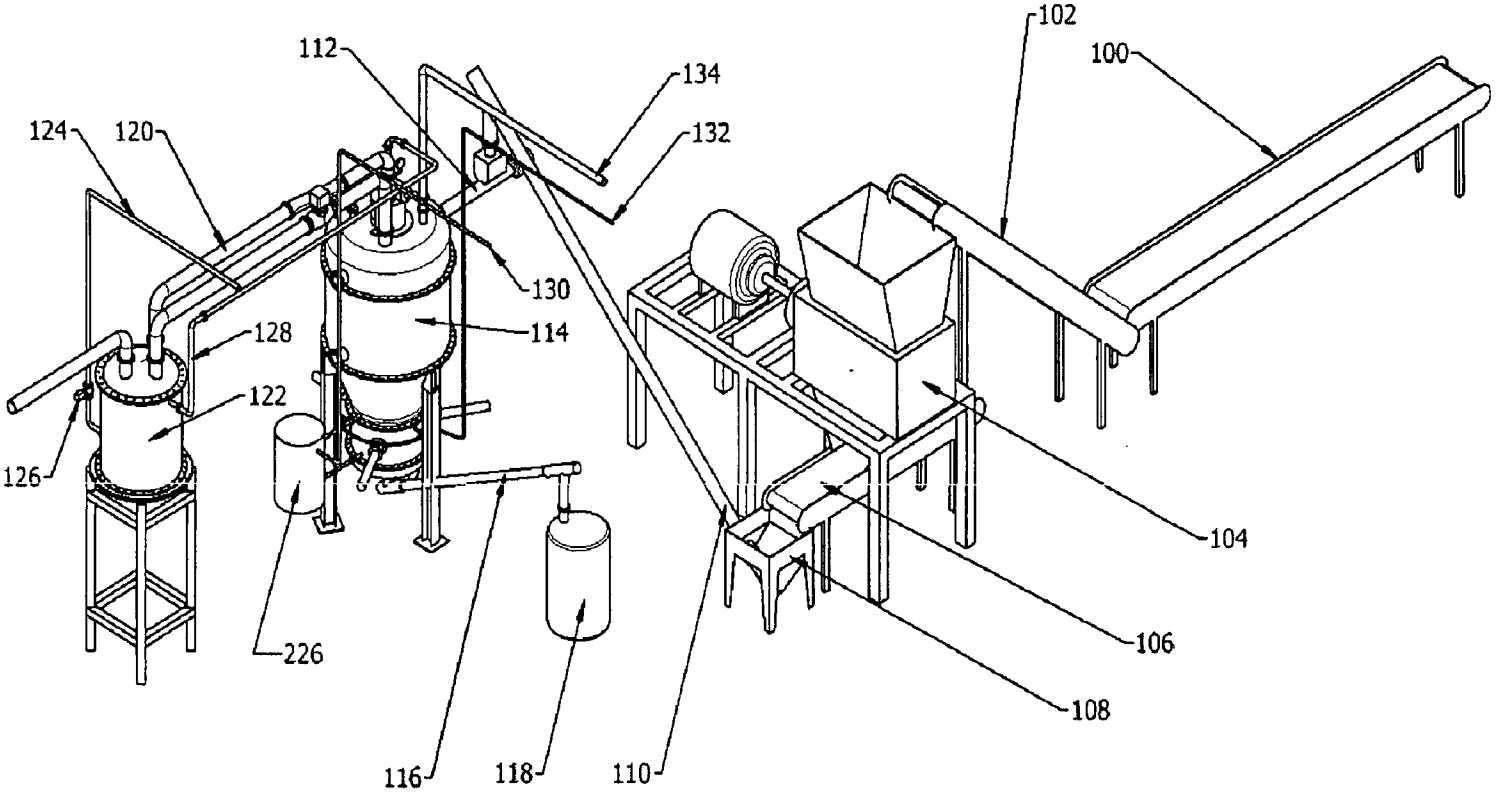

FIGS. 1A and 1B are first and second perspective views respectively of a material processing system according to an embodiment of the present invention. As shown, the material processing system comprises first and second conveyors 100, 102 operable to move input material into a shredder 104. Along conveyor 100, operators may sort the input material in order to remove non-organic material for recycling and hazardous materials for proper disposal. The remaining material, which would normally comprise significant organic material, is conveyed by the conveyor 102 and dropped into the shredder 104. The shredder 104 is operable to reduce the material in size sufficient for further processing. The maximum size that the shredder 104 reduces the input material to is dependent upon dimensions within the remainder of the particular system.

The material processing system of FIGS. 1A and 1B further comprises a third conveyor 106, a load hopper 108, a material feed conveyor 110, a material injection system 112 and a Free Radical Gasification (FRG) reactor 114, that can more generally be referred to as a reactor chamber. From the shredder 104, the input material is dropped onto the third conveyor 106 which carries the material into the load hopper 108. Feed conveyor 110 then transfers the input material into a top opening within the material injection system 112. In some cases, the size that the shredder 104 reduces the input material is determined by dimensions within the material injection system 112. In embodiments of the present invention, each of the conveyors 100,102,106,110 is controlled to deliver material into the material injection system 112 at a desired rate. The desired rate may change based on conditions within the system. For example, the desired rate of input may be adjusted based upon aspects of the resulting syngas from the system.

The input material, after being dropped into the top opening within the material injection system 112, is moved towards the FRG reactor 114 and may further be compressed by the material injection system 112. This movement can be done through a number of techniques including, but not limited to, a screw mechanism. The process of moving the material towards the FRG reactor 114 and compressing the material for one particular embodiment of the present invention will be described in more detail with reference to FIGS. 3A, 3B, 3C and 4.

The material is input into an opening near the top of the FRG reactor 114 by the material injection system 112. As will be described with reference to FIGS. 2A and 2B, rotational motion of a screw mechanism within the FRG reactor 114 causes the input material to move downward through the FRG reactor 114. Within the lower portion of the FRG reactor 114 is a plurality of electrodes as will be described in detail with reference to FIGS. 10 to 14 which when electricity is applied, generates an arc with a high intensity light and high heat. The arc combined with the possible injection of water into the FRG chamber 114, allows for a Free Radical Gasification (FRG) zone to form. Material exposed to the high intensity light and high heat of the arc is reduced from long organic molecular chains to simpler molecules. Additionally, the arc cleaves molecules, producing highly reactive free radicals which then can also reduce even more molecules. The free radicals act in parallel to the thermolytic reactions to break down the long organic molecular chains, thus improving the amount of material broken down in the process. This can lead to lower energy usage per unit of material processed.

The input material is directed into the FRG zone by the screw mechanism within the FRG reactor 114 at a rate that that can be substantially similar to the conversion rate of the material into syngas within the FRG zone. A large portion of the resulting molecular structures from the breakdown of the material can comprise components of syngas such as hydrogen ($H_2$) and carbon monoxide (CO). The syngas that is produced is at a high temperature and is drawn off in one or more locations in close proximity to the FRG zone, at various elevations above the FRG zone and/or near the top of the FRG reactor 114. The syngas may contain contaminants such as vapourized tars, water vapour and particulate matter. In some embodiments, the syngas is extracted from a location close to the FRG zone, as the syngas at this location may have the least amount of contaminants, thus reducing the cost of subsequent cleaning of the syngas. In other embodiments, syngas extraction may be at locations further above the FRG zone to allow the syngas, which will be at a high temperature, to contribute to pyrolysis of the input material. Pyrolysis can additionally breakdown long chain molecules within the input material.

Within the system of FIGS. 1A and 1B, the syngas extracted from the FRG reactor 114 is piped along syngas transfer pipe 120 to a condensate tank 122 in which water can be used to cool the syngas causing condensation of entrained water and contaminant vapours in the condensate tank 122. The cooling water can be inserted into a water jacket (not shown) enclosing the condensate tank 122 and/or into a coil (not shown) within the tank 122 from water pipe 124 and through a water valve 126 that can control the flow of water into the condensate tank 122. The cooling water, while cooling the hot syngas within the condensate tank 122, will increase in temperature as a result. This warmed water may then be piped from the water jacket and/or coil within the condensate tank 122 through water pipe 128 to the top of the FRG reactor 114 and injected into the FRG reactor 114 as will be described with reference to FIG. 2B. The high intensity light and high heat of the arc cause homolytic bond cleavage of the water molecules resulting in a significant source of free radicals within the FRG reactor 114. The contribution of this additional source of free radicals can aid in energy requirement reduction and can also provide a significant source of desirable atoms which ultimately form the resulting syngas. Some of the hydrogen from the water molecules becomes $H_2$ and some of the oxygen from the water molecules combines with carbon to form CO.

Although in the system of FIGS. 1A and 1B, the same water is used as a cooling agent for the syngas and as the water for the generation of free radicals within the FRG reactor 114, it should be understood that in other embodiments this may not be the case. In some embodiments, a separate cooling agent could be used to reduce the temperature of the syngas while water may be injected into the FRG reactor 114 from an alternative source.

To aid in waste product management, water may also be maintained in a pool at the bottom of the FRG reactor 114. Non-organic material such as glass, ceramic, dirt etc. that enter the FRG reactor 114 within the input material will become molten in or near the FRG zone and drop into the water pool at the bottom of the FRG reactor 114 (below the FRG zone) to cool into vitrified particles. Similarly, metal pieces that enter within the input material will be melted in or near the FRG zone and become metal pellet-like particles in the water pool. In some embodiments of the present invention, the level in the water pool is maintained below the FRG zone and is maintained by a leveling system with an external water reservoir tank 226. Water is supplied to the external tank 226 through water pipe 130.

The pellet-like waste components from the non-organic material and metal can be removed through a hole in the bottom of the FRG reactor 114 and dropped onto a waste conveyor 116. The waste components can then be conveyed to a waste receptacle container 118 where they can be sorted and processed into saleable commodities such as aggregates and metals. The waste conveyor 116 is angled upwards from the hole in the bottom of the FRG reactor 114 to above the waste receptacle container 118 such that, although water from the water pool may enter the waste conveyor 116, the level of the water in the waste conveyor 116 will be below the top of the waste conveyor 116 and therefore will not typically enter the waste receptacle container 118. The elevation of the waste conveyor 116 may further accommodate differences in pressure between the FRG reactor 114 and the waste conveyor 116 that could change the level of the water within the waste conveyor 116.

The syngas that exits the condensate tank 122 may be removed and processed to further remove contaminants such as water, tars and vapourized metals. The syngas, once cleaned, may be used for many well-known purposes including, but not limited to, as fuel feedstock for combustion in heating systems, boilers and/or electrical generators or as an input within a conversion process to produce diesel fuel, methanol or ammonia.

Prior to starting the material processing system of FIGS. 1A and 1B, an oxygen purging process may be performed within the FRG reactor 114. Specifically, a non-oxygen containing gas (ex. Nitrogen) may be input to the FRG reactor 114 through purge supply pipe 132. This non-oxygen containing gas is used to substantially remove all available oxygen from the FRG reactor 114, thus preventing combustion within the FRG reactor 114 when the input material is brought into contact with high temperatures from the arc.

As an additional safety feature, the FRG reactor 114 may be fitted with a low pressure burst disk or a reusable Pressure Safety Relief Valve (PSRV) 252 (shown in FIG. 2B) and a relief pipe 134 operable to dump gas to a safe location (ex. external to a building) if the pressure within the FRG reactor 114 exceeds a designed limit. These safety features could be used in the case that a significant problem occurred such as a blockage in the syngas transfer pipe 120.

Figure 2A:
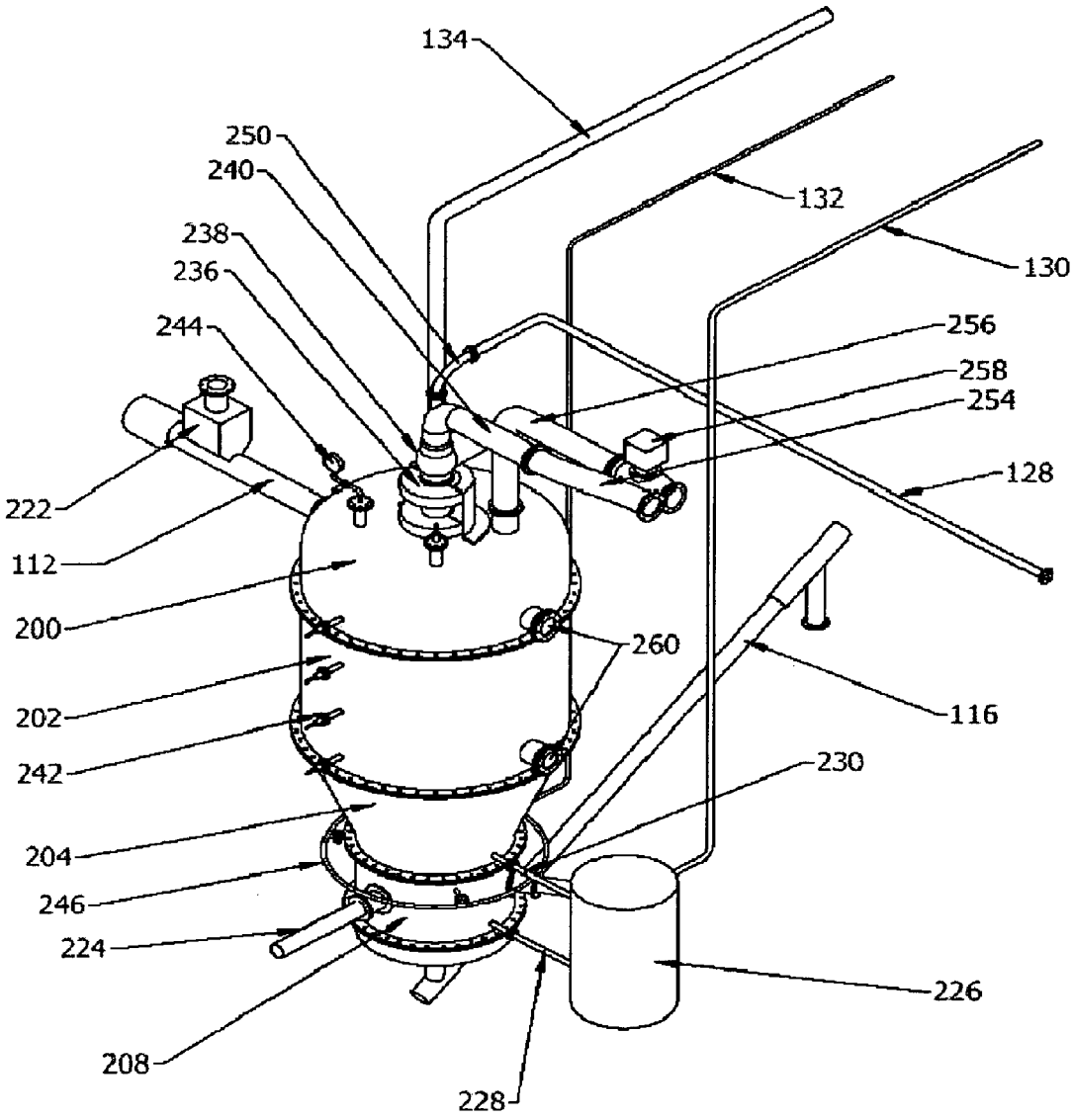
FIGS. 2A and 2B are a top angular view and a cross-sectional side view respectively of an FRG reactor according to an embodiment of the present invention.
Figure 2B:
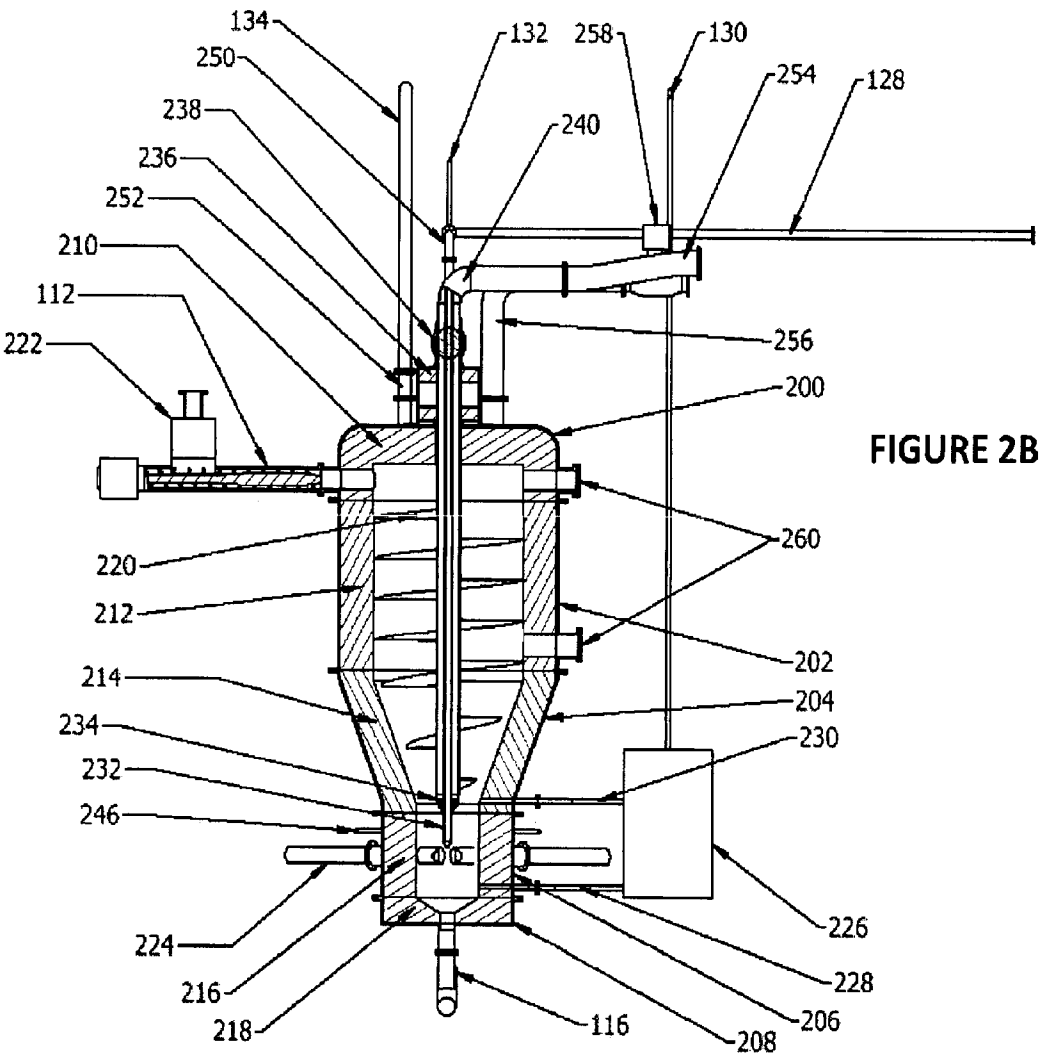

FIGS. 2A and 2B are a top angular view and a cross-sectional side view respectively of the FRG reactor 114 according to an embodiment of the present invention. Shown in FIGS. 2A and 2B, the FRG reactor 114 comprises an FRG reactor top section 200, an FRG reactor main body section 202, an FRG reactor transition section 204, an FRG reactor base section 206 and an FRG reactor bottom section 208 assembled together to form the outer shell of the FRG reactor 114. Each of the sections of the FRG reactor 114 has a corresponding refractory liner with sufficient refractory properties to withstand the high temperatures within the FRG reactor 114 caused by the arc and to provide insulation to the outside of the FRG reactor 114. In particular, the FRG reactor 114 comprises a top section refractory liner 210, a main body refractory liner 212, a transition refractory liner 214, a base refractory liner 216 and a bottom refractory liner 218 that each are within the inner surface of a corresponding one of sections 200,202,204,206,208 respectively. In some embodiments, two layers of refractory liners are utilized for each section: an inner layer with high refractory properties but poor insulation properties that can withstand the high temperatures of the arc and exposure to the input material being converted; and an outer layer coupled to the inner wall of the FRG reactor 114 with superior insulation properties.

Together the main body, transition and base sections 202, 204,206 of the FRG reactor 114 form an upright cylindrical chamber with a first diameter in the main body section 202 and a second smaller diameter within the base section 206. The transition section 204 is cylindrical with a narrowing diameter from top to bottom, from the first diameter to the second diameter. The top section 200 and the bottom section 208 enclose and seal the cylindrical chamber.

The sections of the FRG reactor 114 in FIG. 2A comprise openings for various pipes and apparatus. For instance, the top section 200 comprises openings for the material injection system 112; a flexible water coupling 250 coupled to the water pipe 128; the low pressure burst disk/PSRV 252 coupled to the relief pipe 134; a syngas outlet pipe 240 that is coupled via a flexible syngas line coupling 254 to the syngas transfer pipe 120; and a secondary syngas outlet pipe 256 that is coupled to a secondary syngas control valve 258. The secondary syngas outlet pipe 256 may be used in a number of manners in various embodiments of the present invention. In particular, the secondary syngas outlet pipe 256 may provide a complementary syngas extraction location; provide an alternative syngas extraction location in case of a partial or complete obstruction in the syngas outlet pipe 240; and/or provide a location to extract the non-oxygen containing gas used in the oxygen purging process described above.

The base section 208 comprises openings for a plurality of electrodes 224 that protrude through the base section from outside of the FRG reactor 114 to inside. Within the embodiment of FIGS. 2A and 2B, there are three electrodes 224 each protruding horizontally into the FRG reactor 114 at 120° from each other and almost meeting at the center of the base section 206. The electrodes have a gap between them in which the arc will form when electricity is conducted through the electrodes 224. Different configurations for the electrodes 224 will be described in detail with reference to FIGS. 10 to 14. The bottom section 208 comprises an opening for removal of waste components to the waste removal conveyor 116 as described above.

The FRG reactor 114 of FIG. 2B further comprises a Material Feed Screw (MFS) 220 that is operable to move the input material from the opening in the FRG reactor 114 with the material injection system 112 towards the arc (and the FRG zone) formed by the electrodes 224 in operation. The MFS 220 comprises a feed screw shaft 702 with one or more protruding feed screw flutes 700 as will be described with reference to FIGS. 7A to 7E. The MFS 220 is positioned vertically within the center of the FRG reactor 114 with the top end of the feed screw shaft 702 protruding through the top section 200 and the bottom end of the feed screw shaft 702 ending above the electrodes 224. In the embodiment of FIG. 2A, the bottom end of the feed screw shaft 702 ends at approximately the seam between the transition section 206 and the base section 208. The top end of the feed screw shaft 702 is coupled to an MFS drive system 238 external to the FRG reactor 114 through a bearing and seal element 236. The MFS drive system 238 is operable to rotate the MFS 220 which will in turn result in the movement of the input material from the top of the FRG reactor 114 towards the arc formed by the electrodes 224.

The rate of rotation of the MFS 220 may be controlled in a number of manners. In one embodiment, the rate of rotation of the MFS 220 may be controlled by a computing apparatus (not shown). In other embodiments, the rate of rotation of the MFS 220 may be modified manually or may be of a fixed rate. In one embodiment, the rate of rotation of the MFS 220 may be determined based upon a monitored aspect of the syngas being extracted from the FRG reactor 114. In other embodiments, the rate of rotation of the MFS 220 may be determined based upon a rate of breakdown of the input material.

As will be described in detail with reference to FIGS. 7A-7E, the FRG reactor 114 further comprises a syngas removal system 234 that is integrated within the feed screw shaft 702 in FIG. 2B. The syngas removal system 234 comprises a syngas removal pipe 704 implemented inside the feed screw shaft 702 and coupled at the top end to the syngas outlet pipe 240 external to the FRG reactor 114. The syngas outlet pipe 240 is coupled via a flexible syngas line coupling 254 to the syngas transfer pipe 120 and therefore to the condensate tank 122. The lower end of the syngas removal pipe 704 protrudes from the lower end of the feed screw shaft 702 and has a nozzle on the end. The nozzle, as shown in FIG. 2B, is above the electrodes 224 (approximately at the seam between the transition and base sections 204,206) and in operation would be close to the arc formed by the electrodes 224, thus allowing for removal of syngas from a location close to the FRG zone. It should be understood that in other embodiments, the syngas removal system 234 may allow for removal of the syngas from alternative locations further from the FRG zone as will be described with reference to FIGS. 9A-9F. In some embodiments of the present invention, a differential between the internal pressure of the FRG reactor 114 and atmospheric pressure can allow for improved removal of syngas through the nozzle in the syngas removal pipe 704 and/or other alternative locations.

Further, as will be described in detail with reference to FIGS. 7A-7E, the FRG reactor 114 comprises a water injection system 232 integrated within both the feed screw shaft 702 and the syngas removal pipe 704 in FIG. 2B. The water injection system 232 comprises a water injection pipe 706 implemented inside both the feed screw shaft 702 and the syngas removal pipe 704 and coupled at the top end to the water pipe 128 external to the FRG reactor 114. The lower end of the water injection pipe 706 protrudes from the lower end of the feed screw shaft 702 and has a nozzle on the end. The nozzle, as shown in FIG. 2B, is adjacent to the electrodes 224 and in operation would be above the arc formed by the electrodes 224, thus allowing for injection of water into the FRG zone. In some embodiments, the nozzle of the water injection pipe 706 may be close to the FRG zone but sufficiently far as to not melt the nozzle. The injection of water into the FRG zone will allow for the generation of additional free radicals as the arc breaks down the water molecules into their base components. The hydrogen within the water molecules may then be extracted within the syngas as $H_2$ and the oxygen may combine with carbon molecules to form carbon monoxide (CO), both of which are significant components of syngas. The syngas removal system 234 will be described in detail Although the embodiment described with reference to FIGS. 7A-7E has the syngas removal pipe 704 and the water injection pipe 706 integrated within the MFS 220, this should not limit the scope of the present invention. In alternative embodiments of the present invention, one or both of the syngas removal and the water injection may not be integrated within the MFS 220. In these alternative embodiments, the syngas removal may occur in a different location and/or the water injection may occur in a different location or not at all.

As shown in FIG. 2A, the external water reservoir tank 226 is adjacent to the FRG reactor 114 and is coupled to a water pipe 228 that passes through the base section 206 into the FRG reactor 114, a pressure equalization pipe 230 that passes through the transition section 204 into the FRG reactor 114 and the water pipe 130 which is coupled to a source of water. A water level may be maintained at a desired level within the external water reservoir tank 226 using one of a plurality of well-known water leveling techniques (ex. a float level system). The pressure equalization pipe 230 ensures the pressure in the FRG reactor 114 above the water pool remains the same as the pressure above the water level in the tank 226. Water can freely flow between the tank 226 and the FRG reactor 114 via the water pipe 228 and, due to the pressure being matched with the pressure equalization pipe 230, gravity will cause water to flow into the FRG reactor 114 until the water level is equal to the water level in the external water reservoir tank 226. As water is consumed within the FRG reactor 114 or exits through the waste conveyor 116, the leveling system adds more water to maintain the water pool at the appropriate water level. This embodiment of water leveling of the water pool in the FRG reactor 114 allows for a range of operating water levels with varying distances relative to the FRG zone to be controlled by an operator and/or a computing apparatus by controlling the water level within the tank 226.

In order to allow an operator to monitor aspects within the internal operation of the FRG reactor 114, the top section 200 further comprises a pressure gauge and transducer 244 and the main body section 202 comprises a plurality of temperature probes 242. The pressure gauge can provide immediate visual indications of internal pressure within the FRG reactor 114. The pressure transducer may be connected to a computing apparatus (not shown) and provide information on the pressure within the FRG reactor 114 to an operational control system. The operational control system may be able to adjust many aspects of the overall system to manage the pressure within the FRG reactor 114. In some embodiments, a syngas control valve (not shown) may be implemented after the condensate tank 122 to stabilize the internal pressure within the FRG reactor 114 at a desired level. In one embodiment, that level may be 1 PSI, though in other embodiments, other pressure levels within the FRG reactor 114 may be desired. An operational control system managed by an operator and/or a computing apparatus may control the syngas control valve in response to the measured pressure levels in the FRG reactor 114 received from the pressure guage and pressure transducer 244. An operator and/or a computing apparatus may further monitor temperatures within the FRG reactor 114 using the temperature probes 242.

Further, in the embodiment of FIGS. 2A and 2B, the top section 200 and the main body section 202 each comprise a sight port 260 that can be used to monitor the progress of movement and/or breakdown of the input material within the FRG reactor 114. The sight ports 260 may comprise a clear quartz material, though other materials may also be used. Although the site ports 260 may become dirty as the FRG reactor 114 is in use, during start-up, the site ports 260 may provide an ability to visually observe inside the FRG reactor 114 including the MFS 220. Further, the site ports 260, in some embodiments, may provide access to withdraw a sample of the input material and/or be adapted to add a tertiary syngas removal pipe. In some embodiments, no site ports are included within the FRG reactor 114.

Yet further, in the embodiments of FIGS. 2A and 2B, a purge injection ring 246 surrounds the FRG reactor 114, in this case around the base section 206. The purge injection ring 246 is coupled to a plurality of purge injection sites that protrude through the walls of the FRG reactor 114, in this case through the base section 206, and is further coupled to the purge supply pipe 132. The purge supply pipe 132 is coupled to one or more tanks containing a non-oxygen containing gas (ex. Nitrogen) and supplies the non-oxygen containing gas to the purge injection ring 246 which can subsequently be injected into the FRG reactor 114 during the purging process to remove oxygen from the FRG reactor 114 prior to operation of the system.

In operation, the FRG reactor 114 operates to produce syngas through the molecular breakdown of the input material. This entails breaking chemical bonds with both thermal decomposition and the action of free radicals. The free radicals are formed, from both input material and injected water, using the high intensity light and high temperature generated by the electric arc. The temperature within the FRG reactor 114 is controlled by the electrical energy applied to the electrodes 224 in order to create a zone of free radicals (the FRG zone) that can be used to stimulate further molecular breakdown. In addition to the primary means of temperature control, other means of controlling the temperature are the rate of entry of input material, rate of removal of gas, and the rate of injection of water. The final composition of the syngas can be manipulated through control of the conversion temperatures.

It should be noted that pyrolysis will also occur within the input material due to the high temperatures within the FRG reactor 114, producing significant amounts of syngas. Further, as the gas progresses upwards within the FRG reactor 114, the heated gas may result in pyrolysis within the cooler input material that has not yet reached the FRG zone close to the arc, breaking down some of the molecular structures within this material. Further, vaporous components (ex. tars, gums, etc.) within the gas that moves upwards in the FRG reactor 114 may condense onto the cooler input material above the arc and then subsequently be moved into the FRG zone by the MFS 220. These components may then be broken down and contribute positively to the production of the syngas.

Figure 3A:
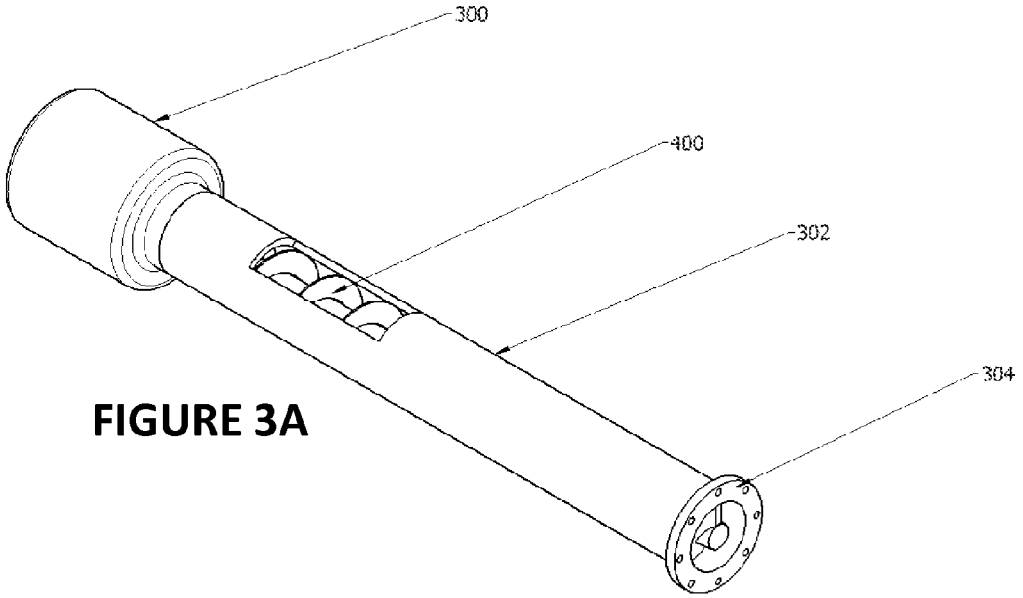
FIGS. 3A, 3B and 3C are a top angular view, a top view and a side view respectively of a material injection system operable to move material into the FRG reactor of FIGS. 2A and 2B according to one embodiment of the present invention.
Figure 3B:
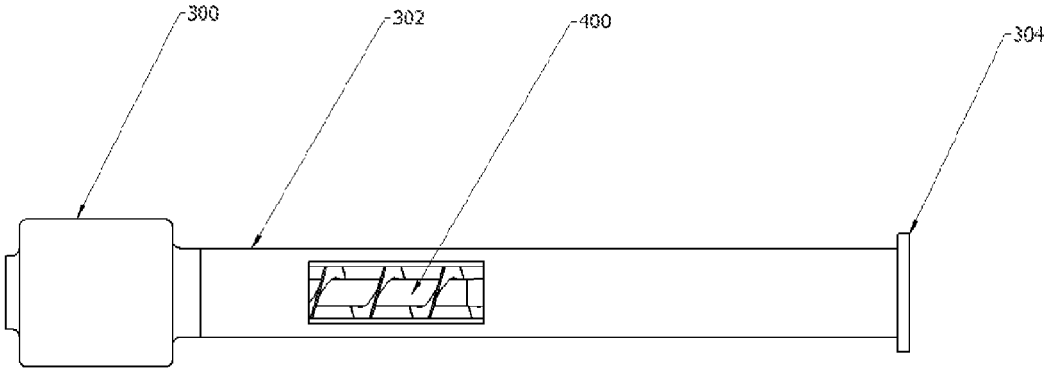
Figure 3C:
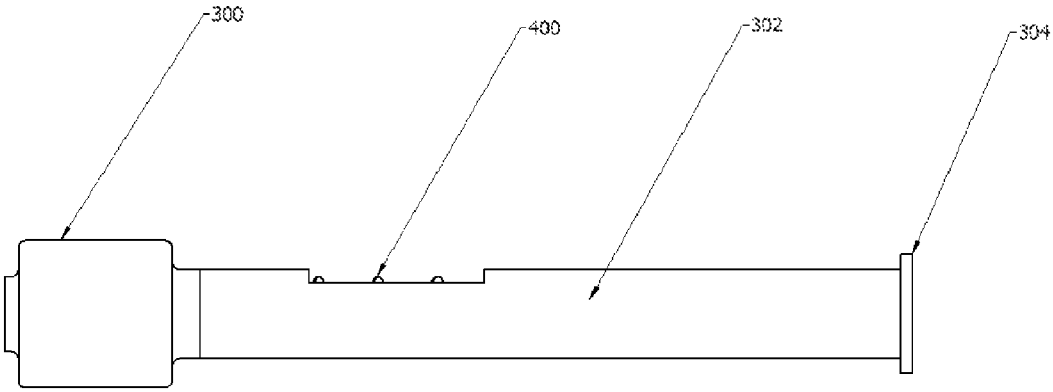

FIGS. 3A, 3B and 3C are a top angular view, a top view and a side view respectively of the material injection system 112 operable to move material into the FRG reactor 114 according to one embodiment of the present invention. Shown in FIGS. 3A, 3B and 3C, the material injection system 112 comprises a cylindrical barrel 302 that encloses a Material Injection Screw (MIS) 400. The barrel 302 is coupled to a mounting flange 304 at one end that enables the material injection system 112 to be mounted horizontally to a corresponding opening within the top section 400 of the FRG reactor 114. The barrel 302 comprises an opening in the top surface of the cylindrical body sufficient in size to allow material conveyed to the material injection system 112 from the shredder 104 to enter the barrel 302 between flutes on the MIS 400. The material injection system 112 further comprises an injection screw drive 300 mounted to the barrel 302 and connected to the MIS 400 that is operable to rotate the MIS 400 in order to move input material that enters through the opening in the top of the barrel 302 towards the FRG reactor 114. The injection screw drive 300 may be controlled locally or by a central computing apparatus (not shown) to manage the feed rate. In some embodiments, the injection screw drive 300 may be able to sense problems in the material injection system 112, such as a blockage caused by the particular input material inserted (ex. metal jamming the MIS 400) through monitoring of torque on the MIS 400. In response, the injection screw drive 300 may send a warning message to an operator, terminate the rotation of the MIS 400 and/or reverse rotation of the MIS 400.

The opening in the top surface of the barrel 302, in the embodiment of FIGS. 3A, 3B and 3C, is close to the opposite end of the barrel 302 from the mounting flange 304, which will be coupled to the FRG reactor 114. This distance between the opening in the top surface of the barrel 302 and the FRG reactor 114 allows the material injection system 112 to affect the input material in one of a number of ways prior to the material entering the FRG reactor 114. In embodiments of the present invention, as the rotation of the MIS 400 causes the input material to move towards the FRG reactor 114, the material may encounter changing conditions along the length of the MIS 400 that cause compression of the material. In particular, an increase in the diameter of a shaft of the MIS 400 and/or a reduced flute pitch of the MIS 400 can reduce the volume between sequential flutes of the MIS 400, effectively imparting significant compression on the material. The compressed material can form an effective seal against the low internal pressure within the FRG reactor 114 and prevent syngas and other gaseous components from exiting the FRG reactor 114 via the material injection system 112. At the end of the material injection system 112 mounted to the FRG reactor 114, the shaft of the MIS 400 may have a diameter reduction and/or the flute pitch of the MIS 400 may be increased to allow the input material to expand prior to entering into the FRG reactor 114. Gas that permeates out of the FRG reactor 114 may be forced back into the FRG reactor 114 by the movement of the input material.

Figure 4:
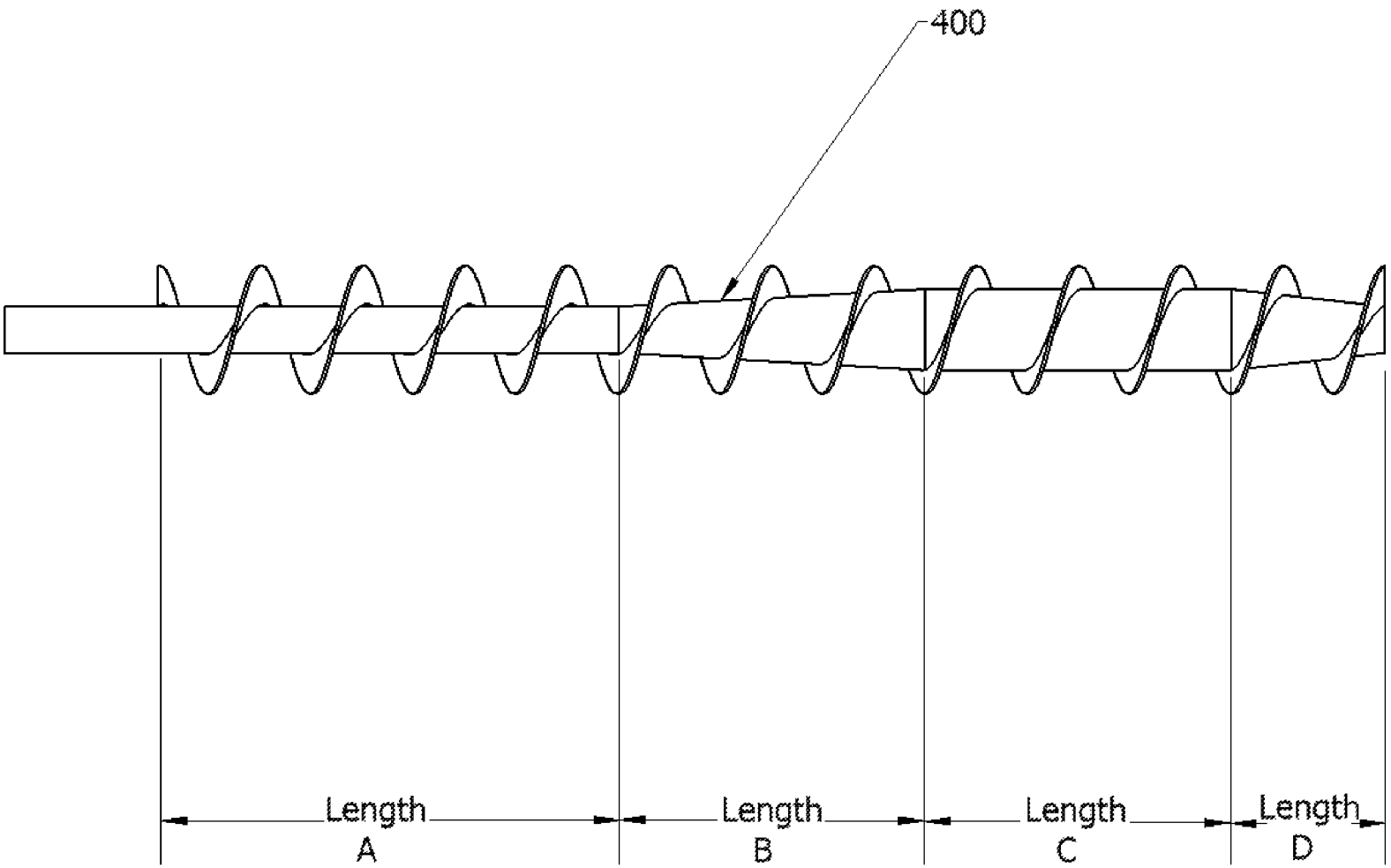
FIG. 4 is a side view of a sample material injection screw that may be within the material injection system of FIGS. 3A, 3B and 3C.

FIG. 4 is a side view of one particular sample MIS 400 that may be within the material injection system 112 of FIGS. 3A, 3B and 3C. It should be understood that the material injection screw 400 depicted in FIG. 4 is only a sample embodiment of the MIS 400 and other implementations could be designed to allow movement of the input material into the FRG reactor 114. In this embodiment, the MIS 400 comprises four segments, labeled Length A, Length B, Length C and Length D in FIG. 4. In Length A, the shaft of the MIS 400 is of uniform diameter and the MIS 400 has a uniform flute pitch, which would allow the MIS 400 in operation to move the input material but not to significantly provide compression. In Length B, the shaft of the MIS 400 has an increasing diameter left to right, which allows in operation for compression of the input material as it passes the Length B of the MIS 400. In Length C, the shaft of the MIS 400 has uniform diameter, greater than the uniform diameter of Length A. This uniform diameter maintains the input material in compressed form as it passes the Length C in operation, which can provide an effective seal preventing gaseous material from exiting the FRG reactor 114 through the material injection system 112. In Length D, the shaft of the MIS 400 has a decreasing diameter left to right, which may allow for some expansion of the input material and easier injection of the input material into the FRG reactor 114.

Figure 5A:
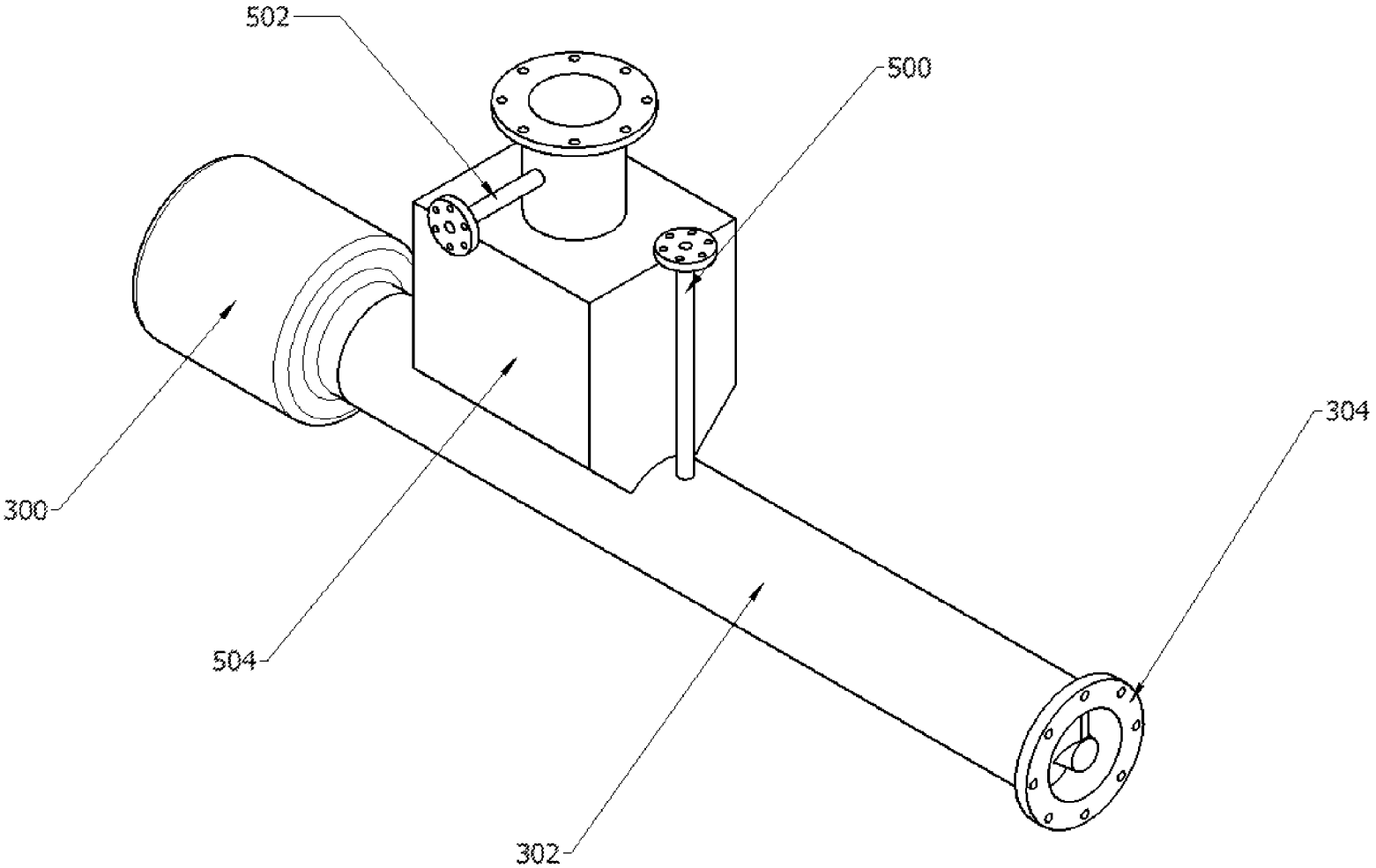
FIGS. 5A, 5B and 5C are a top angular view, a top view and a side view respectively of a material injection system according to an alternative embodiment in which the material injection system includes attachments for injection of tars and/or water.
Figure 5B:
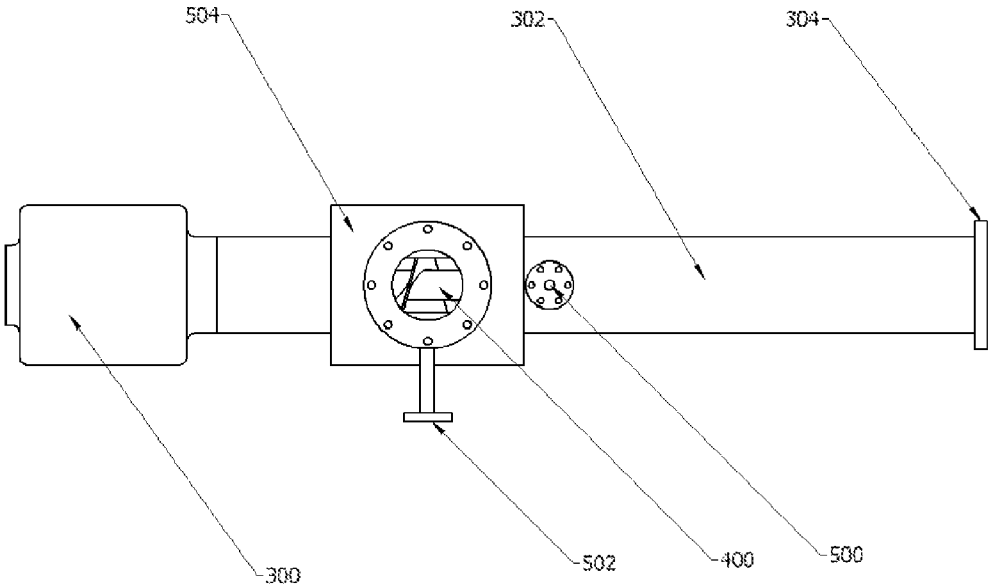
Figure 5C:
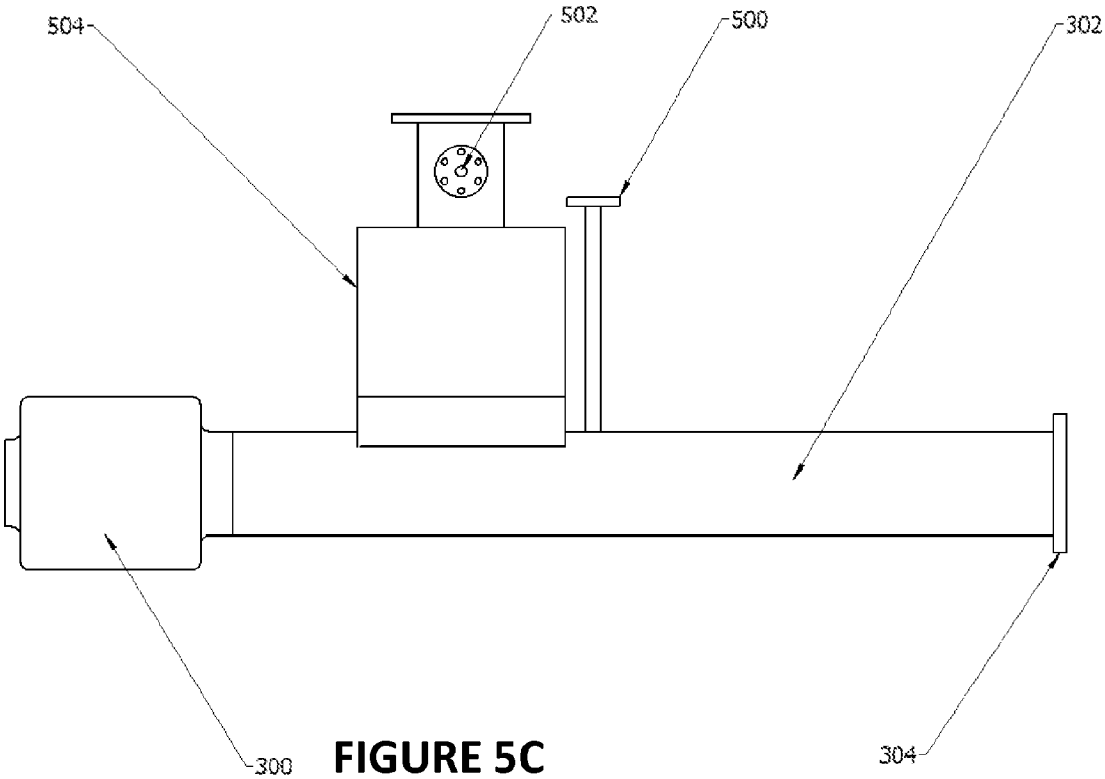

It should be understood that the embodiment of FIGS. 3A-3C is only one particular implementation of the material injection system 112. FIGS. 5A, 5B and 5C are a top angular view, a top view and a side view respectively of the material injection system 112 according to an alternative embodiment in which the material injection system 112 includes attachments for injection of tars and/or water. As shown, the opening in the top surface of the barrel 302 is covered by a material injection system hopper 504 that can be used to aid in the insertion of material into the material injection system 112. The hopper 504 comprises a top opening in which it may receive input material from the feed conveyor 110, a bottom opening that matches the opening in the top surface of the barrel 302 and an attachment 502 operable to allow additional components, such as tars, to be mixed with the input material.

The tars may come from waste within the overall system, for example tars may be produced from pyrolysis and may precipitate out of the FRG reactor 114 to the condensate tank 122, or may come from an external source. The tars are higher molecular weight by-products that are carbon-containing flammable material but are not sufficiently volatile to form a desired component of the syngas. The addition of tar to the input material can be beneficial in a number of ways. For one, the tar is carbonaceous and may be consumed within the FRG reactor 114, thus increasing the production of syngas. Further, the tars may fill interstices within the input material when compressed by the MIS 400, which may improve the ability of the input material to prevent gas from exiting from the FRG reactor 114 through the material injection system 112. Yet further, the tars may aid in lubricating the inside of the barrel 302 and/or the MIS 400. One should understand that in some embodiments the addition of tars may not be conducted and/or may not gain one or more of these benefits.

Further in FIGS. 5A, 5B and 5C, in some embodiments of the present invention, the barrel 302 of the material injection system 112 may comprise a water attachment 500 operable to allow water to be added to the input material within the barrel 302. As shown, the water attachment 500 may be approximately halfway along the length of the barrel 302, in this case at the transition between Length A and Length B of the MIS 400. In other embodiments, the water attachment 500 may be at another location on the barrel 302 or could be coupled to the hopper 504. Water may be added to the material injection system 112 to ensure the input material maintains a particular desired level of moisture. Water may be added systematically or ad-hoc based upon the particular material that is being input to the material injection system 112. If the input material is too dry, the material when compressed may not provide sufficient resistance to prevent gas from exiting from the FRG reactor 114. The added water may fill the interstices within the input material and thus prevent gas from the FRG reactor 114 from permeating past Length C on the MIS 400.

Figure 6A:
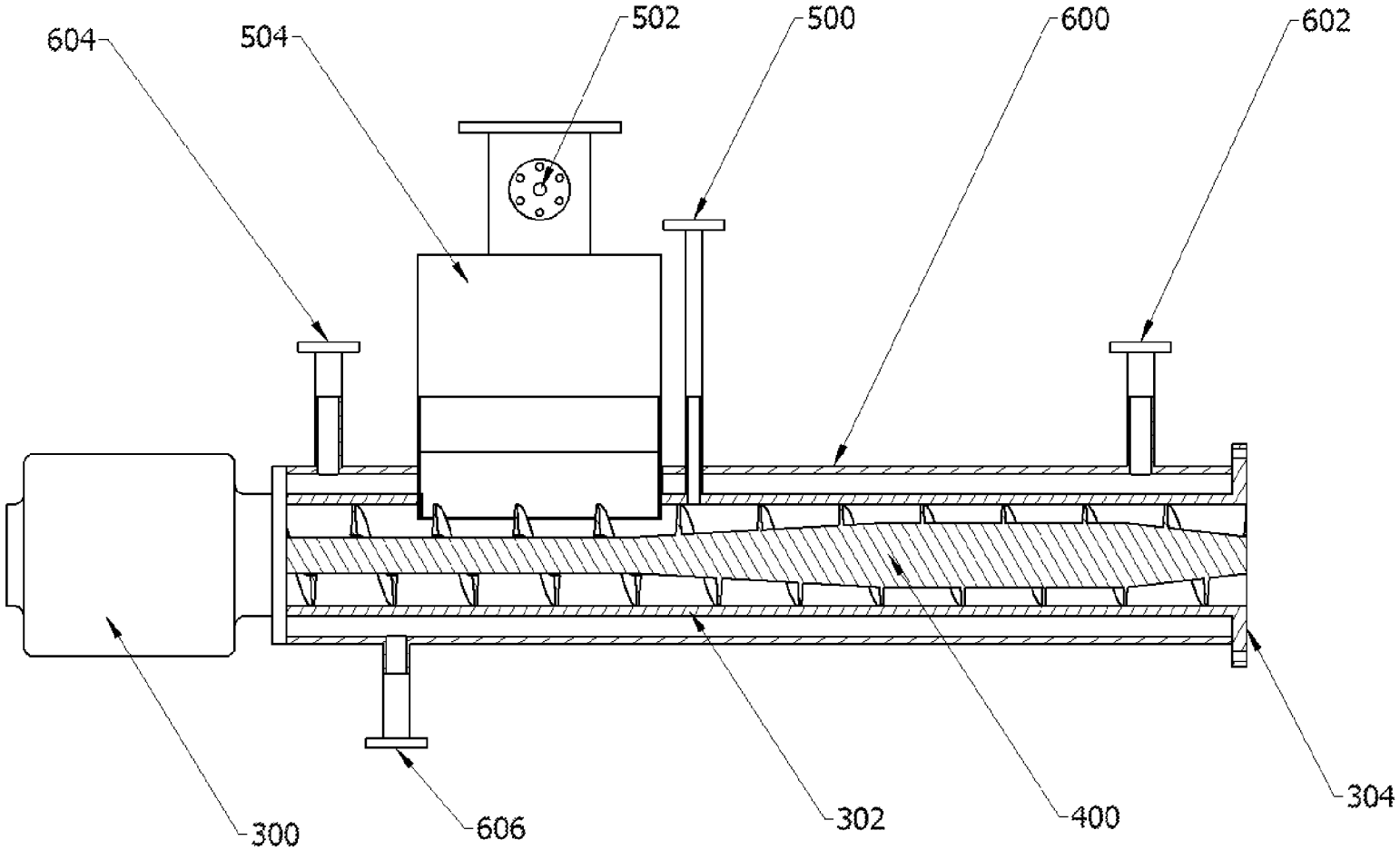
FIGS. 6A, 6B and 6C are a cross-sectional side view, a top angled view and a side view respectively of a material injection system according to an alternative embodiment in which the material injection system includes an external jacket.
Figure 6B:
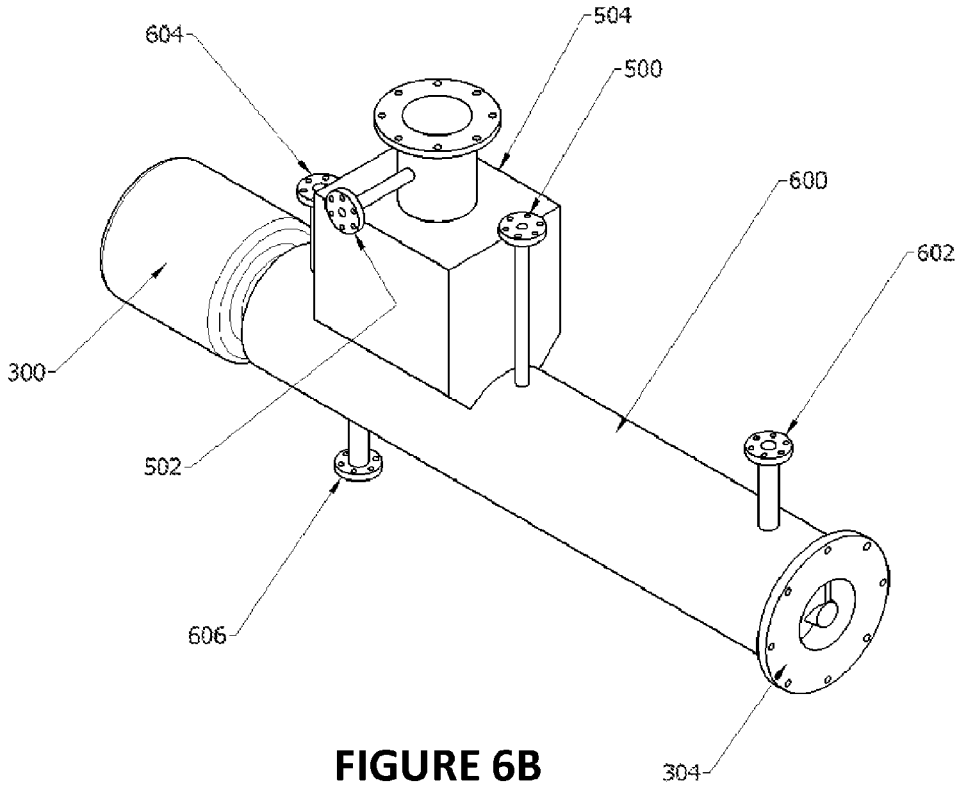
Figure 6C:
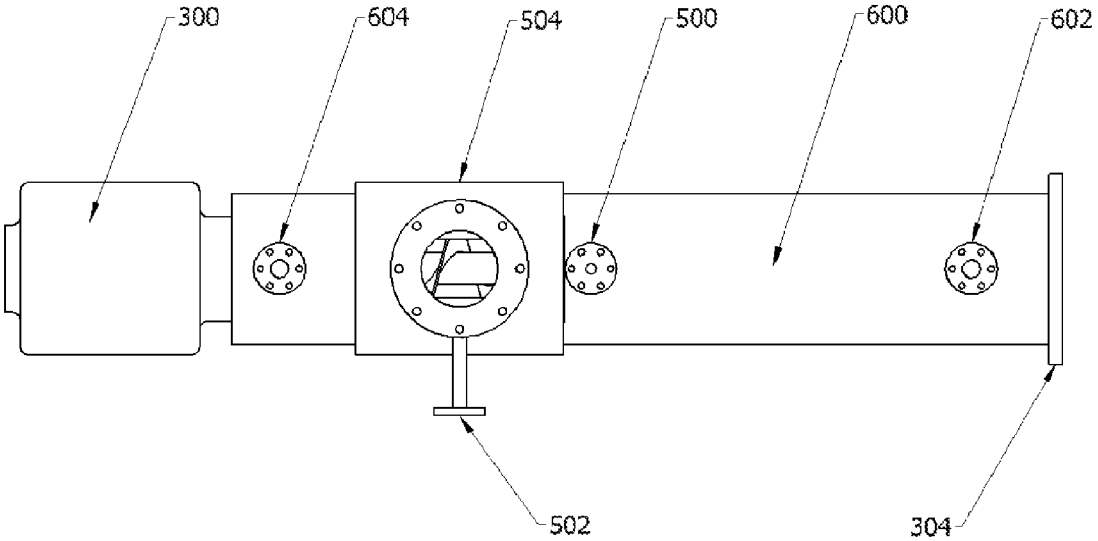

FIGS. 6A, 6B and 6C are a cross-sectional side view, a top angled view and a side view respectively of the material injection system 112 according to a further alternative embodiment in which the material injection system includes an external jacket 600. As shown, the external jacket encircles the barrel 302 of the material injection system 112 and comprises an inlet 602, an outlet 604 and a drain 606. In one embodiment, the external jacket 600 is used to heat the input material within the barrel 302. In this case, hot syngas produced within the FRG reactor 114 may be input to the inlet 602 and output from the outlet 604 to increase the temperature of the input material within the barrel 302 while, at the same time, cooling the syngas. By increasing the temperature of the input material, the system energy efficiency may be increased.

In another embodiment, the external jacket 600 may be used to cool the material within the barrel 302. As the material is compressed within the material injection system 112, heat may build up. By piping water (or another coolant) from the inlet 602 to the drain 606, the material can be cooled and the energy generated in the compression can be used to heat the water. The heated water can then be used to inject within the FRG reactor 114 using the water injection system 232 as described previously or may otherwise be used within the system.

Figure 7B:
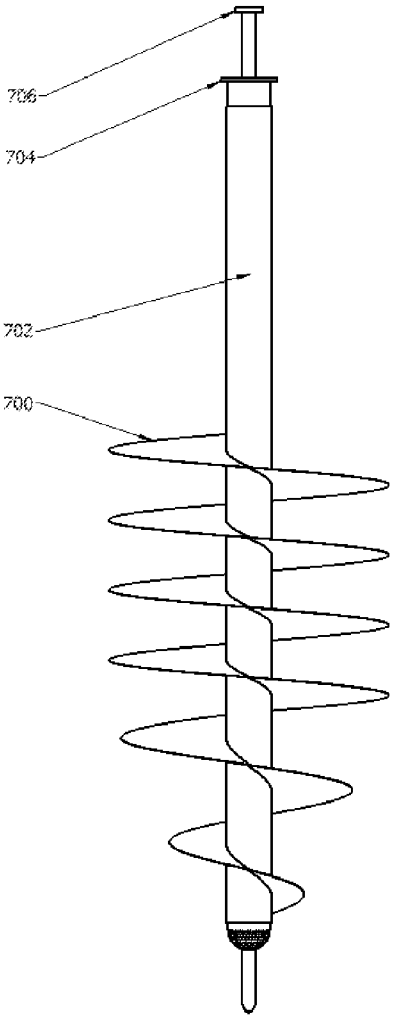
FIGS. 7A and 7B are a top angled view and a side view respectively of a material feed screw system that may be within the FRG reactor of FIGS. 2A and 2B according to an embodiment of the present invention.
Figure 7A:
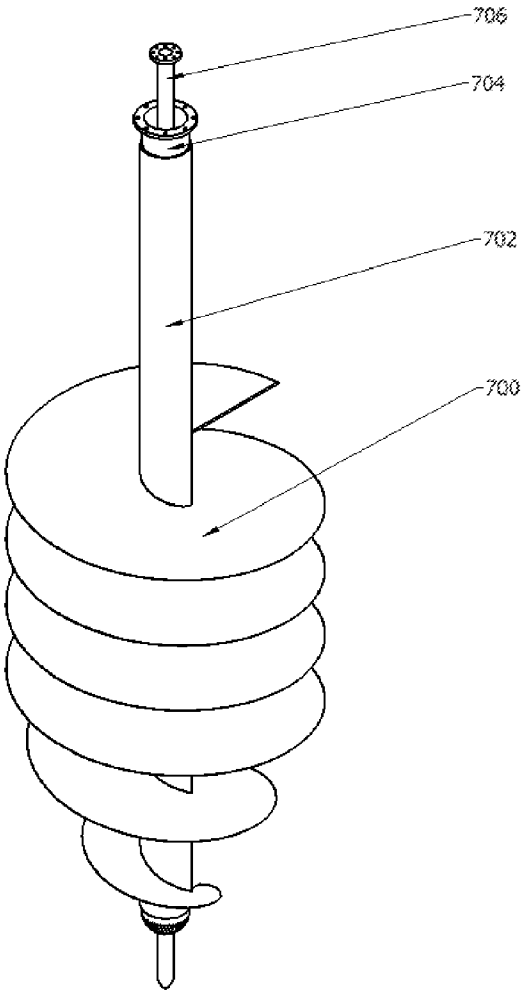
Figure 7C:
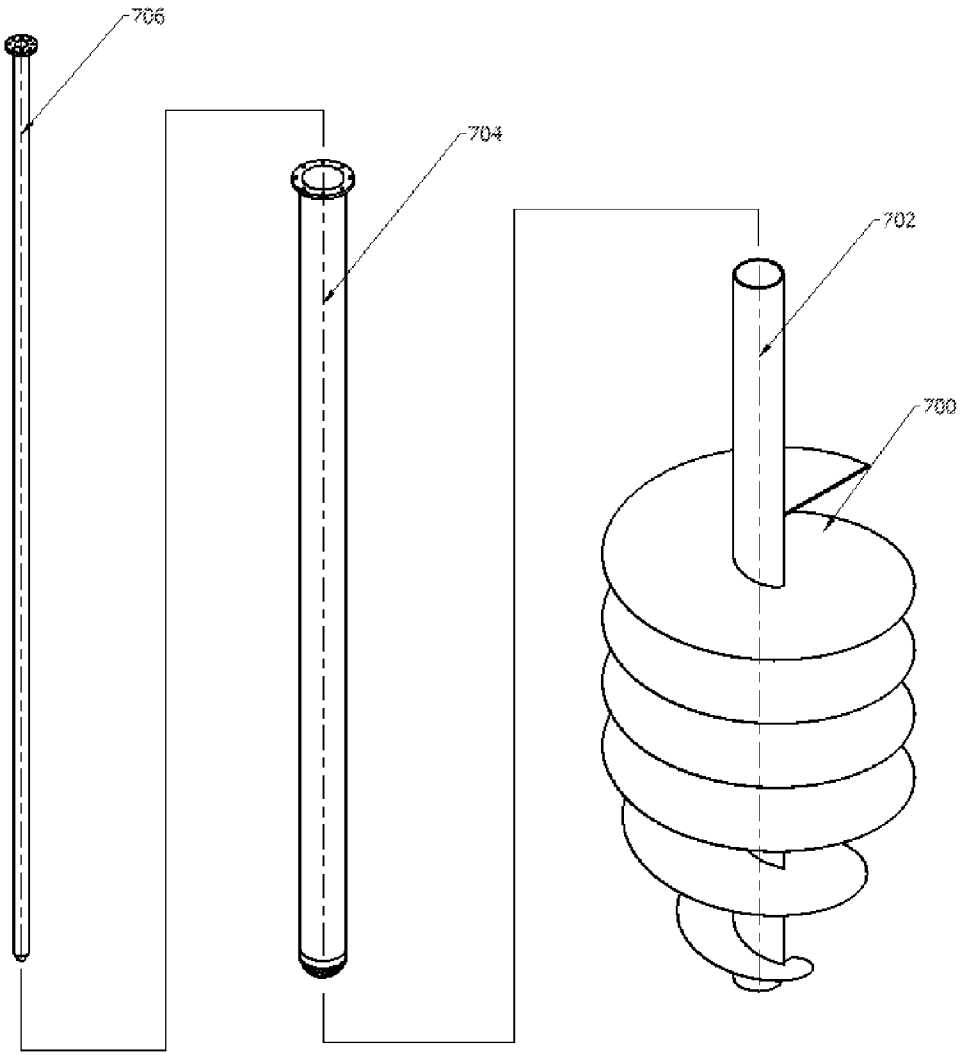
FIG. 7C is an assembly diagram for the material feed screw system of FIGS. 7A and 7B.
Figure 7E:
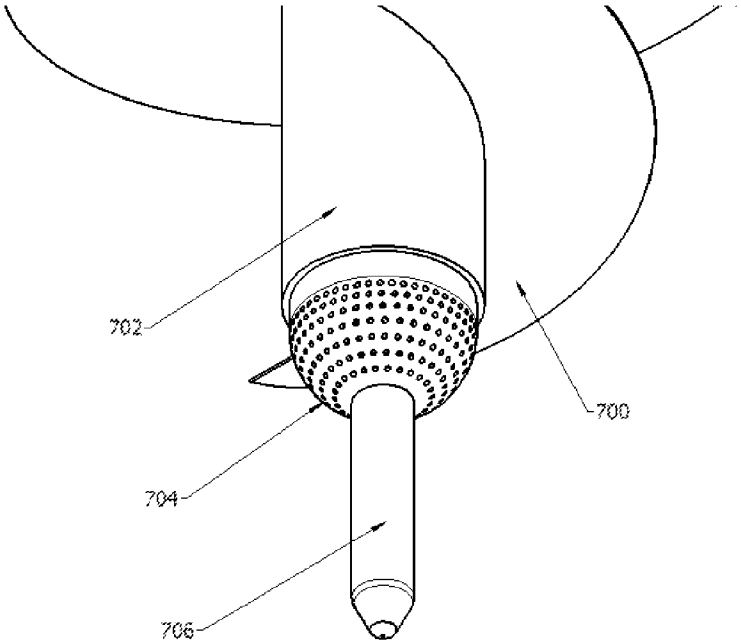
FIGS. 7D and 7E are a zoomed in view of the top and bottom portion respectively of the material feed screw system of FIGS. 7A and 7B.
Figure 7D:
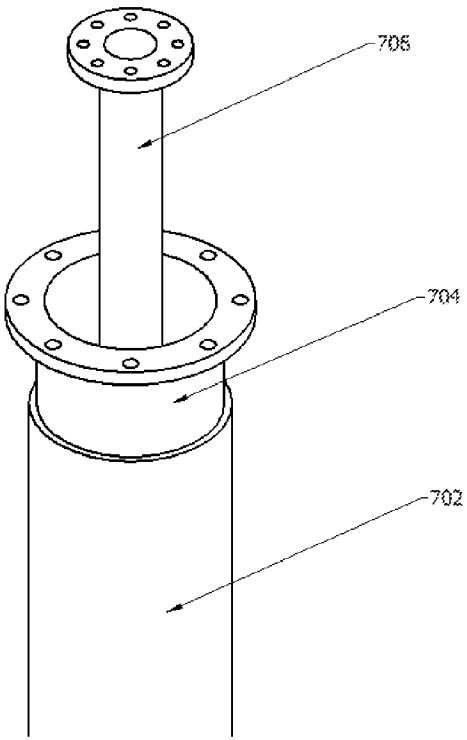

FIGS. 7A and 7B are a top angled view and a side view respectively of a material feed screw system comprising the material feed screw 220 of FIGS. 2A and 2B according to an embodiment of the present invention. FIG. 7C is an assembly diagram for the material feed screw system of FIGS. 7A and 7B. FIGS. 7D and 7E are a zoomed in view of the top and bottom portion respectively of the material feed screw system of FIGS. 7A and 7B. As shown, the material feed screw system comprises the cylindrical feed screw shaft 702; the feed screw flutes 700 that are connected to the outer surface of the feed screw shaft 702; the syngas removal pipe 704 integrated within the feed screw shaft 702; and the water injection pipe 706 integrated within the syngas removal pipe 704.

In the embodiment of FIGS. 7A and 7B, the flutes 700 are helical and have a diameter to match the inner diameter of the FRG reactor 114. Through most of the MFS 220, the flutes 700 have a fixed pitch but, as the diameter of the flutes 700 is reduced to match the tapering of the FRG reactor 114 in the transition section 204, the pitch of the flutes 700 is also changed to maintain relatively constant volume between flutes. In this embodiment, this is done to prevent a significant compression of the input material, which could cause problems such as stress on the MFS 220 or jamming of input material. In some embodiments the volume between flutes may increase or decrease depending upon the design requirements. As shown in FIGS. 8A-8H, the flutes 700 of the MFS 220 may be modified in alternative embodiments. For instance, the flutes 700 may have different pitch levels, include perforations (or small holes) in part or all of the flutes 700 and/or have a serrated edge at the outer diameter.

The feed screw shaft 702 within FIGS. 7A-7E is a hollow cylinder that is coupled to the MFS drive system 238 external to the FRG reactor 114. The portion of the feed screw shaft 702 that stretches out of the top of the FRG reactor 114 is sealed along the edge of the FRG reactor 114 and may be coupled to the MFS drive system 238 via suitable bearings. The MFS drive system 238 may be controlled locally or by a central computing apparatus (not shown) and is operable to control the rate at which the input material is moved downward from the opening in which the material injection system 112 is attached to the FRG zone by controlling the rate of rotation of the feed screw shaft 702. In some embodiments, the MFS drive system 238 may monitor torque on the MFS 220 to detect input material jams within the FRG reactor 114. In response to detecting a potential jam, the MFS drive system 238 may send a warning message to an operator, terminate the rotation of the MFS 220 and/or reverse rotation of the MFS 220.

As shown in FIG. 7C, the gas removal pipe 704 is integrated within the feed screw shaft 702 with the outer diameter of the gas removal pipe 704 being very slightly smaller the inner diameter of the shaft 702. The gas removal pipe 704 in this embodiment does not rotate with the shaft 702 and there is a seal between the pipe 704 and the shaft 702 at the upper most edge of the shaft 702. As shown in FIG. 7E, the gas removal pipe in this embodiment comprises a nozzle at the bottom comprising a series of small holes (in this example, hundreds of very small holes) which allow for syngas to enter the pipe 704 and a central orifice sufficient to allow the water injection pipe 706 to pass through. In other embodiments described with reference to FIGS. 9A-9F, other implementations of the gas removal pipe 704 are illustrated.

The gas removal pipe 704 is coupled to the syngas outlet pipe 240, which is in turn coupled to the syngas transfer pipe 120 via the flexible syngas line coupling 254. The flexible coupling 254 can enable the gas removal pipe 704 to be adjustable for distance to the FRG zone. This adjustment may be done manually to optimize an aspect of a particular syngas output or may be automated. In some embodiments, the pipe 704 may be adjusted in another manner to modify the distance of syngas removal from the FRG zone.

In some embodiments, the gas removal pipe 704 is coupled to a purge system operable to blast a purge gas through the gas removal pipe 704 to clear the nozzle of contaminants that may block one or more of the holes. Further, to enable cleaning or other adjustments, the gas removal pipe 704 may be removed from the FRG reactor 114 when not in operation by detaching its connection to the syngas outlet pipe 240 and lifting it vertically.

The water injection pipe 706, of FIG. 7C, is integrated within the gas removal pipe 704 with the outer diameter of the water injection pipe 706 being substantially less than the inner diameter of the gas removal pipe 704. The water injection pipe 706 in this embodiment does not rotate with the shaft 702. On the top end, the water injection pipe 706 is connected to a flexible water coupling 250 external to the FRG reactor 114, which is in turn connected to the water pipe 128. As shown in FIG. 2B, the syngas outlet pipe 240 comprises an elbow in which a section allows the water injection pipe 706 to pass and be connected to the flexible water coupling 250. The location within the section of the elbow where the water injection pipe 706 exits is sealed to prevent syngas from exiting. In one example, the seal may be a standard compression seal between two flanges (not shown). On the bottom end, the water injection pipe 706 comprises a nozzle, which may take numerous forms. In FIG. 7E, the nozzle comprises a single hole out of which water may enter the FRG reactor 114. In other embodiments, more than one hole could be formed within the nozzle of the water injection pipe 706. Similar to the gas removal pipe 704, the water injection pipe 706 may be adjustable for distance to the FRG zone. The flexible water coupling 250 may allow for an operator to manually adjust the positioning of the water injection pipe 706 to optimize an aspect of a particular syngas output. The location of the water injection and the quantity of water injected may affect the level of impurities within the syngas output. Too much water being injected could lower temperatures due to heat loss in converting water to steam. Further, to enable cleaning or other adjustments, the water injection pipe 706 may be removed from the FRG reactor 114 when not in operation by detaching its connection to the water flexible coupling 250 and lifting it vertically.

Figure 8B:
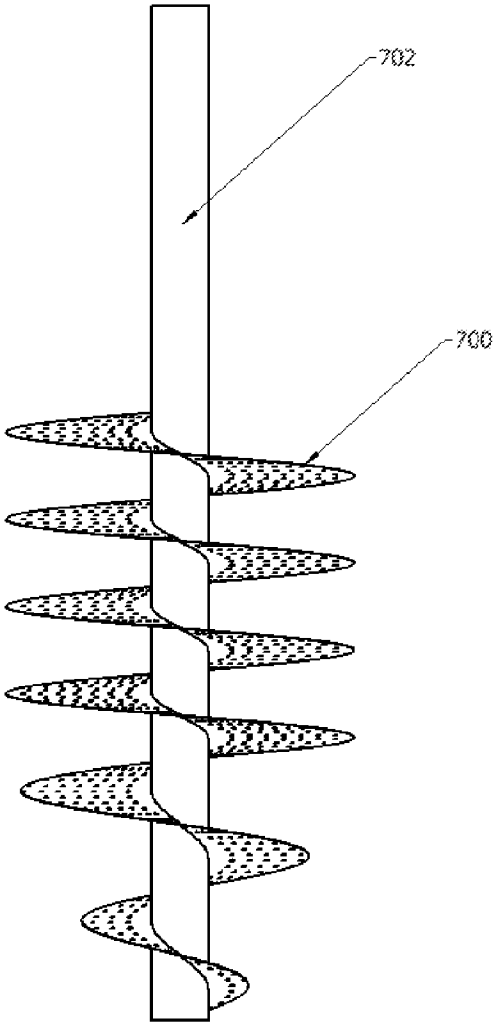
FIGS. 8A and 8B are a top angled view and a side view respectively of a material feed screw according to an alternative embodiment in which the material feed screw includes perforations.
Figure 8A:
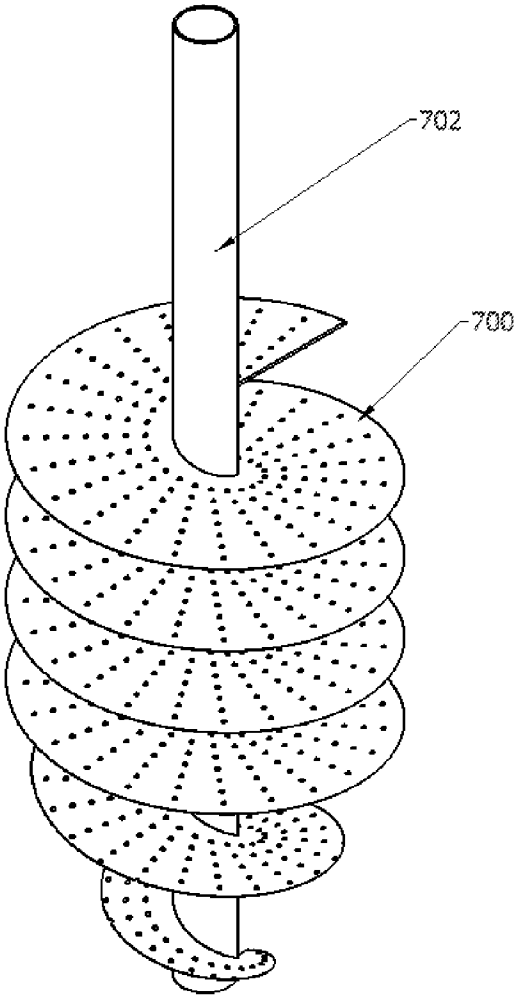

FIGS. 8A and 8B are a top angled view and a side view respectively of the material feed screw 220 according to an alternative embodiment in which the material feed screw 220 includes perforations within the feed screw flutes 700. The perforations in the flutes 700 can allow the syngas to migrate upwards through the openings, allowing cooling of the gas prior to extraction and also facilitating pyrolysis within input material that has not yet reached the sufficient temperatures. Further, the upward movement of the syngas may allow for condensing of vaporous components such as tars onto the input material in the upper portion of the FRG reactor 114. These condensed tars can then move, with the input material that they are attached, to the lower portion of the FRG reactor 114 and into the FRG zone by the MFS 220. The perforations may take many forms including small circular holes, slotted type holes and/or various other shapes and sizes depending upon the desired flow of syngas upwards through the MFS 220.

Figure 8D:
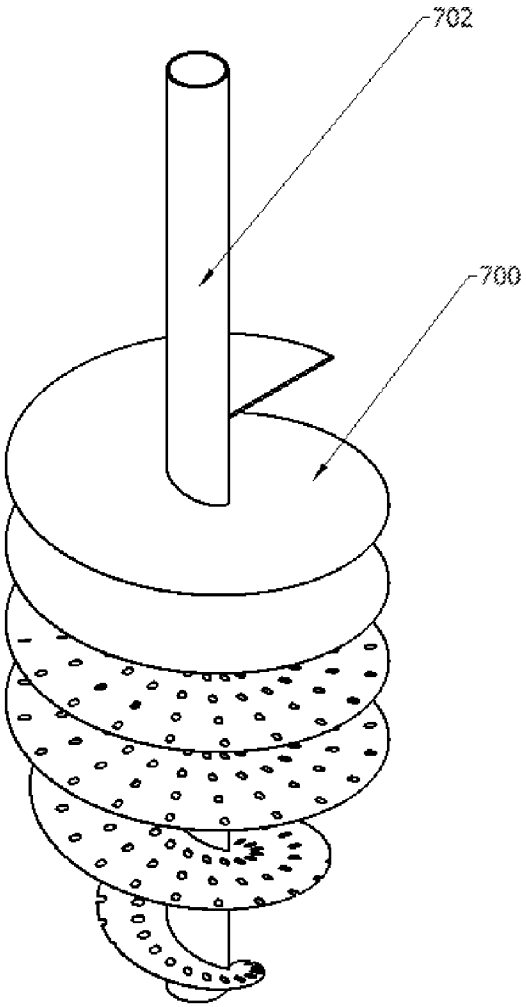
FIGS. 8C and 8D are top angled views of material feed screws according to additional alternative embodiments in which the material feed screw includes alternative perforation designs.
Figure 8C:
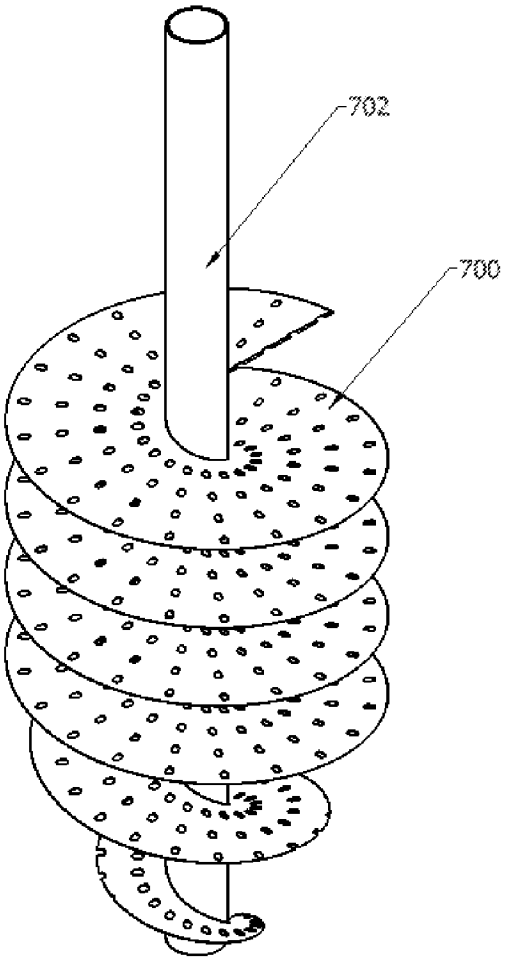

FIGS. 8C and 8D are top angled views of material feed screws according to additional alternative embodiments in which the material feed screw 220 includes alternative perforation designs within the feed screw flutes 700. In FIG. 8C, the perforations are larger than in FIGS. 8A and 8B. In FIG. 8D, the perforations are only within the lower flutes on the material feed screw 220. By only having perforations within the lower portion of the flutes 700, the syngas will more easily move upwards in the lower portion of the flutes 700 and then not move upwards as easily once the perforations stop. This change in perforations may be useful in a number of embodiments of the present invention. As will be described with reference to FIGS. 9A-9F, in some embodiments, gas removal takes place at different locations above the FRG zone along the MFS 220. In these embodiments, perforations may only be implemented in the lower flutes as per FIG. 8D in order to facilitate easier movement of the syngas through the flutes 700 up to the point in which the gas removal takes place. In some embodiments, the perforations may continue above the location at which the gas removal takes place while, in other embodiments, the perforations may reduce in size and/or quantity or be removed completely above the location at which the gas removal takes place. By including perforations and adjusting the size, quantity and/or location of the perforations in the flutes 700, gas flow within the FRG reactor 114 may be managed to an extent.

Figure 8F:
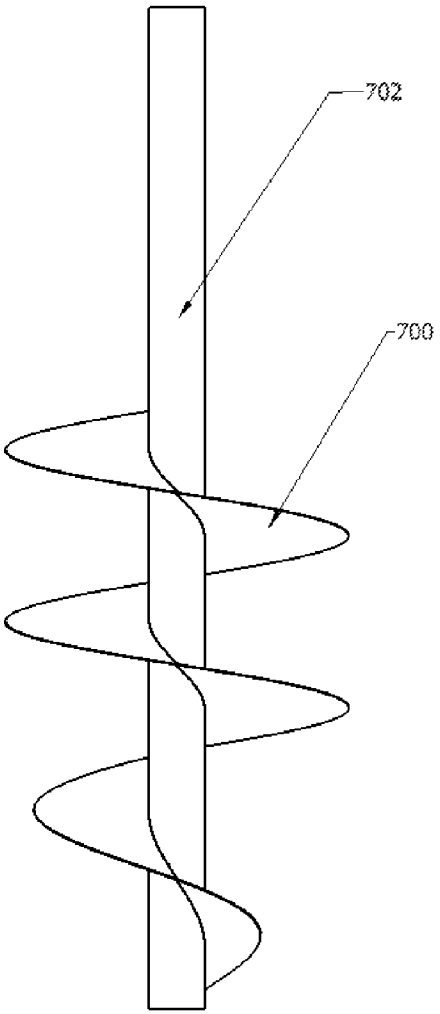
FIGS. 8E and 8F are a top angled view and a side view respectively of a material feed screw according to an alternative embodiment in which the pitch of the flute is increased.
Figure 8E:
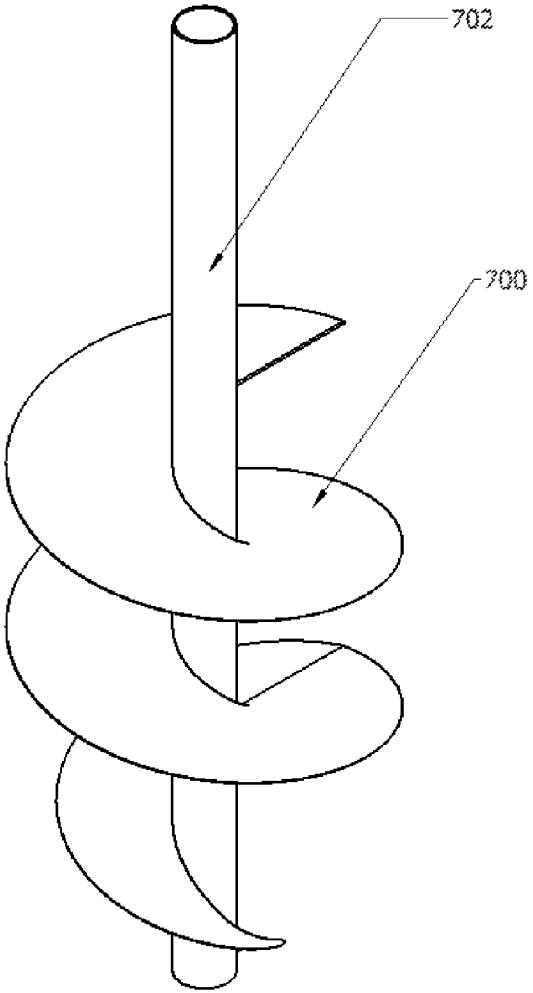

FIGS. 8E and 8F are a top angled view and a side view respectively of the MFS 220 according to yet another alternative embodiment in which the pitch of the flutes 700 are increased. It should be understood that one may adjust the pitch of the flutes 700 depending upon design requirements. For instance, a larger pitch may allow for a number of advantages including: increased particle size within the input material; reduced jamming of the input material between the edge of the flutes 700 and the inner wall of the FRG reactor 114; simplified manufacturing of the MFS 220; and additional space between the flutes which may be used for alternative/additional syngas removal locations as will be described with reference to FIGS. 9A-9F. With a larger pitch, there will be an increase in volume of the input material between adjacent flutes 700. Therefore, to maintain the same rate of input of material being introduced to the FRG zone as with a smaller pitch, the rotation of the MFS 220 will need to be decreased. Due to the lower volume of input material between adjacent flutes 700, a smaller pitch can allow for a more controlled movement of the input material through the FRG reactor 114.

Figure 8H:
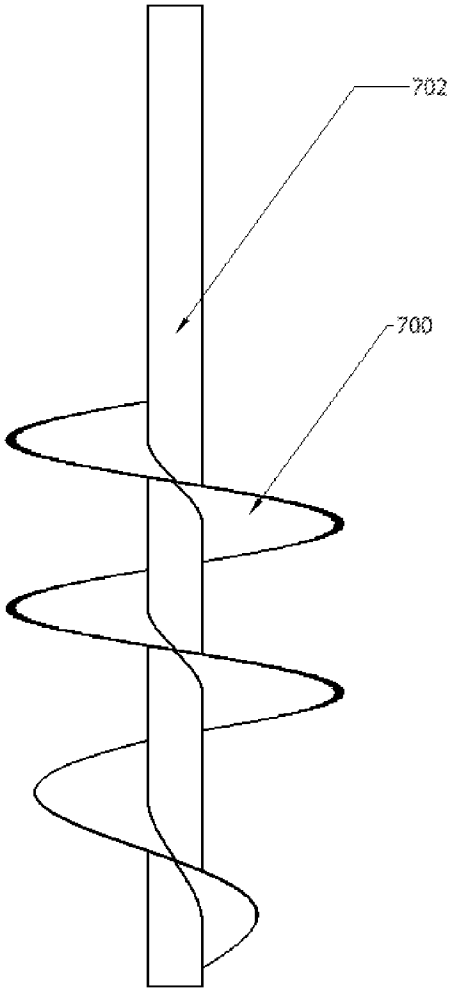
FIGS. 8G and 8H are a top angled view and a side view respectively of a material feed screw according to an alternative embodiment in which the pitch of the flute is increased and the edge of the flute is serrated.
Figure 8G:
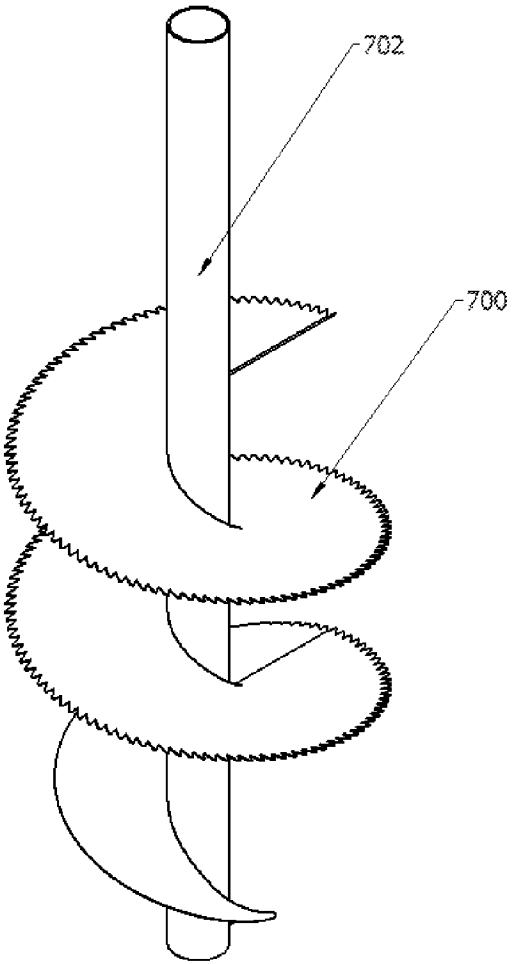

FIGS. 8G and 8H are a top angled view and a side view respectively of the material feed screw 220 according to one further alternative embodiment in which the pitch of the flutes 700 are increased compared to the flutes of FIGS. 7A and 7B and the outer diameter edge of the flutes 700 are serrated. The serrated edge at the outer diameter of the flutes 700 can aid in gas migration upwards within the FRG reactor 114 and can also reduce material accumulation along the inner wall of the FRG reactor 114. The internal environment within the FRG reactor 114 will have high heat with large amounts of vapors and wet tars that may deposited on the inner wall of the reactor 114. Serrated edges on the flutes 700 may mitigate build up of these deposits and may further reduce jamming along the walls of the FRG reactor and the flutes 700 (for example, jamming from metal contaminants).

Figure 9B:
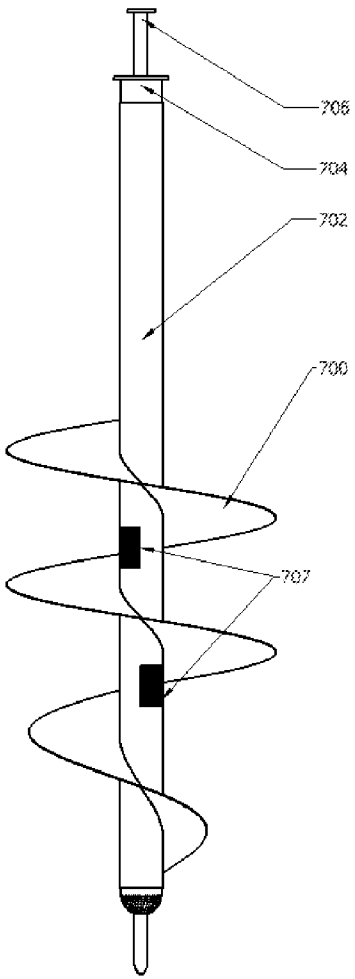
FIGS. 9A, 9B and 9C are a top angled view, a side view and a cross-sectional side view respectively of a material feed screw system according to yet another alternative embodiment of the present invention in which syngas removal may occur at a plurality of locations.
Figure 9A:
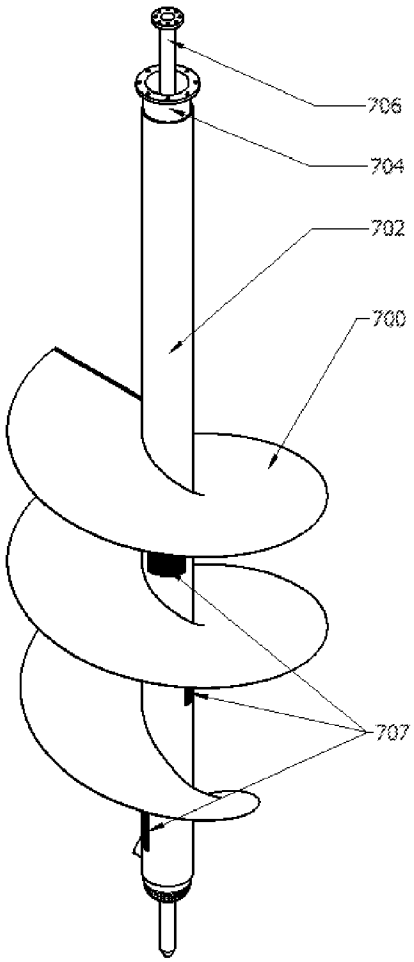
Figure 9D:
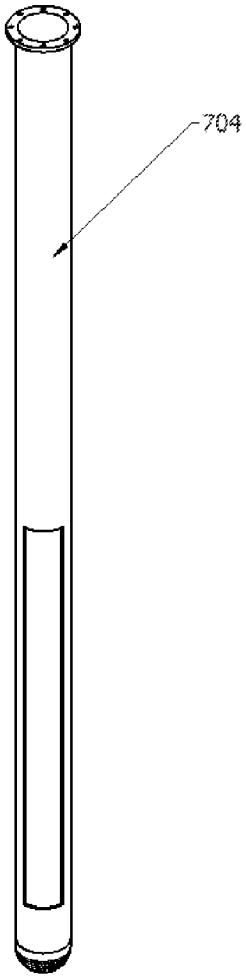
FIG. 9D is an angled top view of a syngas removal pipe within the material feed screw system of FIGS. 9A, 9B and 9C according to an embodiment of the present invention.
Figure 9C:
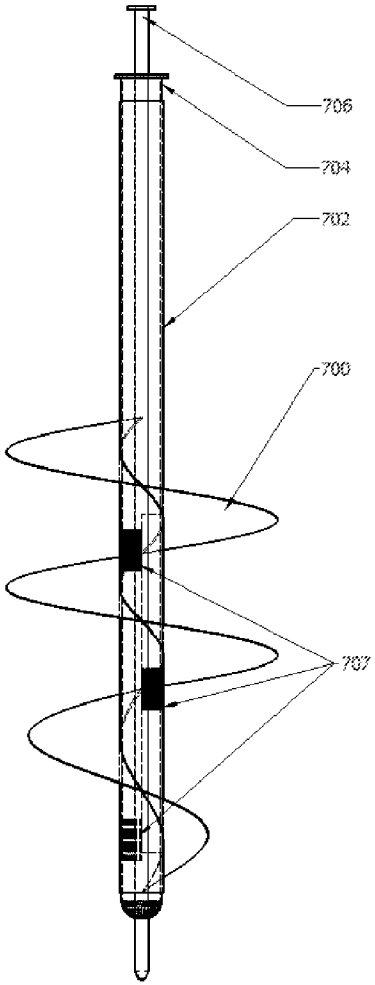

FIGS. 9A, 9B and 9C are a top angled view, a side view and a cross-sectional side view respectively of the material feed screw system according to yet another alternative embodiment of the present invention in which syngas removal may occur at a plurality of locations. FIG. 9D is an angled top view of the syngas removal pipe 704 within the material feed screw system of FIGS. 9A, 9B and 9C according to an embodiment of the present invention. FIG. 9E is a zoomed in view of the bottom portion of the material feed screw system of FIGS. 9A, 9B and 9C. As shown, a plurality of vents 707 within the feed screw shaft 702 may be used for syngas removal, each vent 707 being at a different vertical displacement along the feed screw shaft 702 and at a different angle along the circumference of the shaft 702. Although shown as holes with slots, it should be understood that vents 707 may comprise other openings that are slotted, perforated and/or otherwise designed to allow gas to be extracted. In this example, each vent 707 is approximately 120° displaced from the other two vents 707. The syngas removal pipe 704 comprises a vertical rectangular hole that creates an opening for syngas removal. The location of the syngas removal will depend upon which vent 707 in the shaft 702 that the syngas removal pipe 704 is aligned with. In one example, the opening within the syngas removal pipe 704 is less than or equal to 120° (90° in some cases) such that when the pipe 704 is positioned appropriately, syngas can only be removed from one of the vents 707 in the shaft 702, the other vents 707 being blocked by the pipe 704. In other embodiments, it should be understood that other numbers of vents 707 could be used (two or more) and a different sized and/or shaped hole within the syngas removal pipe 704 may be used.

Figure 9F:
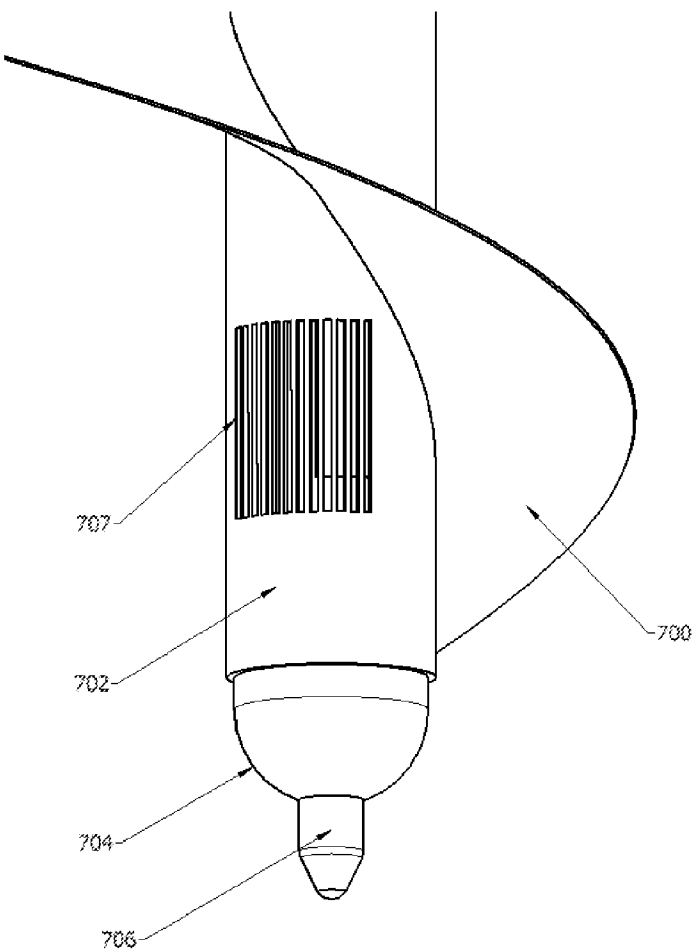
FIG. 9F is a zoomed in view of the bottom portion of an alternative material feed screw system to that of FIGS. 9A, 9B and 9C in which the syngas removal pipe end is not perforated.
Figure 9E:
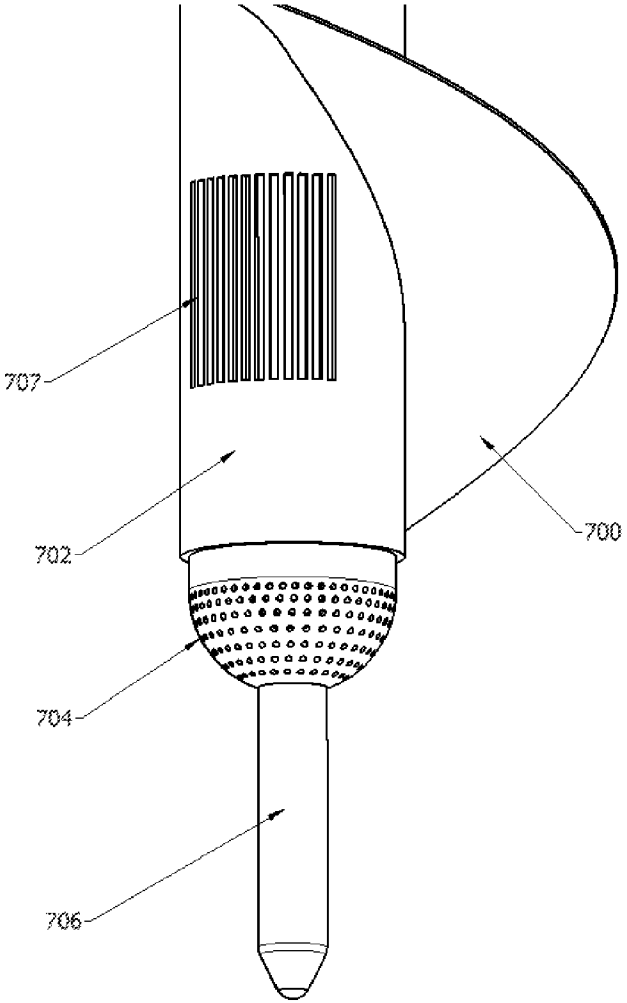
FIG. 9E is a zoomed in view of the bottom portion of the material feed screw system of FIGS. 9A, 9B and 9C.

FIG. 9F is a zoomed in view of the bottom portion of an alternative material feed screw system to that of FIGS. 9A, 9B and 9C in which the syngas removal pipe end is not perforated. In this case, no syngas is removed from the end of the syngas removal pipe 704 and only the vent system as described is used for syngas removal.

The variation on location for syngas removal provides flexibility to the system operations. The higher the extraction level, the lower the temperature of the syngas at the point of extraction and likely the more contaminants that may be present in the syngas. These contaminants may need to be cleaned, depending on the eventual use of the syngas. One particular component that is considered an impurity in the syngas is carbon dioxide $CO_2$ as it is not combustible. The lower the temperature within the FRG reactor 114 will likely result in higher $CO_2$ levels relative to carbon monoxide CO levels (which is a desirable element within the syngas). Further, lower temperature levels will likely increase the tar content within the syngas due to reduced pyrolytic activity at the lower temperature. It should be noted that the level of impurities within the syngas may vary with the composition of the input material. In some embodiments, various control mechanisms, such as the location of the syngas removal, can be controlled to manage the syngas output in response to various fluctuations in input material.

Figure 10A:
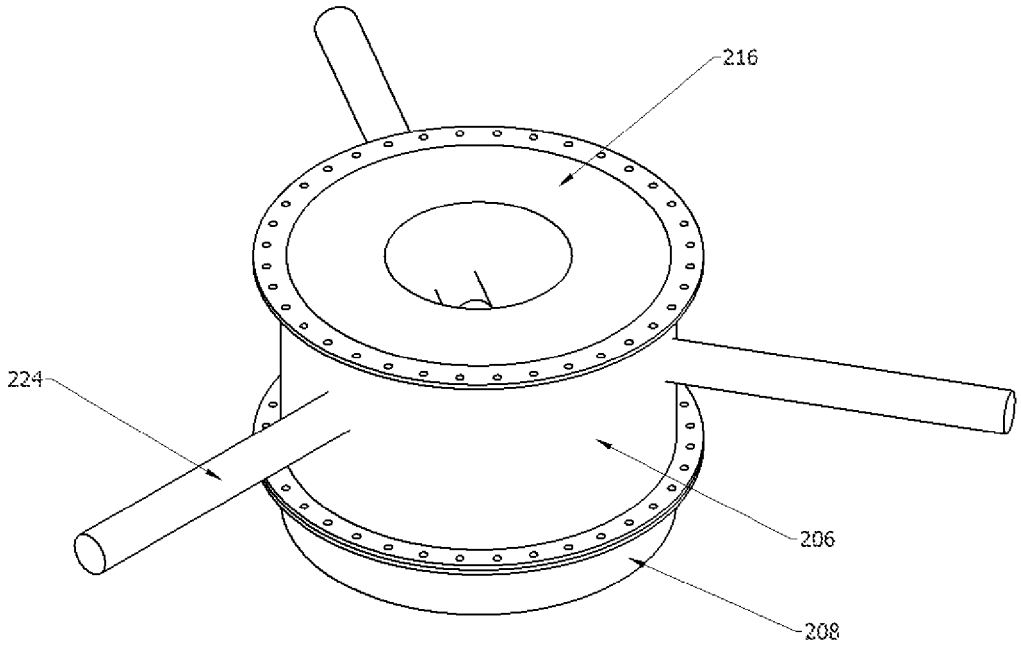
FIGS. 10A, 10B and 10C are an angled top view, a top view and a cross-sectional side view respectively of the bottom portion of the FRG reactor of FIGS. 2A and 2B according to an embodiment of the present invention in which three electrodes are used.
Figure 10B:
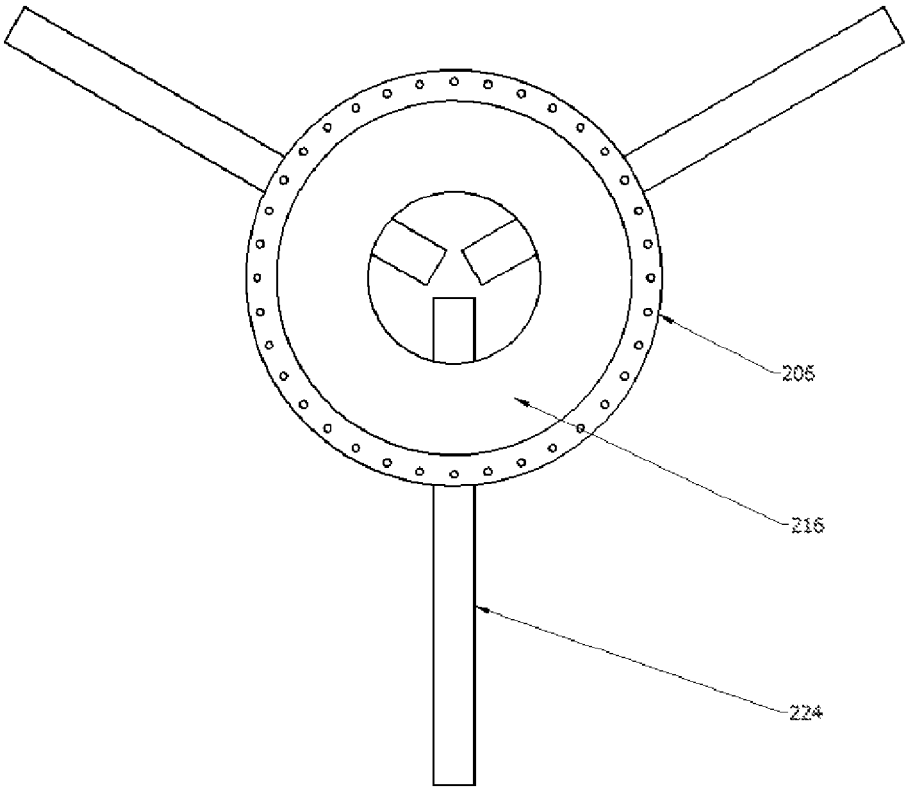
Figure 10C:
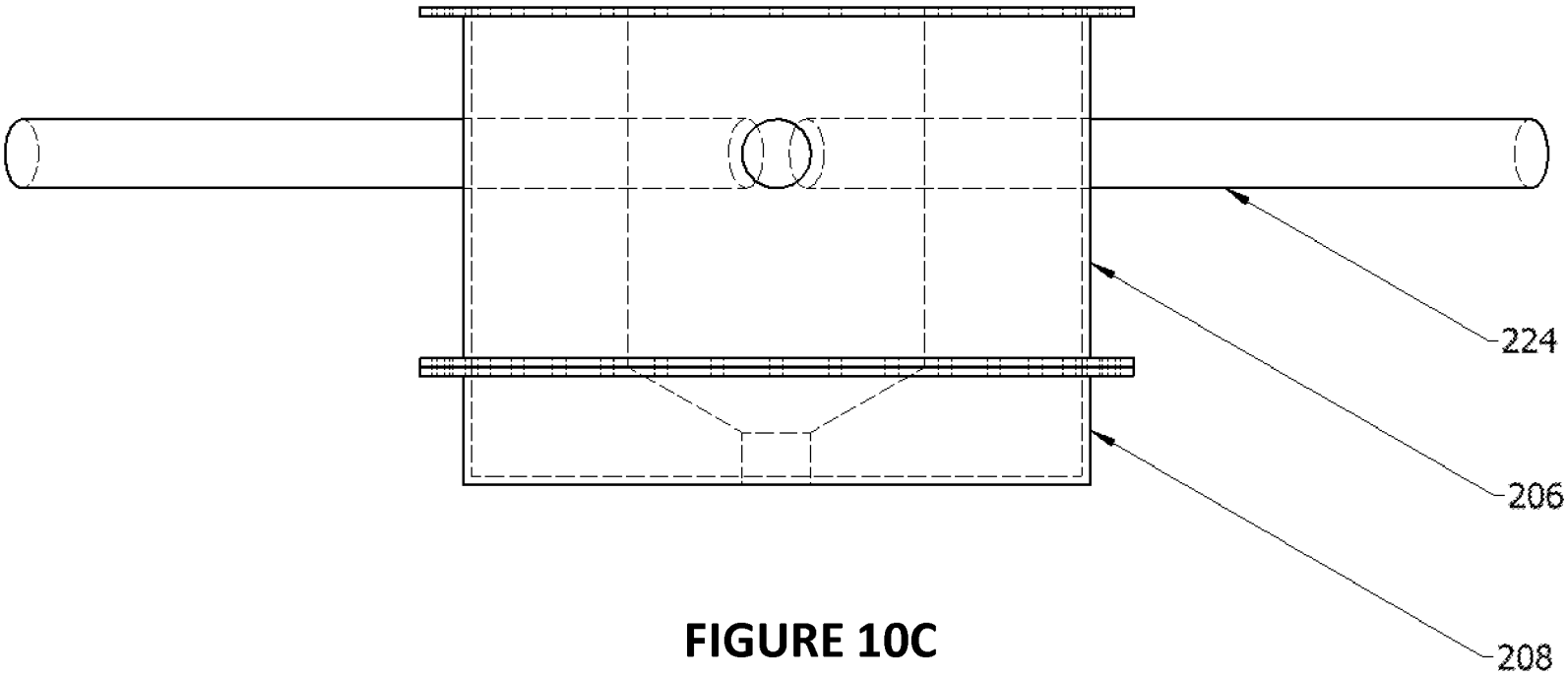

FIGS. 10A, 10B and 10C are an angled top view, a top view and a cross-sectional side view respectively of the bottom portion of the FRG reactor 114 of FIGS. 2A and 2B according to an embodiment of the present invention in which the three electrodes 224 are used. In this configuration, each of the three electrodes 224 are 120° horizontally displaced from the other two electrodes. Shown in FIGS. 10A, 10B and 10C are the FRG reactor base section 206, the FRG reactor bottom section 208 and the base refractory liner 216 with the electrodes 224 protruding through the FRG reactor base section 206 and the base refractory liner 216. In one embodiment, the electrodes are graphite, though other electrode materials may be used including tungsten, molybdenum or titanium.

When electricity is applied to the electrodes 224, an arc will form adjacent to the gap between the electrodes 224. The actual current and voltage used on the electrodes may change due to a variety of design requirements. A higher voltage will allow for easier control of the arc and allow for a smaller diameter electrode to be required.

In one particular implementation, the arc may create a temperature of approximately 6,000° C., though the temperature of the arc may vary in different design implementations. As described, the walls of the FRG reactor 114 are lined with refractory material. There are many grades of refractory material, but typically the higher the alumina content, the higher the temperature that can be withstood (ranging up to 1800° C.). Refractory material can also be resistant to slag, molten metals etc. which could contact the walls of the reactor 114. The FRG reactor 114 of FIGS. 2A and 2B and as shown in FIGS. 10A, 10B and 10C includes a distance between the arc (formed in the gap between the electrodes 224) and the walls of the FRG reactor 114. The temperature gradient through the distance and the input material can drop the temperature to acceptable levels for the refractory liner 216. To mitigate heat transfer through the refractory liners, in some embodiments, the refractory liners comprise a plurality of layers of refractory material, with the refractory material forming the inner walls having high temperature and abrasion resistance and refractory material behind that having reasonable refractory properties and good insulating properties.

Graphite electrodes within the environment in the FRG reactor 114 will be consumed in the process, adding carbon material to the syngas output. In some embodiments of the present invention, to ensure the arc remains correctly formed as the graphite in the electrodes 224 disappears, the electrodes 224 will be pushed further into the FRG reactor 114 and additional electrodes will be added to the ends of the electrodes 224 that protrude from the FRG reactor 114. To affix the additional electrodes to the electrodes currently in use within the FRG reactor 114, each electrode may have a threaded end that allows for additional electrodes to be attached by a screwing action. In some embodiments of the present invention, new electrodes can be added to the existing electrodes during operation, which can effectively make the process in the system a continuous operation. In alternative embodiments, the electrodes are only attached after shutdown of the system and the system is therefore a batch process.

In operation, the electrodes 224 may be required to be moved into and possibly out of the FRG reactor 114. In particular, the electrodes 224 may need to be advanced into the FRG reactor 114 in order to have the arc struck and may need to subsequently be slowly extracted until a stable arc within the FRG reactor 114 is achieved. Further, the electrodes 224 may need to be incrementally advanced into the FRG reactor 114 as the electrodes 224 are consumed by the heat of the arc in operation. In order to move the electrodes 224 into and/or out of the FRG reactor 114 and to maintain the electrodes 224 in a horizontal position a number of structures/mechanisms may be used.

Figure 15A:
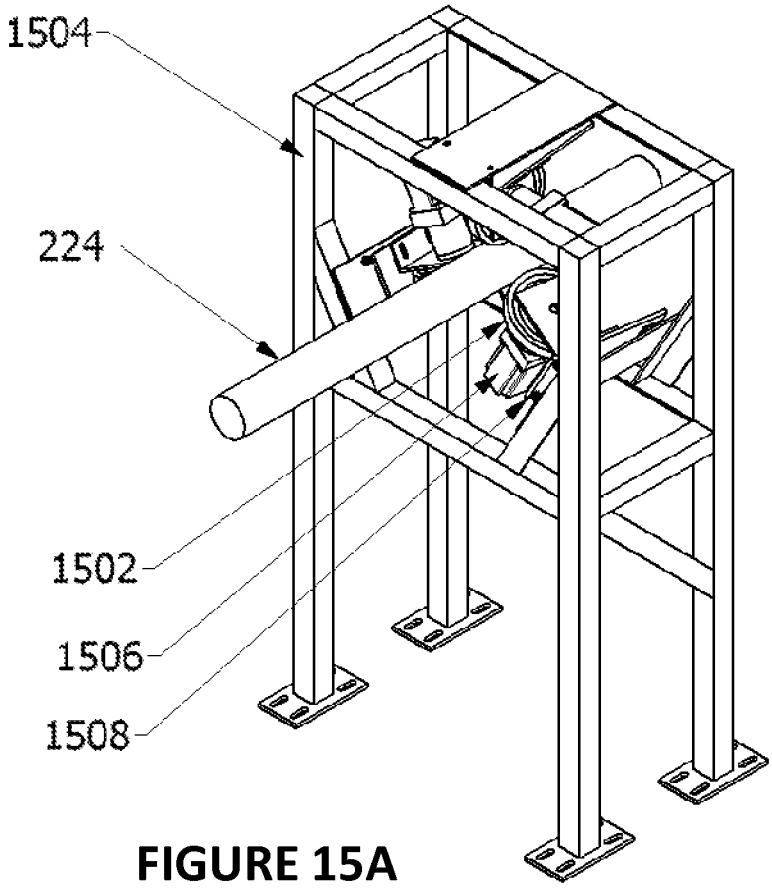
FIG. 15A is an angled top view of an electrode support structure using wheels according to one embodiment of the present invention.
Figure 15B:
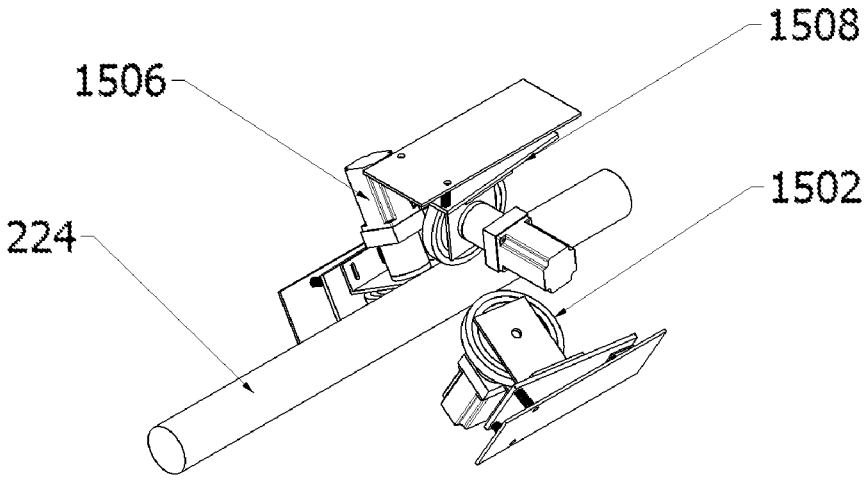
FIG. 15B is a zoomed in view of the wheel structure of FIG. 15A with the support structure removed for clarity.

FIG. 15A is an angled top view of an electrode support structure using wheels according to one embodiment of the present invention. FIG. 15B is a zoomed in view of the wheel structure of FIG. 15A with the support structure removed for clarity. As depicted, a set of three wheels 1502 can be used to move each of the electrodes 224 into or out of the FRG reactor 114 (not shown in FIGS. 15A, 15B). In this implementation, a frame 1504 supports the wheels 1502 and, through the wheels 1502, supports the electrode 224. As shown, the three wheels 1502 are spread out around the outer circumference of the electrode 224 such that each wheel is approximately 120° from each of the other two wheels. Springs 1508 integrated within the frame 1504 are used to keep the wheels 1502 loaded against the electrode 224 and motors 1506 are used to rotate the wheels 1502 and move the electrode 224 into or out of the FRG reactor 114. In alternative implementations, more or less than three wheels 1502 may be used to move the electrodes 224.

Figure 16:
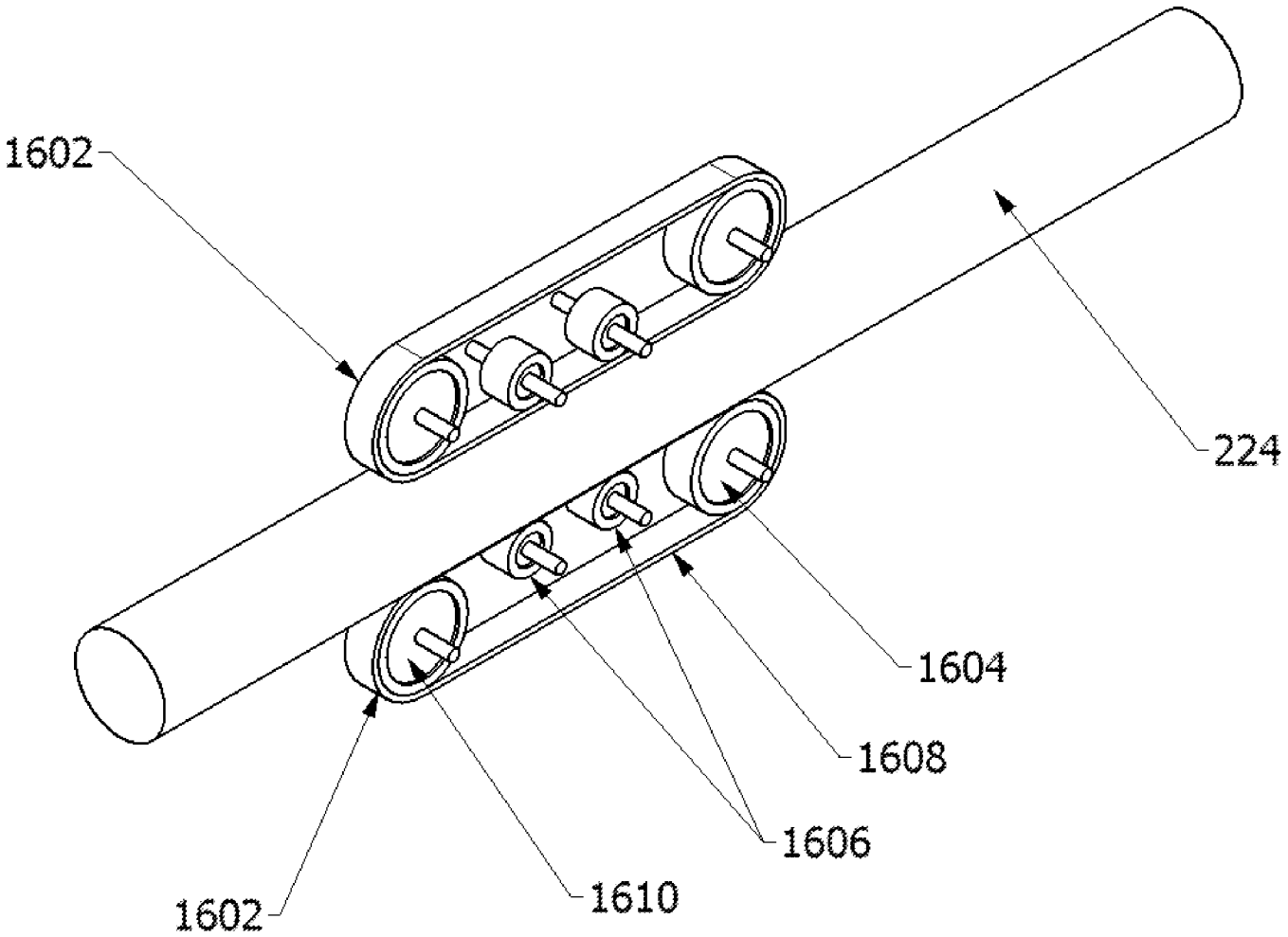
FIG. 16 is an angled top view of an alternative electrode support structure using belt systems.

FIG. 16 is an angled top view of an alternative electrode support structure using belt systems that provide more contact surface with the electrodes 224 compared with the wheels of FIG. 15. In this embodiment, two belt systems 1602 are used to support and move the electrodes 224, one belt system on the upper side of the electrode 224 and one on the lower side. Each of the belt systems 1602 comprises one driven wheel 1604, a plurality of bogey wheels 1606 (two in the example of FIG. 16), an idle wheel 1610 and a belt 1608. The driven wheel 1604 and the idle wheel 1610 are at opposite ends of the belt 1608 within each belt system 1602 and have sufficient distance between them to tighten the belt 1608 around them. The bogey wheels 1606 are inside the belts 1608 between the driven wheels 1604 and the idle wheels 1610. Each of the wheels 1604,1606,1610 are implemented with springs (not shown) or another force generating device to continuously keep the belt 1608 in frictional contact with the electrode 224. In operation, the driven wheels 1604 are rotated by a motor (not shown) and this force is transferred into a linear motion within the electrode 224 as the belt 1608 turns. The belt systems 1602 may be mounted on a frame similar to the frame 1502 depicted in FIG. 15A or may be mounted on another suitable frame to support the belt systems 1602 and the electrodes 224. In alternative implementations, more or less than two belt systems 1602 may be used to move the electrodes 224.

Figure 17A:
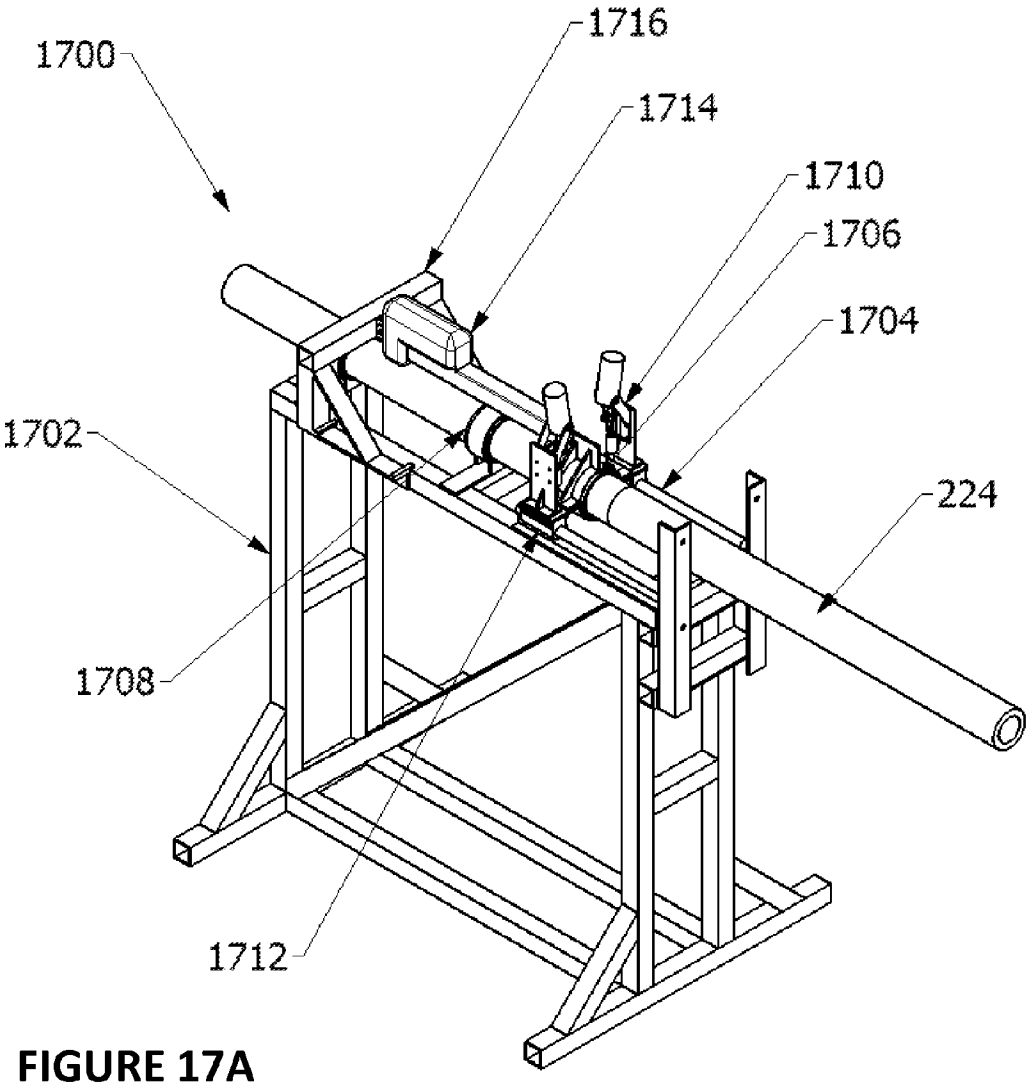
FIGS. 17A and 17B are a top angled view and a zoomed in view respectively of a further alternative electrode support structure using a clamp/rail arrangement.
Figure 17B:
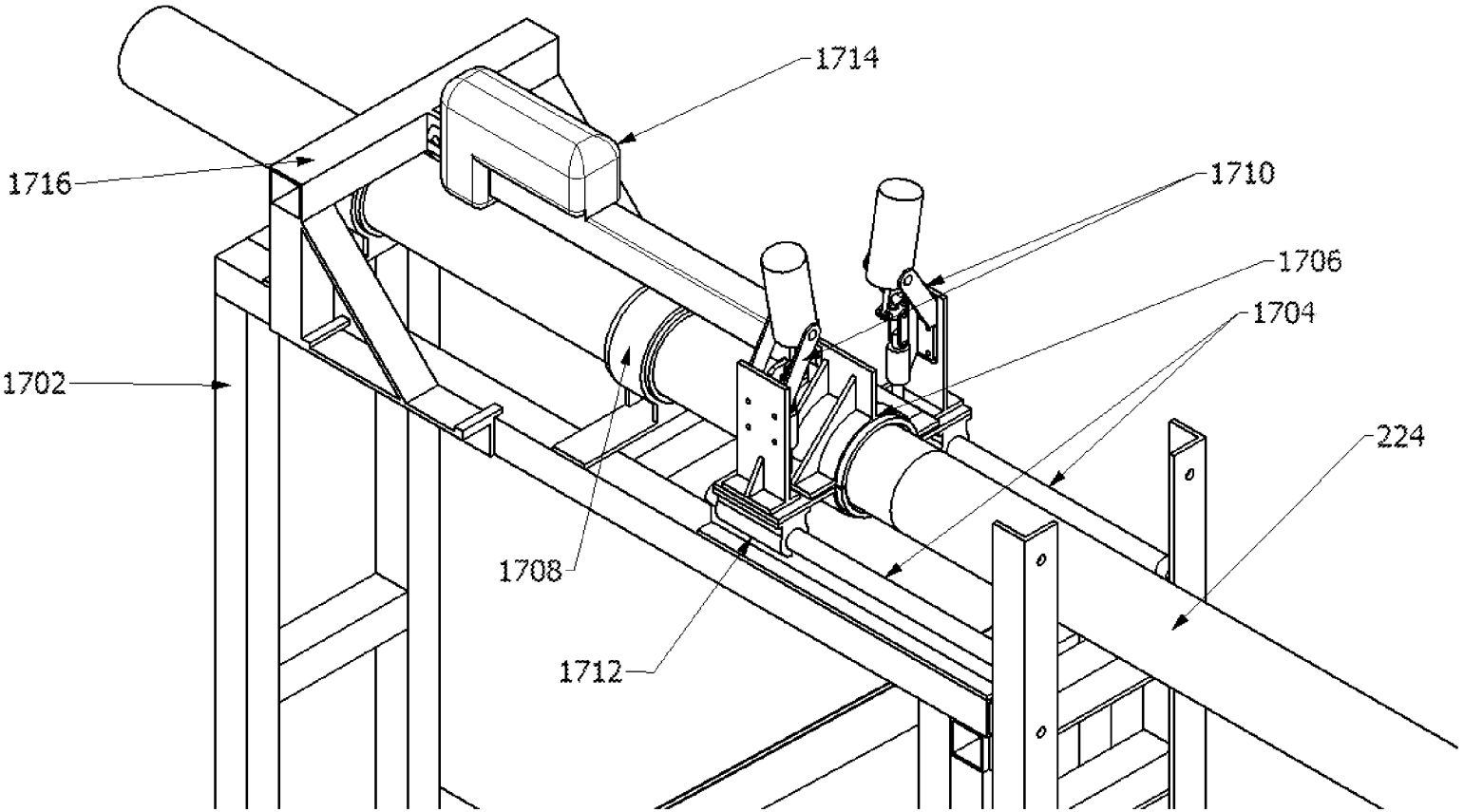
Figure 17C:
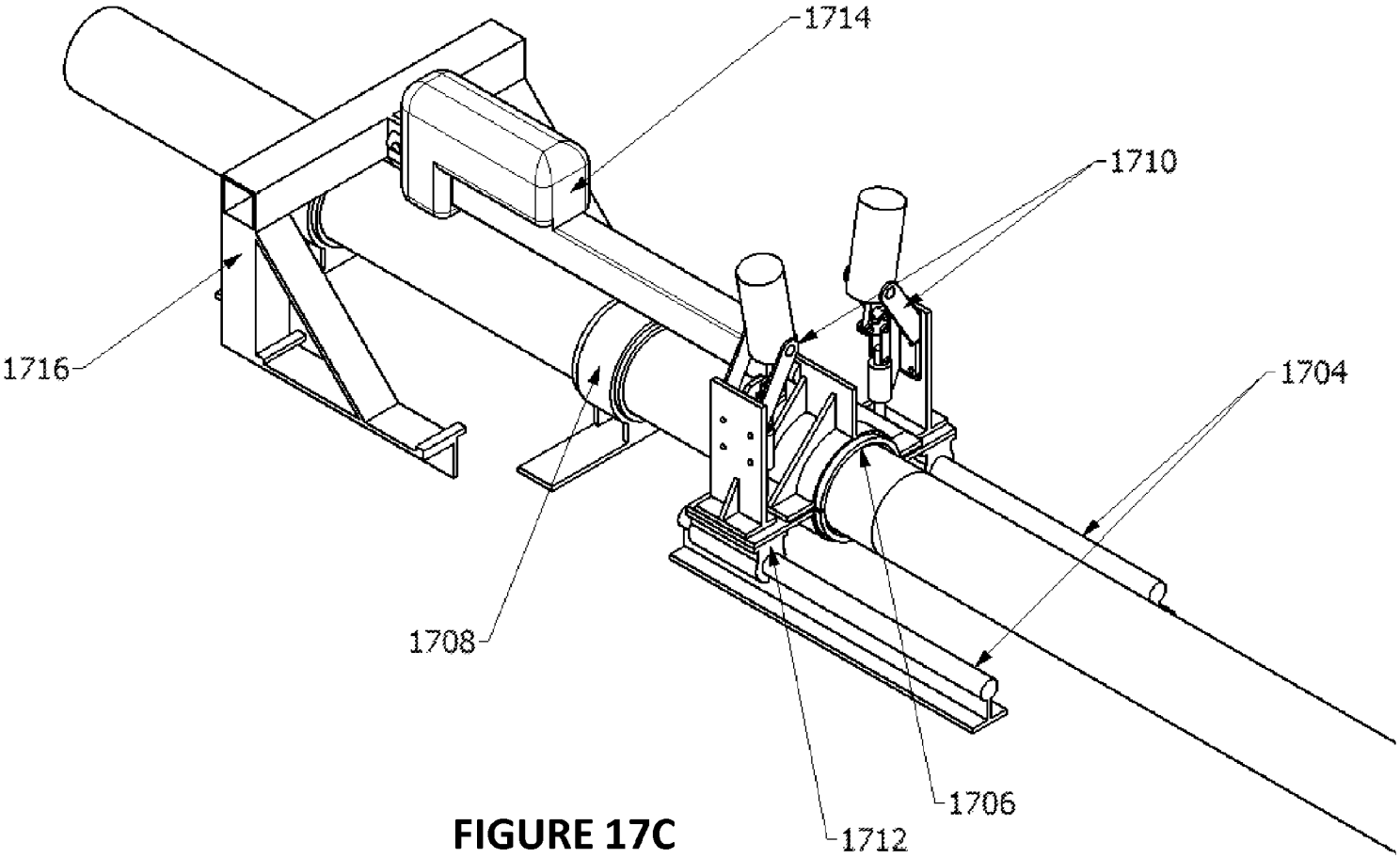
FIG. 17C is a top angled zoomed in view of the clamp/rail arrangement of FIGS. 17A and 17B with the support structure removed for clarity.

FIGS. 17A and 17B are a top angled view and a zoomed in view of a further alternative electrode support structure 1700 using a clamp/rail arrangement. FIG. 17C is a top angled zoomed in view of the clamp/rail arrangement of FIGS. 17A and 17B with the support structure removed for clarity. As shown, in this case, the electrode 224 is supported by a frame 1702 that comprises two parallel guide rails 1704, a clamping element 1706 and a plurality of alignment elements 1708. The clamping element 1706 encircles the electrode 224 and comprises two clamps 1710. When the clamps 1710 are actuated, the clamping element 1706 is in a clamped state in which it is tight to the electrode 224 and effectively integrated with the electrode 224. When the clamps 1710 are not actuated, the clamping element 1706 is in an unclamped state and the electrode 224 may move linearly through the clamping element 1706. In one implementation, the clamps may be pneumatic toggle clamps, though it should be understood that other types (ex. hydraulic, etc.) and/or numbers of clamps and/or clamping elements may be used.

The clamping element 1706 is coupled to two linear bearings 1712 that interlock with the parallel guide rails 1704 and a linear actuator 1714. The linear actuator 1714 is operable to move the clamping element 1706 linearly as the linear bearings 1712 slide along the length of the guide rails 1704. The stationary end of the linear actuator 1714 is secured from movement by means of attachment to a bracket 1716. The electrode 224, as shown, stretches the length of the frame 1702 through the clamping element 1706 and through the alignment elements 1708. In this case there are two alignment elements 1708 that ensure that the electrode 224 is supported and is positioned properly to enter the FRG reactor 114, though other numbers of alignment elements may be used. When the clamping element 1706 is in the clamped state, if the clamping element 1706 is moved along the guide rails 1704 by the linear actuator 1714, the electrode 224 will move with the clamping element 1706.

In one sample operation using the electrode support structure 1700 of FIGS. 17A and 17B, the clamps 1710 may be engaged by opening a valve to feed compressed air to the clamps 1710, thus forcing the clamping element 1706 downward and into a clamped state with the electrode 224. The linear actuator 1714 may then move the clamping element 1706, and as a result the electrode 224, towards or away from the FRG reactor 114 along the guide rails 1704. If the clamping element 1706 reaches the end of the guide rails 1704, the clamps 1710 may be disengaged, thus loosening the clamping element 1706 on the electrode 224, and the linear actuator 1714 can move the clamping element 1706 back to the other end of the guide rails 1704. After the clamping element 1706 is repositioned, the clamps 1710 can be re-engaged, thus forcing the clamping element 1706 back into a clamped state with the electrode 224. The engaging of the clamps 1710 and/or the control of the linear actuator 1714 may be controlled by a computing apparatus (not shown). In the start-up of the FRG reactor 114, the computing apparatus could cause the electrodes 224 to advance within the FRG reactor 114 until the arc has been struck and then retract the electrodes 224 until a stable arc is achieved. The computing apparatus may further advance the electrodes 224 incrementally within the FRG reactor 114 as the heat of the arc consumes the electrodes 224.

In each of the embodiments of electrode support structures depicted in FIGS. 15A, 15B, 16, 17A, 17B and 17C, the frame and structure may be designed to be insulated from the electricity that will pass through the electrodes 224. In one embodiment, a brush assembly as will be described with reference to FIGS. 18A, 18B, 18C and 18D may be used to transfer current to the electrodes 224 from power cables while, in another embodiment, a contact clamp assembly as described with reference to FIGS. 19A, 19B, 19C and 19D may be used. In either case, an electrode support structure 1700 similar to that described with respect to FIGS. 17A, 17B and 17C or another support structure (for example, the support structure of FIGS. 15A/15B or FIG. 16) may be used to provide support to the electrodes 224 and control linear movement of the electrodes 224 as may be required. The additional brush assembly or contact clamp assembly may be added between the support structure and the FRG reactor 114.

Figure 18A:
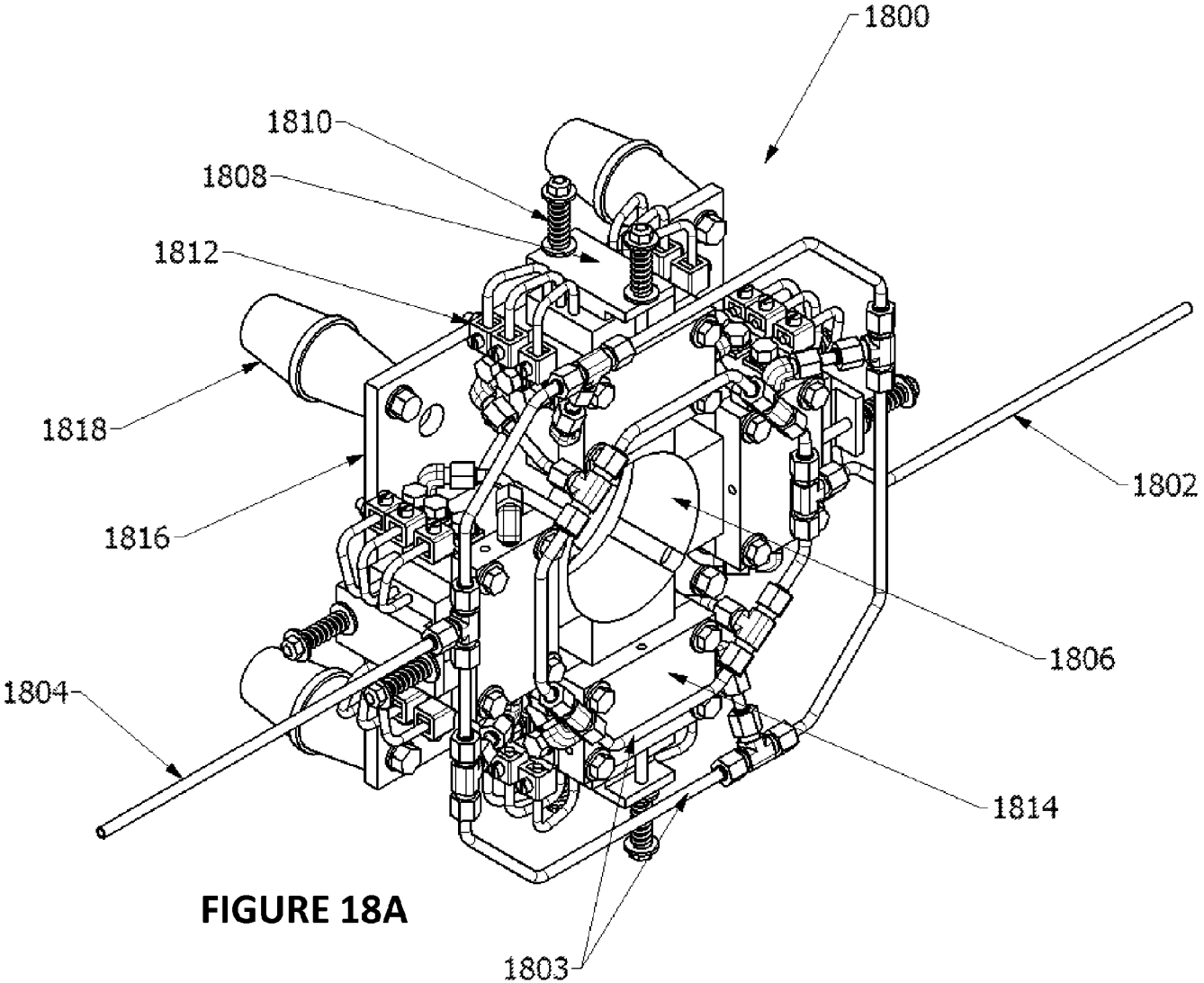
FIG. 18A is a top angled view of a brush assembly for electrifying an electrode according to an embodiment of the present invention.
Figure 18B:
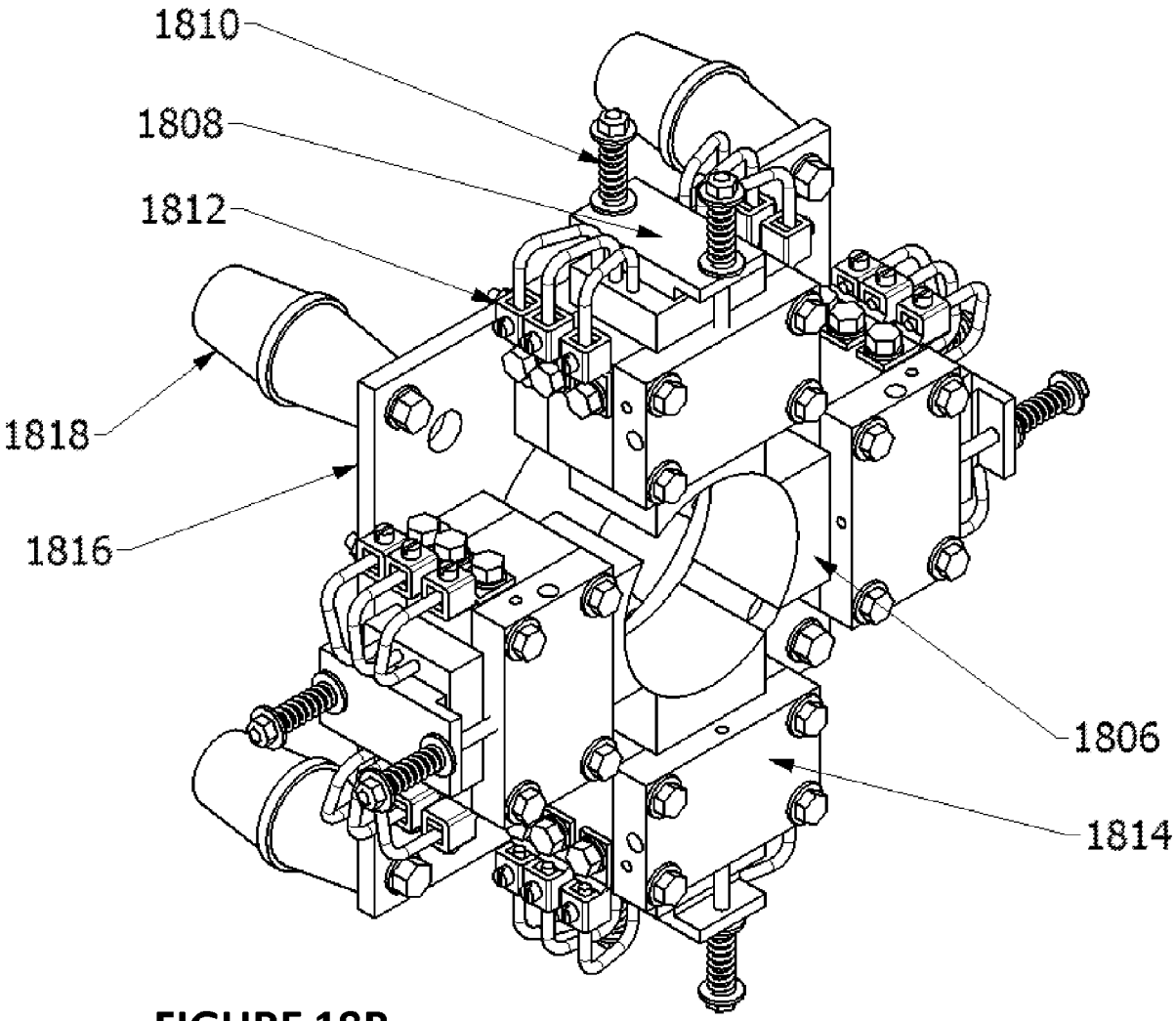
FIGS. 18B and 18C are a top angled view and a zoomed in view respectively of the brush assembly of FIG. 18A with cooling lines and fittings removed for clarity.
Figure 18C:
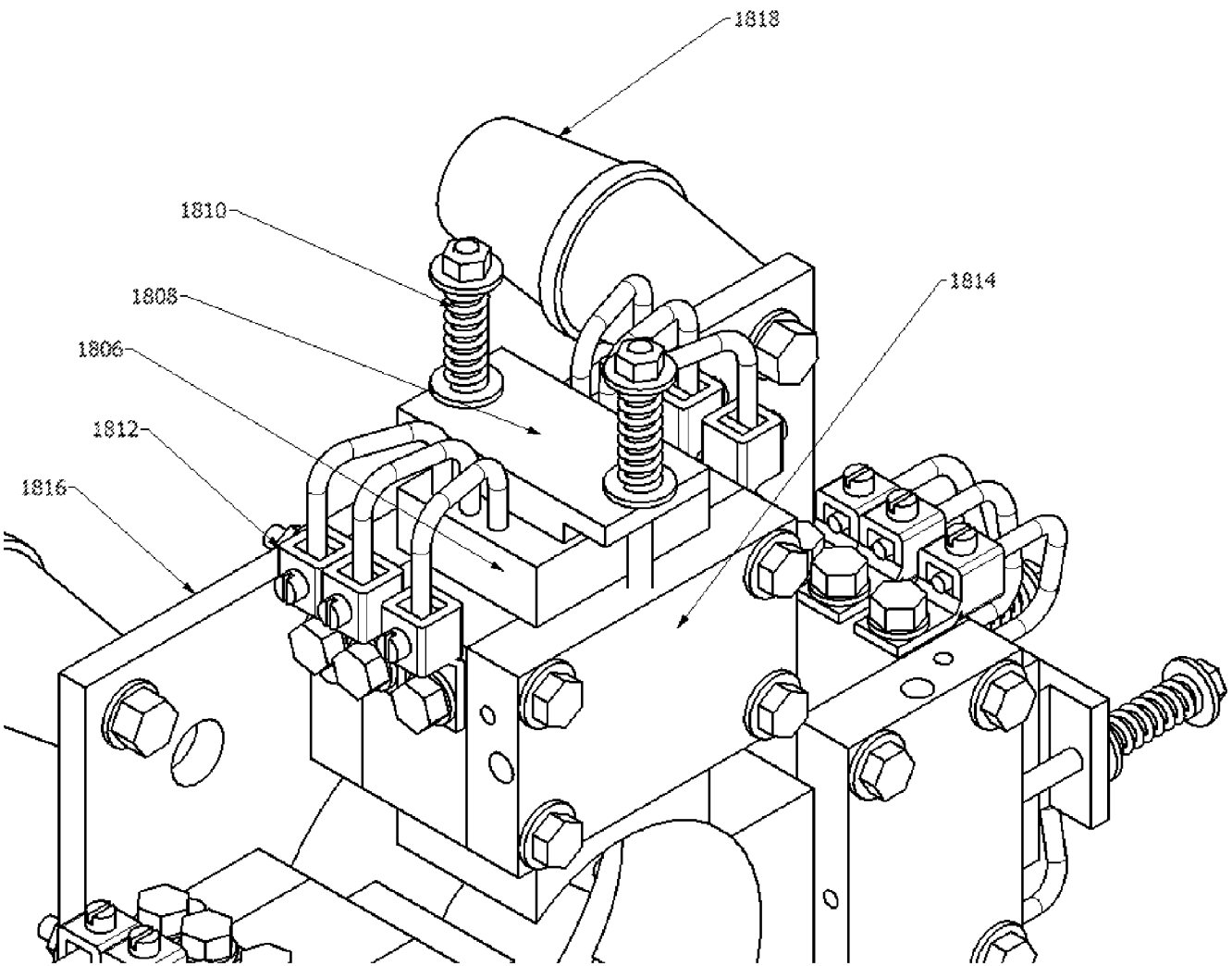

FIG. 18A is a top angled view of a brush assembly 1800 for electrifying an electrode 224 according to an embodiment of the present invention. FIGS. 18B and 18C are a top angled view and a zoomed in view respectively of the brush assembly 1800 of FIG. 18A with cooling lines and fittings removed for clarity. As shown, the brush assembly 1800 comprises a back plate 1816; four insulated standoffs 1818 coupled to one side of the back plate 1816; four brush supports 1814 coupled to the other side of the back plate 1816; and four brushes 1806. In this example, the back plate 1816 comprises a square metal plate with a circular hole in the center, though in alternative implementations, other shapes may be used. The insulated standoffs 1818 are made of electrically insulating material and are used to mount the brush assembly 1800 to the electrode support structure (such as support structure 1700 of FIG. 17A).

Each of the brushes 1806 comprises a flat edge on one side which is coupled to the corresponding brush support 1814 and a rounded edge on the opposite side that with the other three brushes forms the perimeter of a circle or portions thereof. In operation, the electrode 224 is mounted inside the perimeter of the circle formed by the four brushes 1806 and through the hole within the back plate 1816. Each of the brush supports 1814 comprises electrical lugs 1812 that electrically couple to shunts extending from their respective brushes 1806. The brushes 1806 comprise sufficient shunts to conduct the current from the brush supports 1814 through the lugs 1812.

In operation, power cables (not shown) are connected to the back plate 1816 and current flows through the back plate 1816 to the brush supports 1814 and via the electrical lugs 1812 to the brushes 1806 where the current is applied to the electrode 224 through electrical contact between the brushes 1806 and the electrode 224. Each of the brush supports 1814 further has a respective pusher plate 1808 mounted with a spring 1810 on the outer side. The spring 1810 and pusher plate 1808 together work to exert a force on the brush supports 1814, which in turn apply an inward force on the brushes 1806. The spring 1810 and pusher plate 1808 work together to provide a predetermined contact force between the brushes 1806 and the electrode 224. This ensures electrical contact and accommodates minor surface variations along the length of the electrode 224.

The brush supports 1814 are coupled to a set of cooling lines 1803 that allow cooling media to flow from an inflow pipe 1802 through a series of cooling lines within the brush assembly 1800 to an outflow pipe 1804. The cooling lines 1803 wind around the entire brush assembly 1800 with particular cooling focus on the areas in which current is being conducted such as the brushes 1806, the brush supports 1814 and the back plate 1816. In other embodiments, less than all of these elements (ex. only the brush supports 1814) may be cooled or alternatively more elements may also be cooled.

Although shown in FIGS. 18A, 18B, 18C and 18D as four individual brushes, other implementations can be used. For instance, more or less than four brushes 1806 could be utilized to form the circular opening for the electrode 224. Further, each individual brush 1806 may comprise a plurality of segments, individually spring loaded to maximize the contact between the brushes 1806 and the electrode 224 surface area. The brushes 1806 may be comprised of graphite or another material that provides strong current transfer or a blend of materials that may maximize current transfer to the electrode 224.

Figure 18D:
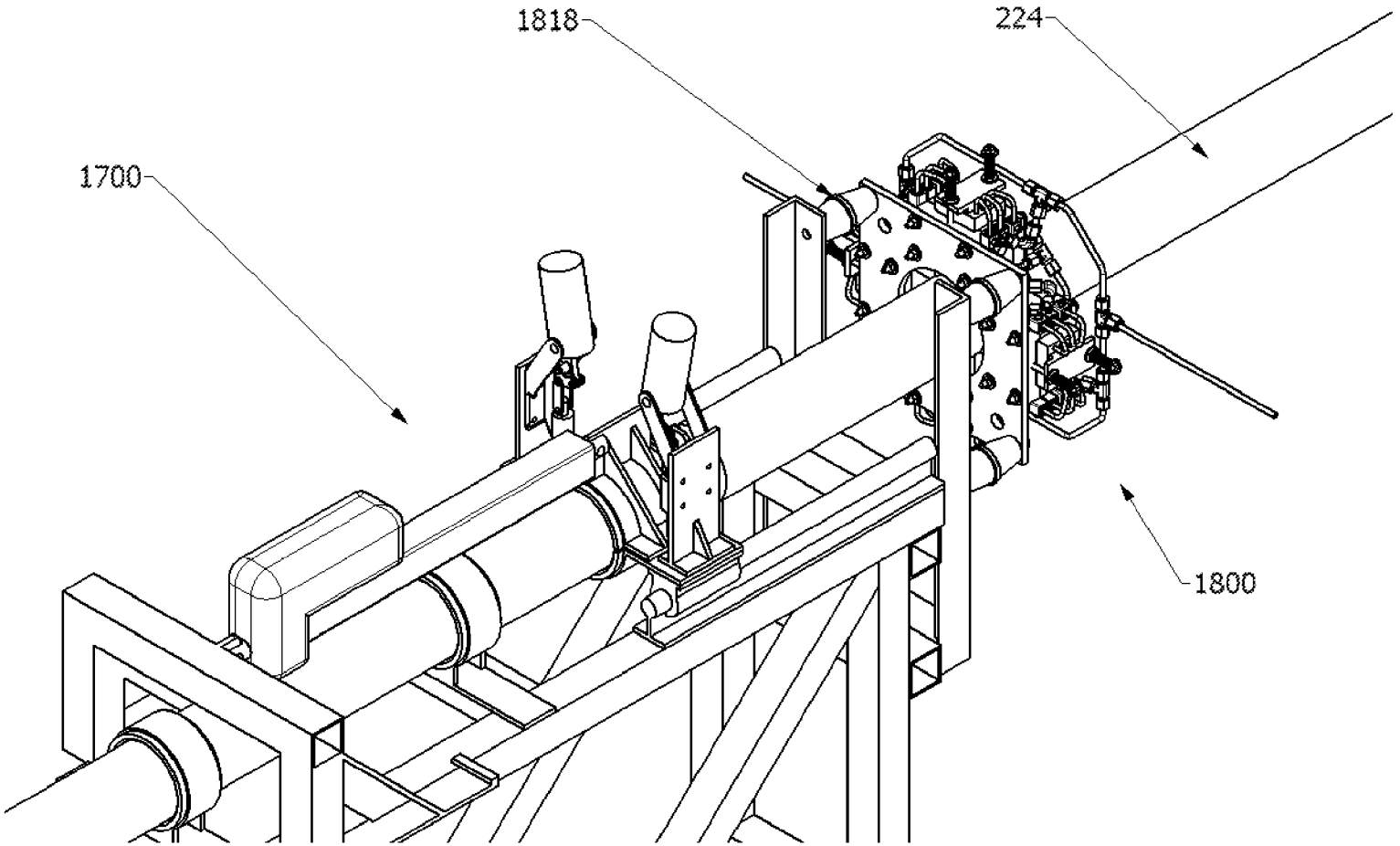
FIG. 18D is a top angled view of the brush assembly of FIG. 18A as installed on the electrode support structure of FIG. 17A.

FIG. 18D is a top angled view of the brush assembly of FIG. 18A as installed on the electrode support structure of FIG. 17A. As shown, the insulated standoffs 1818 are used to mount the brush assembly 1800 to an electrode support structure such as support structure 1700 of FIG. 17A. In operation, the electrode 224 can freely pass through the brush assembly 1800 while the brush assembly remains stationary and the brushes 1806 apply the electrical current to the electrodes 224. This eliminates the need to continually adjust a fixed mechanical clamping of power cables on the electrodes 224 in operation, which can be dangerous for operators and/or require a stoppage in the operation.

Figure 19A:
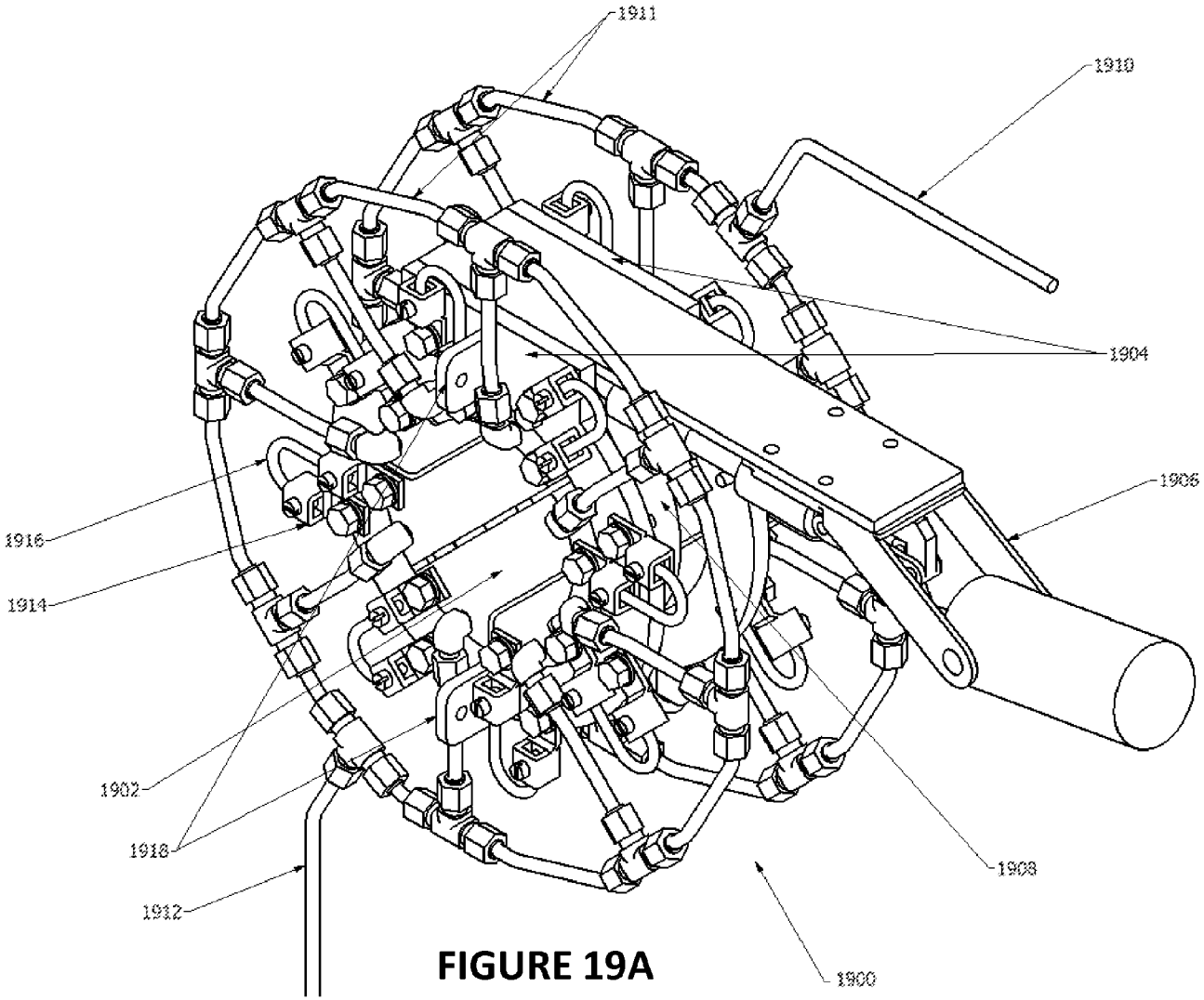
FIG. 19A is a top angled view of a contact clamp assembly for electrifying an electrode according to an embodiment of the present invention.
Figure 19B:
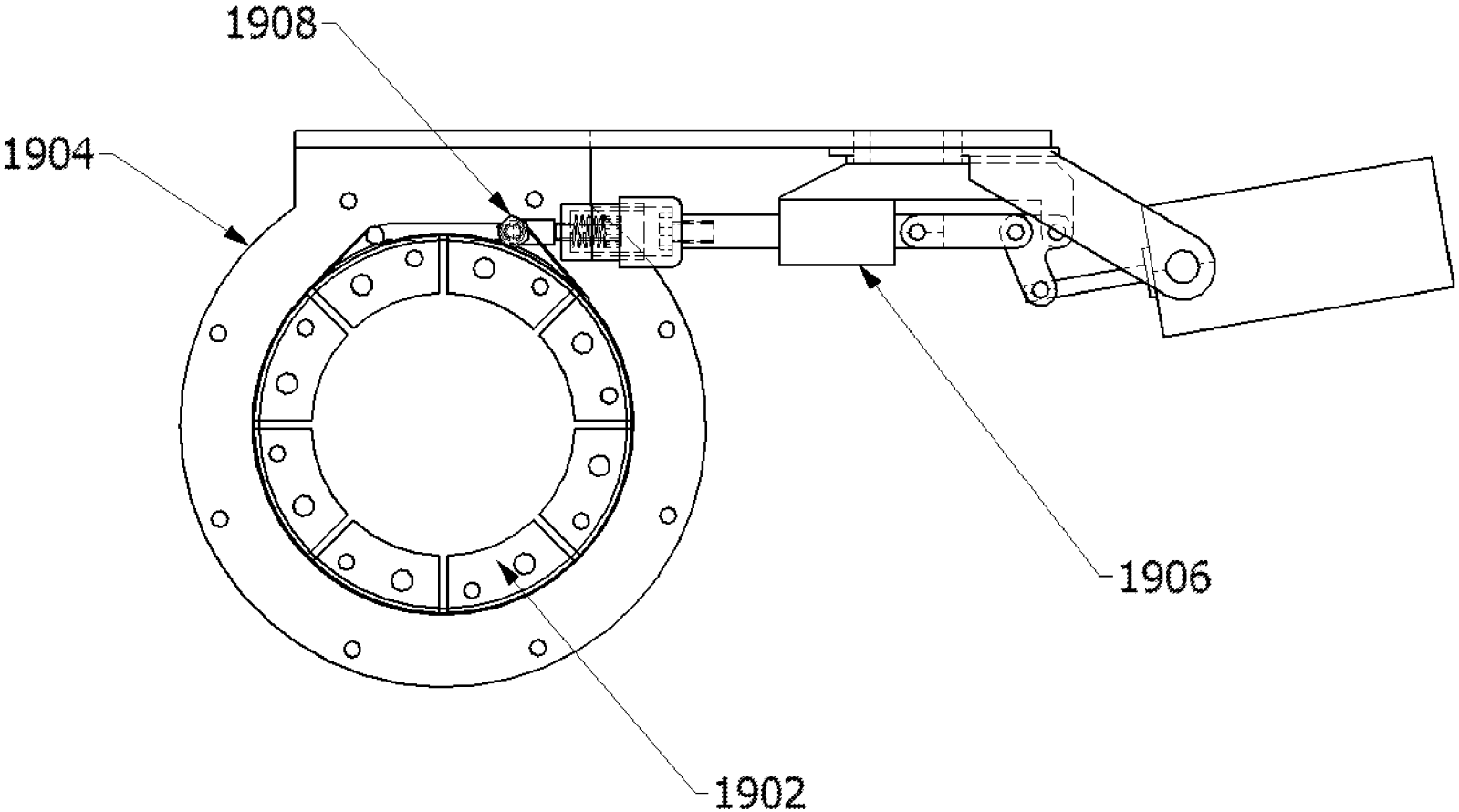
FIGS. 19B and 19C are a side view and a top angled view respectively of the contact clamp assembly of FIG. 19A with cooling lines and fittings removed for clarity.
Figure 19C:
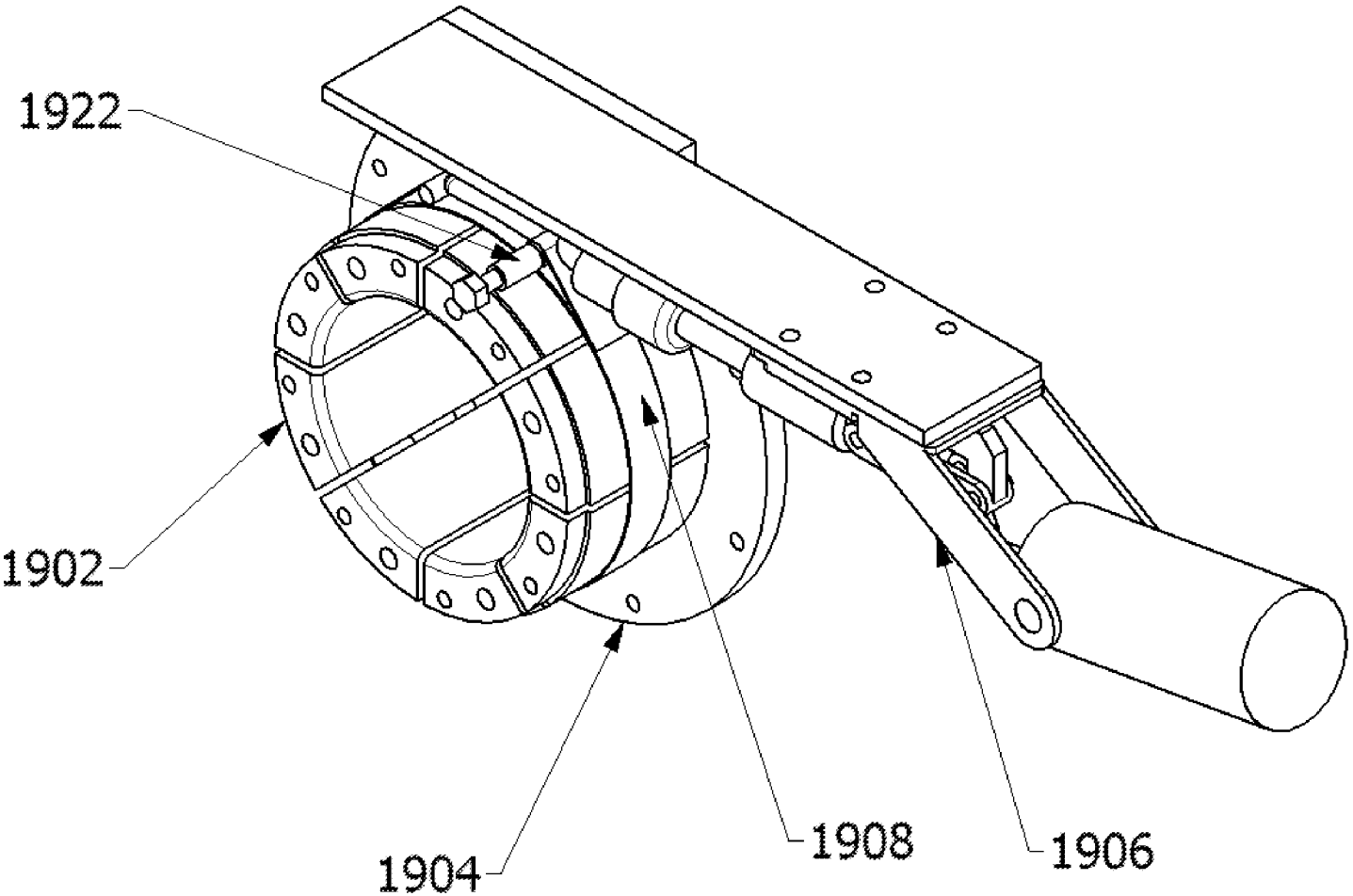

FIG. 19A is a top angled view of a contact clamp assembly 1900 for electrifying an electrode 224 according to an embodiment of the present invention. FIGS. 19B and 19C are a side view and a top angled view respectively of the contact clamp assembly of FIG. 19A with cooling lines and fittings removed for clarity. As shown, the contact clamp assembly 1900 comprises two contact plates 1904 and a plurality of contact segments 1902 each coupled between the two contact plates 1904. The contact plates 1904, in this example, each comprise a circular metal plate with a circular hole in the center, though other shapes may be used in alternative designs. The contact segments 1902 are arranged around the circumference of a circle such that a gap exists between adjacent segments. In operation, the contact segments 1902 will encircle the electrode 224. Each of the segments 1902 is electrically coupled to the contact plate 1904 such that current can be transferred from the contact plate 1904 to the contact segments 1902. Further, each of the contact segments may be provided with cooling capability through cooling lines 1911. Cooling lines 1911 allow cooling media to flow from an inflow pipe 1910 through a series of cooling lines within the contact clamp assembly 1900 to an outflow pipe 1912. The cooling lines 1911 wind around the entire contact clamp assembly 1900 with particular cooling focus on the contact segments 1902.

Further, as depicted in FIGS. 19B and 19C, the contact clamp assembly 1900 further comprises a spring loaded T-bolt clamp 1908 which surrounds the ring of contact segments 1902 and a pneumatic toggle clamp 1906 operable to control the clamp 1908. When the toggle 1906 is activated, it exerts a tension force to the T-bolt portion of the T-bolt clamp 1908, in some embodiments using a spring (not shown), resulting in the clamp band portion of the T-bolt clamp 1908 to apply relatively equal force to the contact segments 1902. This clamping mechanism ensures that the contact segments 1902 maintain a tight contact with the electrode 224. When the toggle 1906 is released, the T-bolt clamp 1908 loosens and allows movement between the contact segments 1902 and the electrode 224. As shown in FIGS. 19A, 19B and 19C, the contact clamp assembly 1900 further comprises a mounting bracket 1922 coupled between the two contact plates 1904 and to one end of the T-bolt clamp 1908, the mounting bracket supporting the toggle 1906.

Figure 19D:
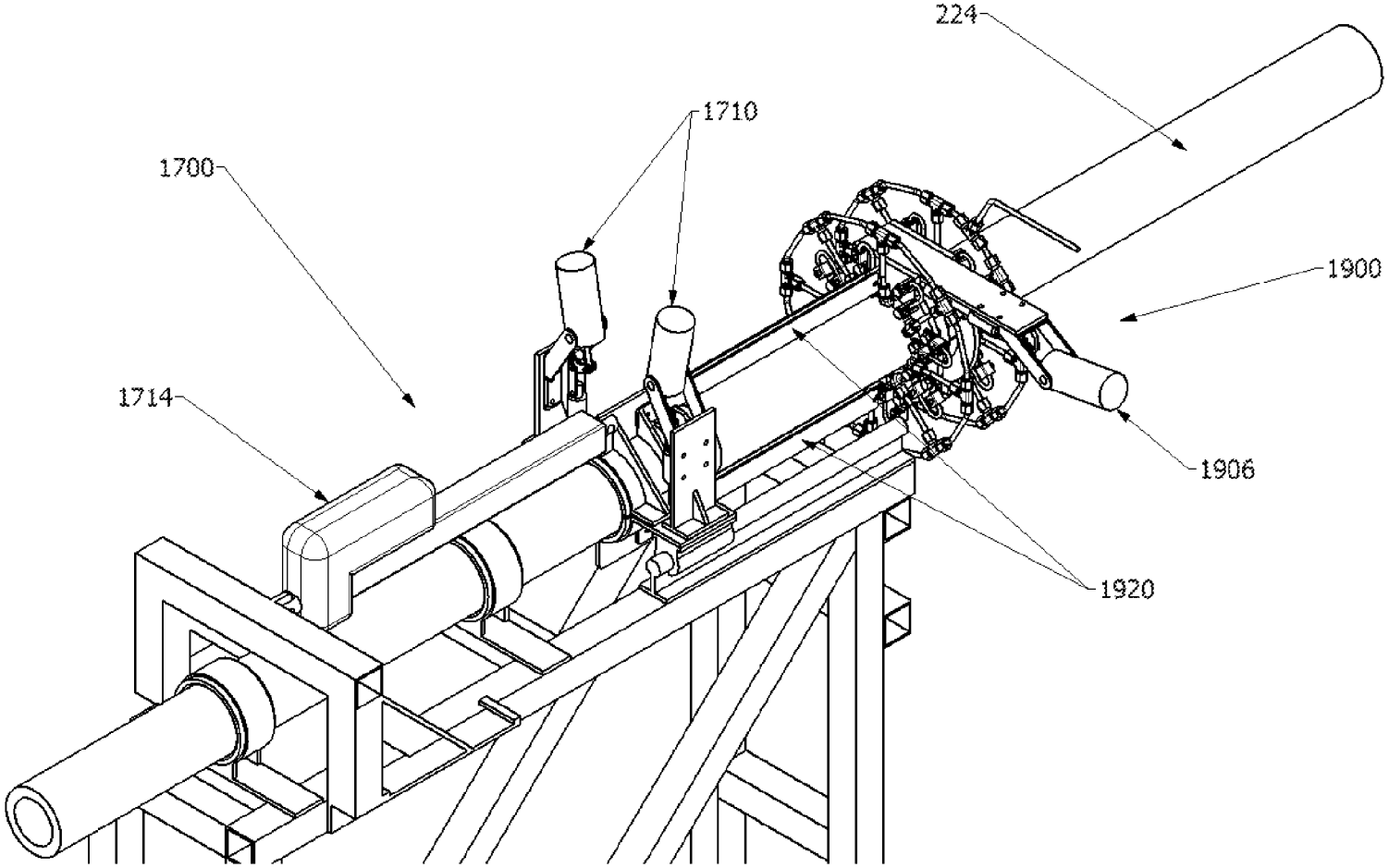
FIG. 19D is a top angled view of the contact clamp assembly of FIG. 19A as installed on the electrode support structure of FIG. 17A.

FIG. 19D is a top angled view of the contact clamp assembly of FIG. 19A as installed on the electrode support structure of FIG. 17A. As shown in FIG. 19A, one of the contact plates 1904 comprises two brackets 1918 on one outer face opposite to the face coupled to the contact segments 1902. These brackets 1918 are used to connect the contact clamp assembly 1900 to linkages 1920, shown in FIG. 19D, that are further connected to the actuator 1714 within the electrode support structure 1700 of FIG. 17A. The linkages 1920 connect the contact clamp assembly 1900 to the actuator 1714 so that the contact clamp assembly 1900 moves with the actuator 1714.

In operation, power cables (not shown) are attached to the contact plates 1904 and current is passed from the power supply (not shown) via the cables (not shown) to the contact plates 1904, through lugs 1914 and jumpers 1916, to each of the contact segments 1902 and then directly to the electrode 224. The contact clamp assembly moves with the actuator 1714 and the electrode 224 until the actuator 1714 reaches the end of a stroke. At this point, the current is turned off and the toggles 1710 of FIG. 17A for the electrode 224 and toggle 1906 for the contact clamp assembly 1900 are deactivated. The actuator 1714 can then be retracted to its start position and all toggles 1710 and 1906 can be re-activated. Once the toggles are activated, the current can be re-applied to the electrode 224 through the contact clamp assembly 1900 and both the electrode 224 and the contact clamp assembly 1900 will move again with the actuator 1714. In operation, this cycle can be repeated continuously as the electrode 224 is consumed in the FRG reactor 114.

Figure 11A:
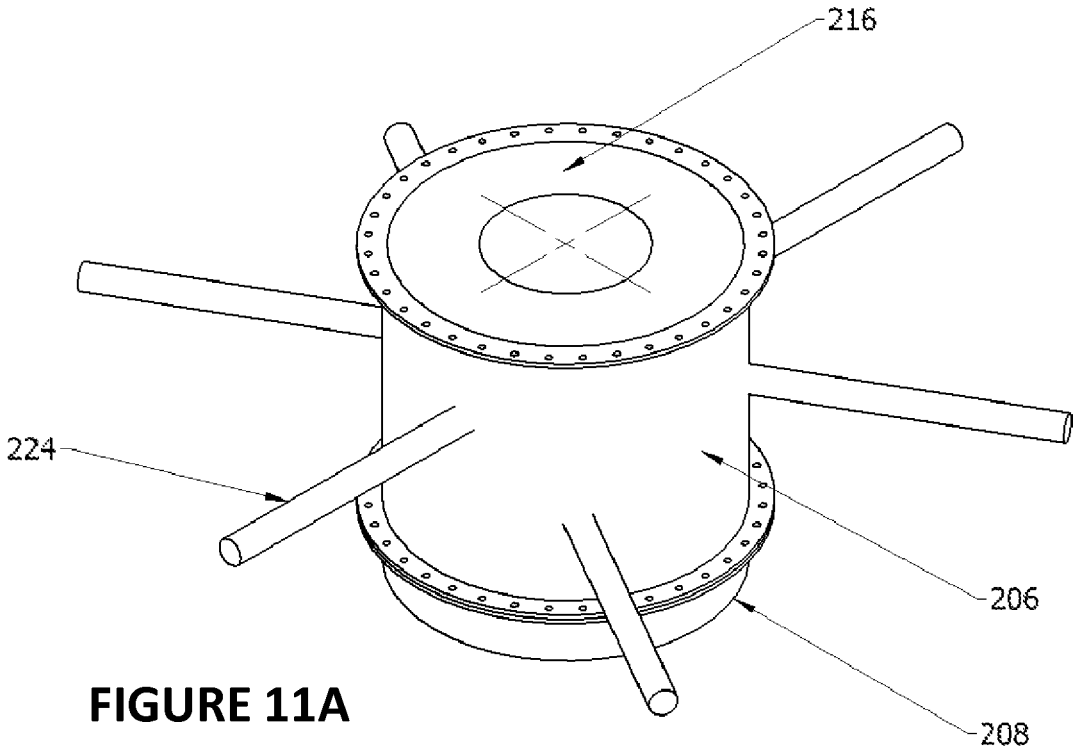
FIGS. 11A, 11B and 11C are an angled top view, a top view and a cross-sectional side view respectively of the bottom portion of the FRG reactor of FIGS. 2A and 2B according to an alternative embodiment in which six electrodes are used.
Figure 11B:
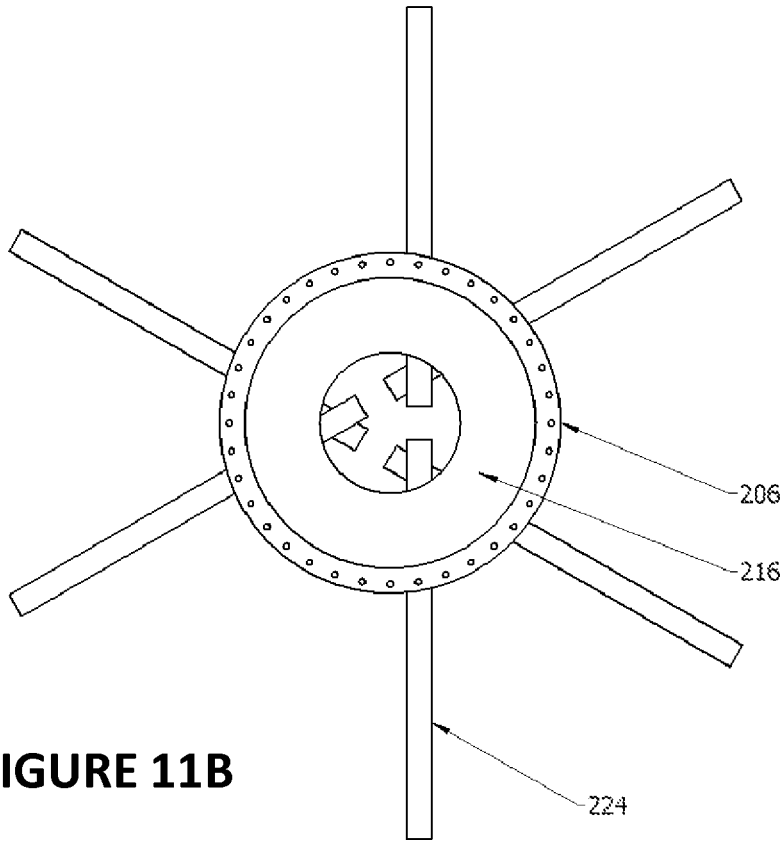
Figure 11C:
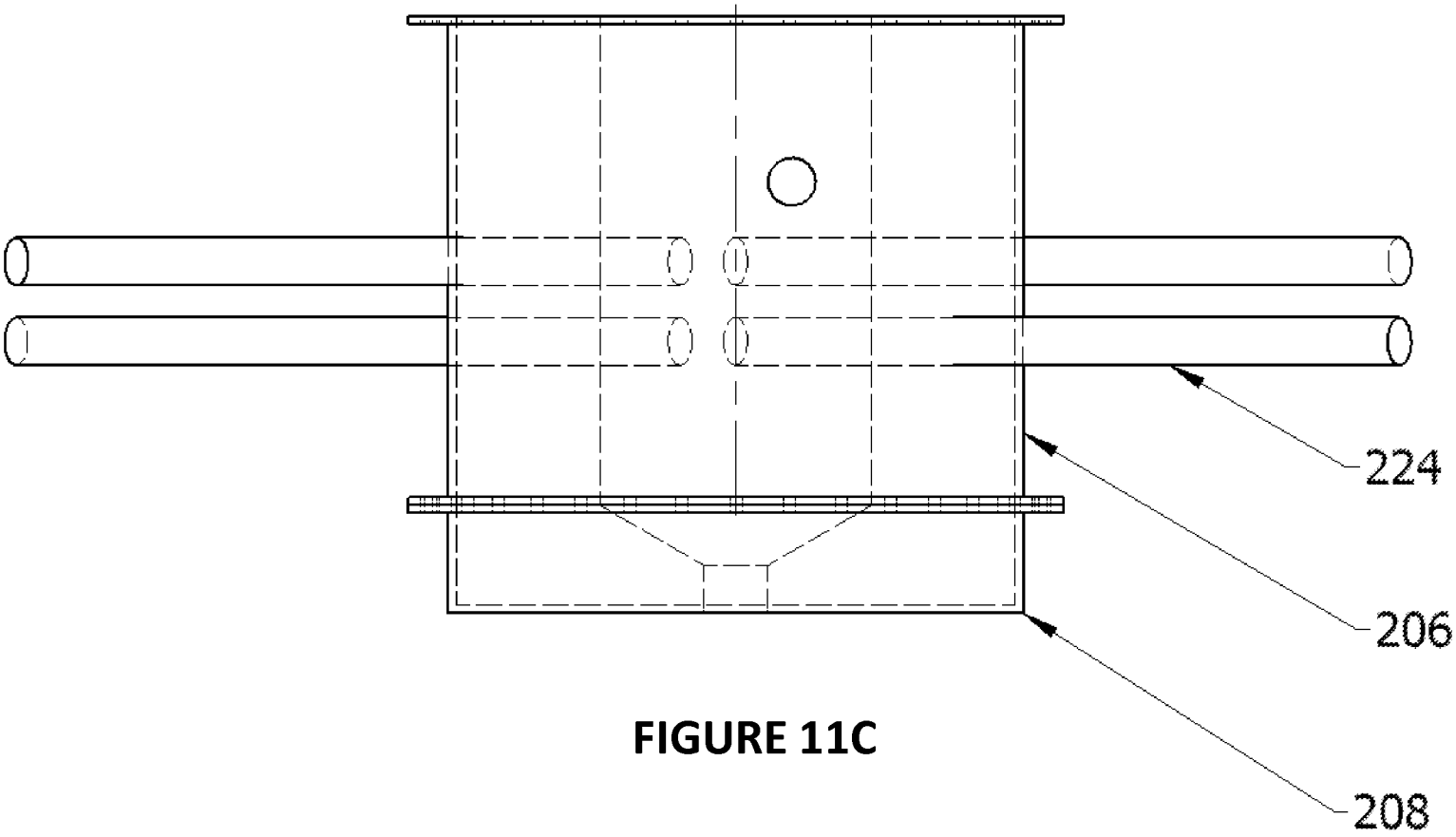

FIGS. 11A, 11B and 11C are an angled top view, a top view and a cross-sectional side view respectively of the bottom portion of the FRG reactor 114 of FIGS. 2A and 2B according to an alternative embodiment in which six electrodes 224 are used. In this configuration, the electrodes 224 are matched together in pairs and each pair enters the base section 206 of the FRG reactor 114 at 180° angles from each other and come close to meeting in the center, creating a small gap between the tips of the electrodes. Each of the pairs of electrodes is approximately 120° horizontally displaced from the other two pairs and is on a different horizontal plane from the other two pairs (one upper pair, one middle pair and one lower pair). Each pair of electrodes has a center line that is offset from a central axis in the FRG reactor 114 and together the center of the three pairs of electrodes create a triangle in the center of the base section 206 of the FRG reactor 114.

By using sets of electrodes, a plurality of arc zones can be created within the FRG reactor 114. This can allow the current being carried in each electrode to be lower than in the embodiment depicted in FIGS. 10A to 10C. In some embodiments, the power level over the three pairs of electrodes is the same as the power level across the three individual electrodes of FIGS. 10A to 10C. In some cases, the use of the plurality of arc zones may allow for a higher energy efficiency within the FRG reactor 114 compared to an implementation that utilizes only a single arc zone.

As material drops to the arc formed by the pair at the highest horizontal plane (the upper pair), a first portion of the material may be molecularly broken down by the upper arc and a second portion may drop to the arc formed by the pair at the middle horizontal plane (the middle pair). At the arc formed by the middle pair, a portion of the material may be molecularly broken down by the arc formed by the middle pair and a finally a final portion of the material may drop to the arc formed by the pair at the lowest horizontal plane (the lower pair) and be molecularly broken down by the lower arc. In one embodiment, a third of the input material may be broken down at each of the three arcs, though in other embodiments a different proportion may be implemented.

Figure 12A:
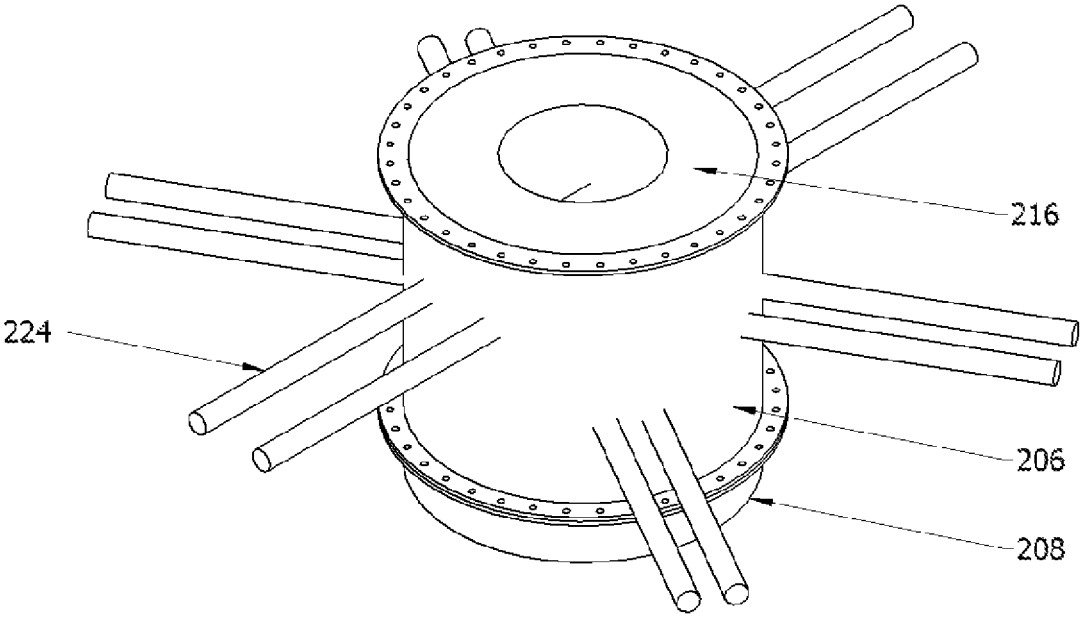
FIGS. 12A, 12B and 12C are an angled top view, a top view and a cross-sectional side view respectively of the bottom portion of the FRG reactor of FIGS. 2A and 2B according to an alternative embodiment in which six parallel pairs of electrodes are used.
Figure 12B:
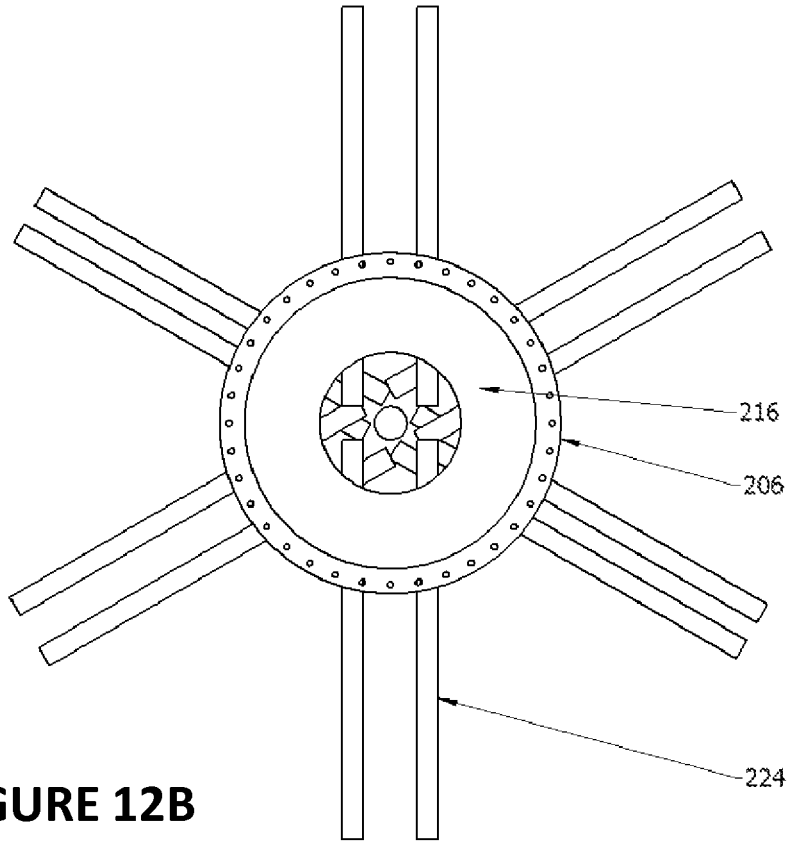
Figure 12C:
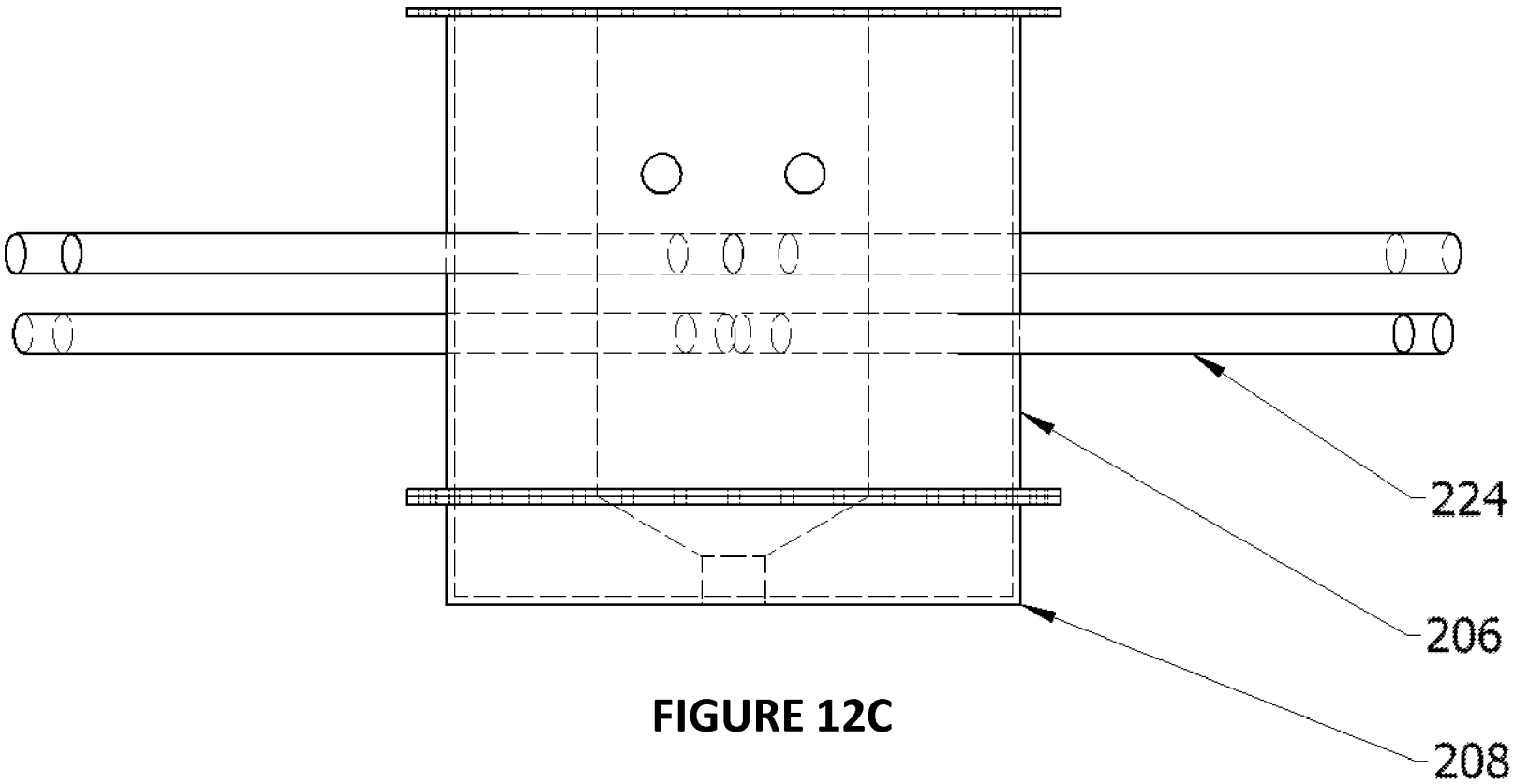

FIGS. 12A, 12B and 12C are an angled top view, a top view and a cross-sectional side view respectively of the bottom portion of the FRG reactor 114 of FIGS. 2A and 2B according to an alternative embodiment in which six parallel pairs of electrodes 224 are used. In this configuration, each parallel pair of electrodes is matched with another parallel pair of electrodes at the same horizontal plane but entering the base section 206 of the FRG reactor 114 at 180° angles from each other. The matched pairs of parallel electrodes come close to meeting in the center of the bottom of the FRG reactor 114, creating a small gap between the tips of the electrodes. The matched pairs of parallel electrodes are 120° horizontally displaced from the other two matched pairs of parallel electrodes and vertically displaced on different horizontal planes from the other matched pairs of parallel electrodes. In some embodiments, as depicted in FIGS. 12A, 12B and 12C, the distance between the parallel electrodes may be larger for the parallel electrodes vertically higher on the base section 206 of the FRG reactor 114.

The implementation of the electrodes 224 depicted in FIGS. 12A to 12C allow for six small arc zones to be formed, two on each of the three different horizontal planes. The two arc zones on each horizontal plane together effectively form a single larger arc zone that is wider than a single arc zone. The two pairs of parallel electrodes on the lowest horizontal plane have their center lines relatively close together while the two pairs of parallel electrodes on the middle horizontal plane have their center lines slightly further apart and the two pairs of parallel electrodes on the highest horizontal plane have their center lines furthest apart. The net effect of the formation of the six arc zones is to create a rather large arc zone beginning at the lowest horizontal plane and extending above the highest horizontal plane.

It should be understood that further alternative embodiments are possible that can allow for alternative arc zones within the bottom portion of the FRG reactor 114. In some embodiments, the fewer or more electrodes or electrode pairs are used. For instance, there may be more than two electrode pairs in parallel at a single horizontal plane, more or less than three horizontal planes with electrodes, and/or different combinations of single pairs of electrodes and multiple pairs of parallel electrodes at different horizontal planes. Further, in some embodiments, the electrodes may not be displaced horizontally by 120° and instead may be aligned or may be displaced by a different angle.

In the plurality of scenarios in which more than one set of electrodes is utilized, the main effect is to form a plurality of arc zones in operation. Each arc zone has it's own input material to arc zone interface area where the heat and light initiate the molecular break down of the input material. In some embodiments, the sum of all the individual input material to arc zone interface areas allows for an increased amount of input material to be converted per unit energy that is input to the system compared to the simpler electrode configuration of FIGS. 10A to 10C in which a single arc zone is formed in operation.

Figure 13A:
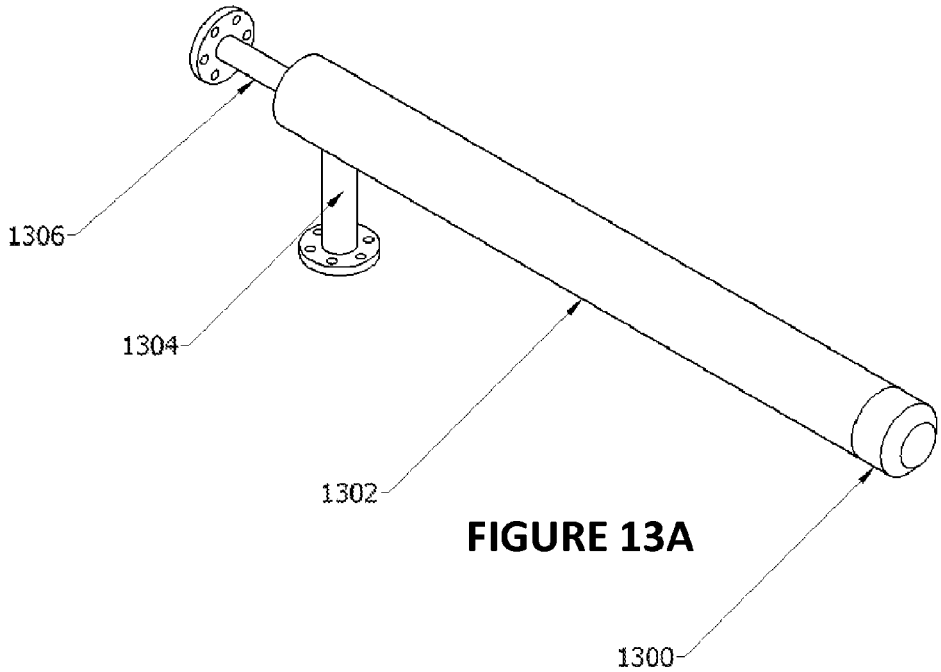
FIGS. 13A, 13B and 13C are an angled top view, a side view and a cross-sectional side view respectively of an electrode that may be used within the FRG reactor of FIGS. 2A and 2B according to an alternative embodiment in which a tungsten tip is used.
Figure 13B:
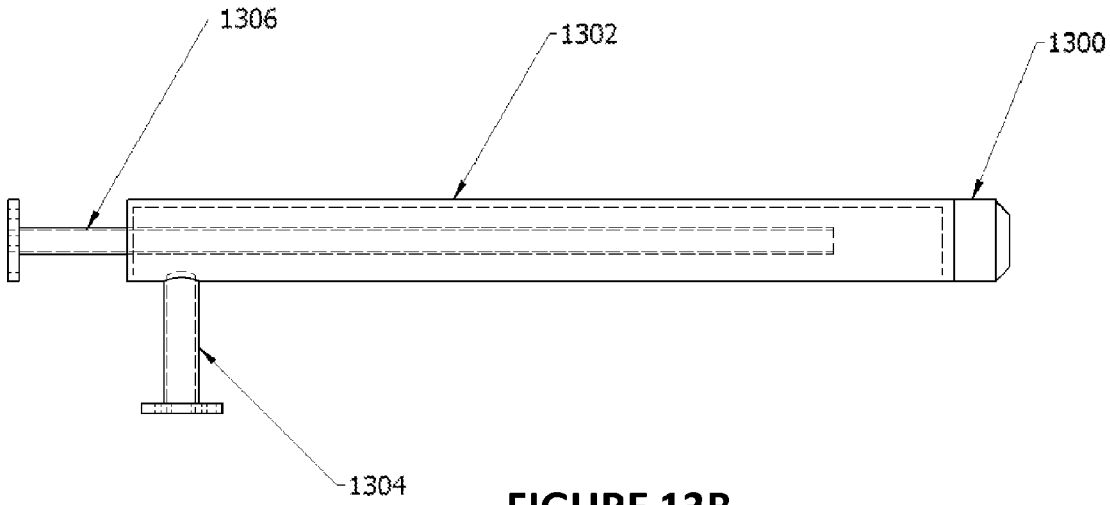
Figure 13C:
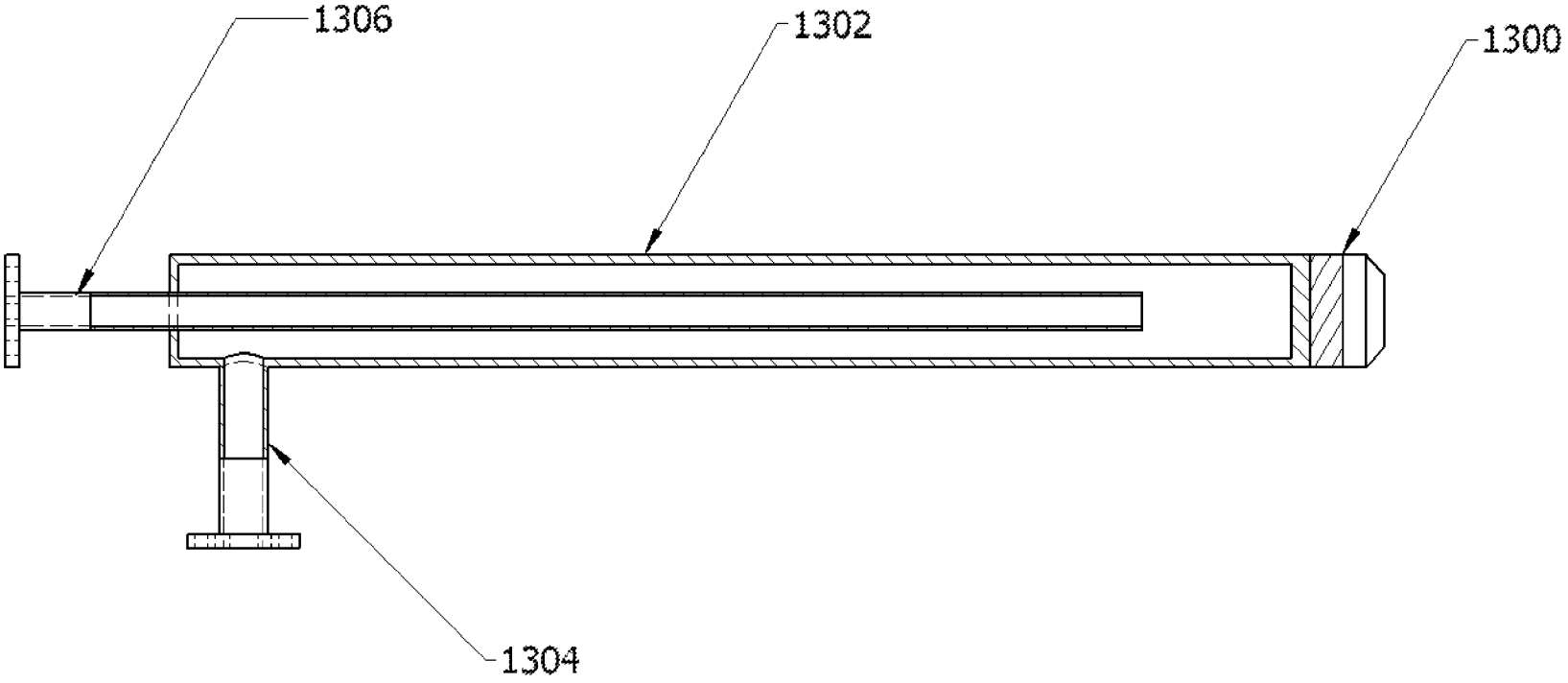

FIGS. 13A, 13B and 13C are an angled top view, a side view and a cross-sectional side view of one of the electrodes 224 that may be used within the FRG reactor 114 of FIGS. 2A and 2B according to an alternative embodiment in which a tungsten tip 1300 is used. In this embodiment, an electrode outer jacket 1302 that may be filled with a coolant (ex. water) is used to cool the tungsten tip 1300. As shown in FIGS. 13A, 13B and 13C, the electrode outer jacket 1302 comprises a coolant inlet 1306 and a coolant inlet 1304.

Graphite electrodes are relatively economical and have a high melting point (~3675° C.) but they are consumed within the operation of the FRG reactor 114 due to the extreme temperatures. This consumption leads to a need for the electrodes needing to be replaced, thus adding costs in electrode materials, labor and possibly downtime during electrode changeover. Further, the energy that is used to consume the graphite electrodes is wasted energy that could have been used to molecularly break down the input material, which may be MSW or MSS. Yet further, the relatively high resistance in graphite contributes to $I^2R$ losses, wasted energy and in some cases heat that may require a method of cooling at the power supply cable to electrode interface.

Tungsten electrodes also have a high melting point (~3400° C.) and will be consumed in the high extreme temperatures of the FRG reactor 114 but at a much lower rate than graphite electrodes. This will lead to less energy wasted on the consuming of the electrodes and more energy available to breakdown the input material, thus potentially lower operational costs. Further, an arc formed using tungsten can produce more UV light than an arc formed with graphite. The additional UV light in some embodiments can increase the production of free radicals within the FRG zone and as a result increase the overall energy efficiency of the system. Problems with tungsten electrodes in the FRG reactor 114 may include difficulty to start and maintain the arc created by the electrodes and the relatively high cost of tungsten compared to graphite. To improve arc characteristics, oxides can be added to the tungsten.

To improve the costs, in some embodiments such as that depicted in FIGS. 13A to 13C, only a tungsten tip 1300 is utilized rather than a full electrode of tungsten. In the embodiment of FIGS. 13A to 13C, the tungsten tip 1300 is bonded to the electrode outer jacket 1302 that is electrically conductive. The electrode outer jacket 1302 may be formed with a less expensive metal such as copper and can be cooled by coolant running through the electrode outer jacket 1302. In operation, liquid coolant (such as water) can be input to the coolant inlet 1306, flow through the electrode outer jacket 1302 and output from the coolant outlet 1304. The coolant can prevent the jacket 1302 from melting as well as potentially lower the tungsten tip temperature and therefore reduce the consumption of the tungsten tip 1300.

In other embodiments, tungsten could be utilized to form the entire electrode and, in this case, an electrode outer jacket 1302 may not be necessary, though it may still be used. Further, in some embodiments, the electrode outer jacket 1302 could be used with graphite electrodes or electrodes made of other materials. Some materials that could be used to form an arc within the FRG reactor 114, either as a whole electrode or as a tip coupled to a hollow tube with an electrode outer jacket, include molybdenum (melting point: ~2610° C.) and titanium (melting point: ~1775° C.). One skilled in the art may know of other electrode materials that could also allow for the formation of an arc within the FRG reactor 114 and the material used in the electrodes should not limit the scope of the present invention.

Figure 14A:
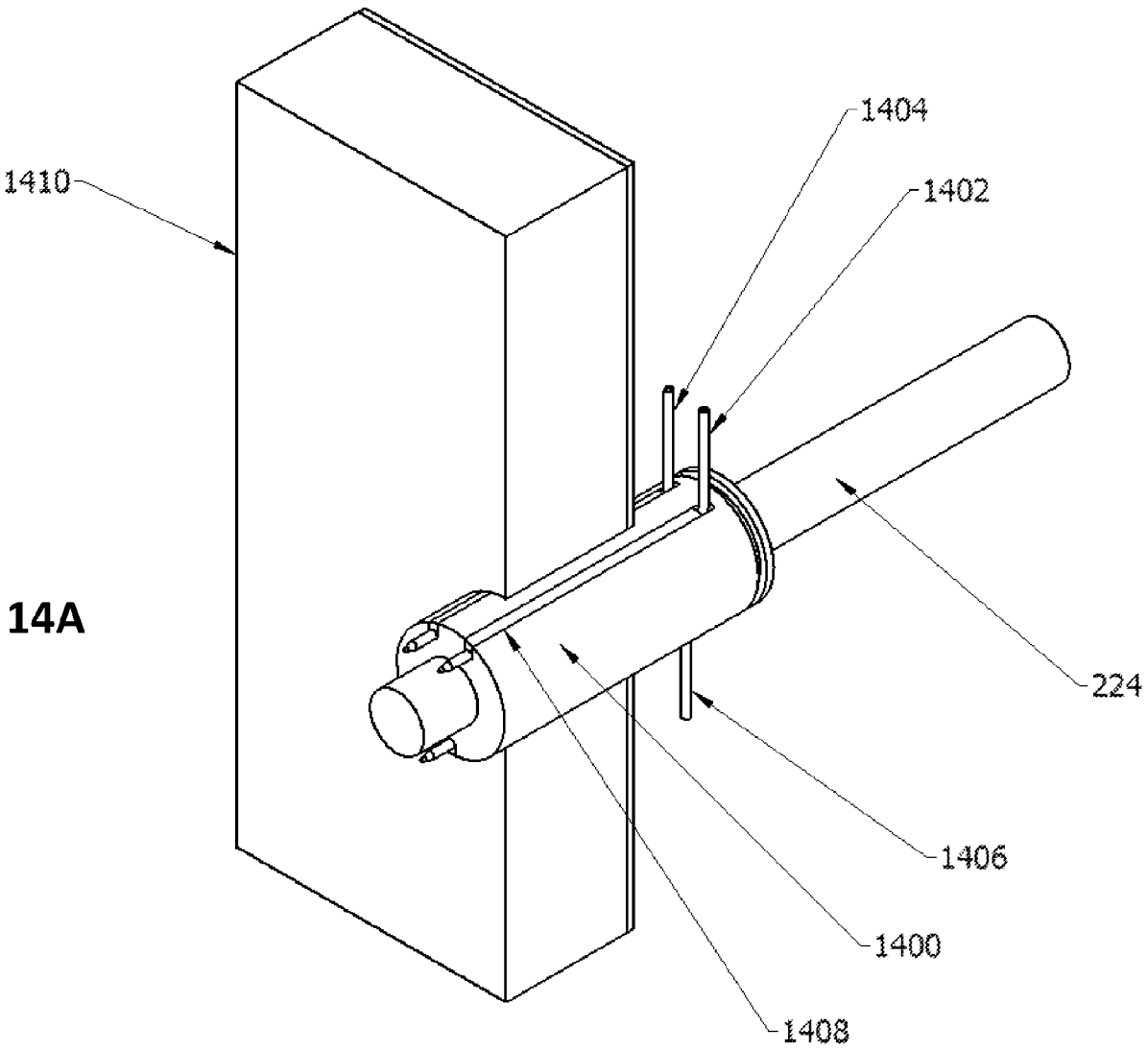
FIG. 14A is an angled top view of an electrode system according to an alternative embodiment of the present invention which includes injectors for tar, water and/or $CO_2$.
Figure 14B:
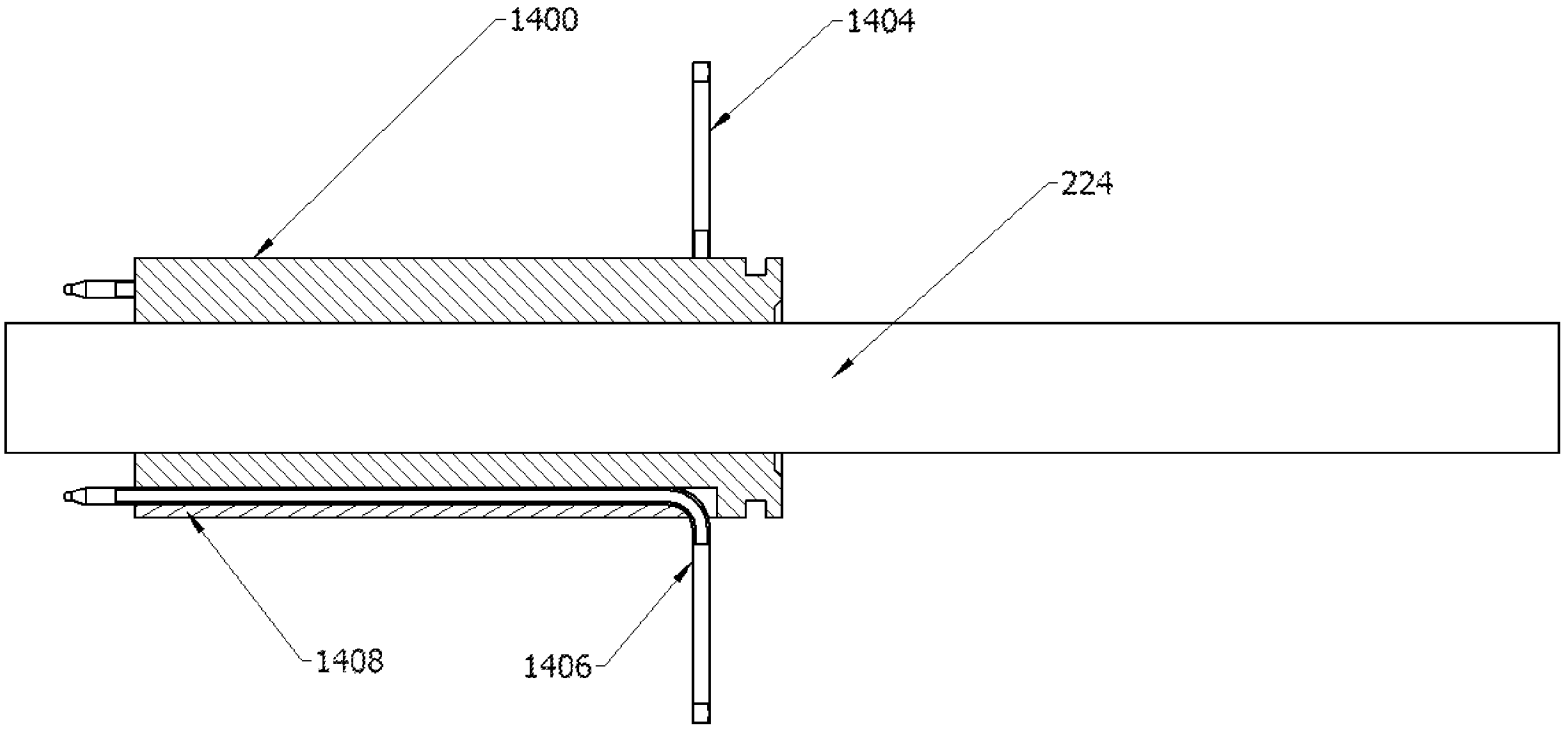
FIGS. 14B and 14C are a cross-sectional side view and a cross-sectional front view respectively of the electrode system of FIG. 14A.
Figure 14C:
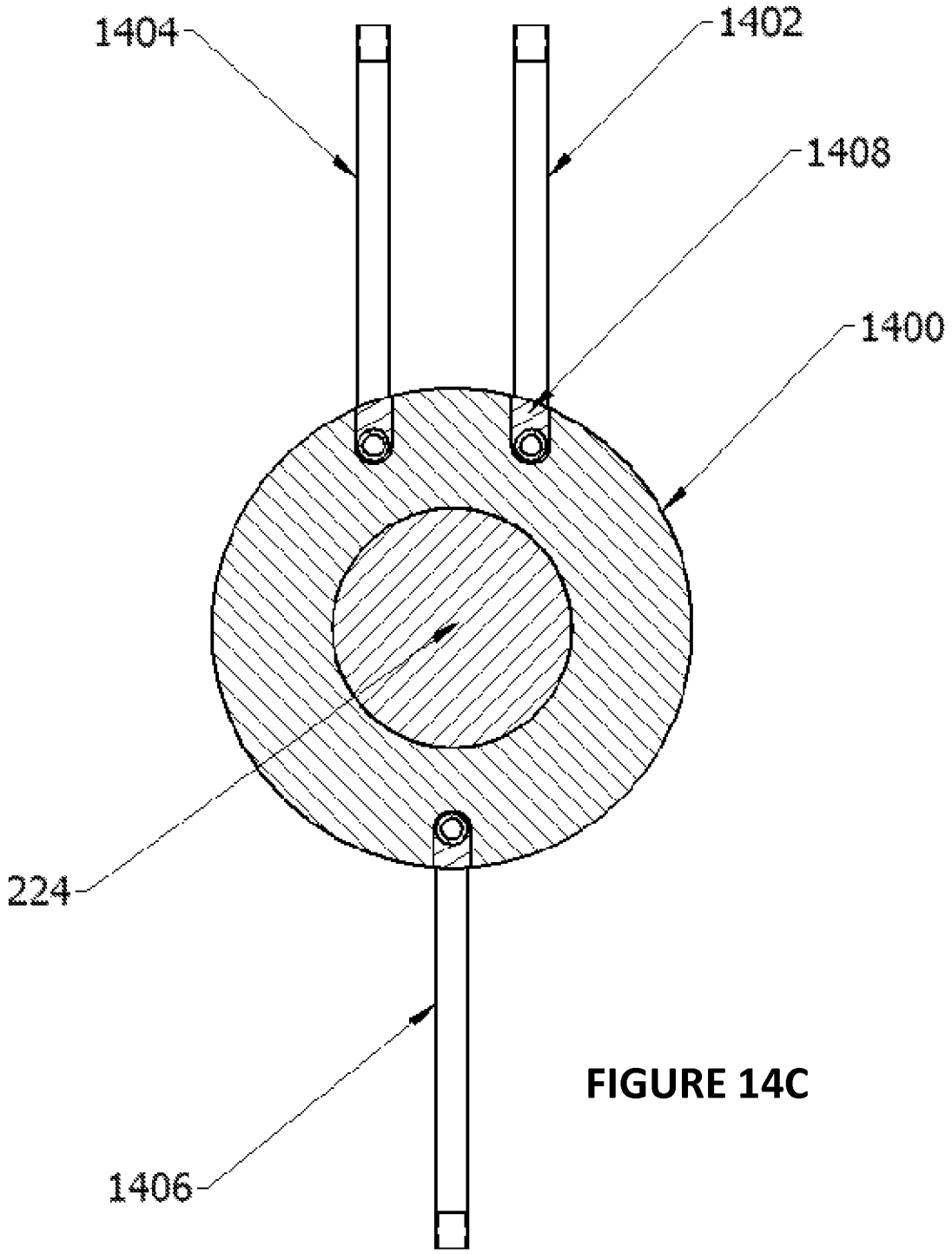
Figure 14D:
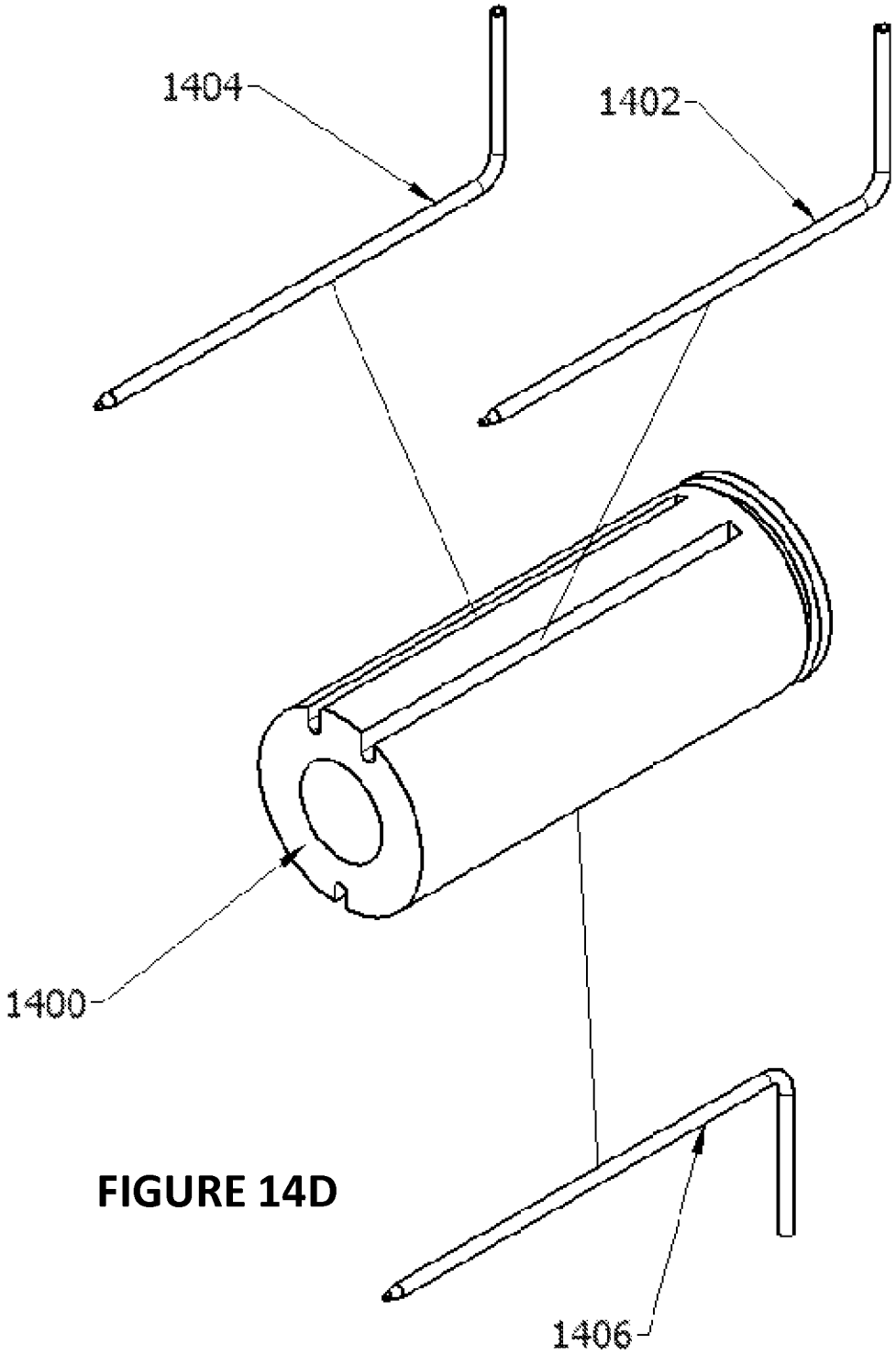
FIG. 14D is an assembly diagram for the electrode system of FIG. 14A.

FIG. 14A is an angled top view of an electrode system according to an alternative embodiment of the present invention, which includes injectors for tar, water and/or $CO_2$. FIGS. 14B and 14C are a cross-sectional side view and a cross-sectional front view of the electrode system of FIG. 14A. FIG. 14D is an assembly diagram for the electrode system of FIG. 14A. As shown, the electrode 224 is encased in an insulator 1400 and both the electrode 224 and the insulator 1400 protrude through a portion 1410 of the base section 206 of the FRG reactor 114. The portion 1410 is illustrated in FIG. 14A for clarity. Further within the insulator 1400 are first, second and third notches in which a water injector 1402, tar injector 1404 and $CO_2$ injector 1406 are inserted with sealant 1408 filling in each of the three notches. It should be understood that some embodiments of the present invention may have none, one, two, three or more injectors such as injectors 1402, 1404, 1406 and FIGS. 14A to 14D are illustrating one particular implementation in which water, tar and $CO_2$ is injected adjacent to one or more electrodes.

In embodiments that implement the water injector 1402, water added into the FRG reactor 114 at the electrode will be homolysised by the light and heat of the arc to produce free radicals. The water injector 1402 could replace or be in combination with the water injection pipe 706. In some embodiments, water injected via the water injector 1402 may need more pressure than water injected by the water injection pipe 706 to ensure the water makes it to the arc. In some embodiments, the water that is injected by the water injector 1402 may comprise contaminated water such as condensate loaded with tars or industrial waste from an external source. The use of this contaminated water in this matter can allow for a safe and efficient disposal method.

In embodiments of the present invention, tar may be generated by pyrolysis of input material above the arc in the FRG reactor 114. These tars may either be broken down by the arc or may exit the FRG reactor 114 in the form of vapors in the syngas. In some embodiments, tars may be collected at one or more locations within the system of the present invention, potentially during the cleaning of the syngas or, in some embodiments, within the FRG reactor 114. Since the tars are a source of carbon, in some embodiments, tar can be injected into the FRG reactor 114 adjacent to the electrodes 224 using the tar injector 1404. The tars can then molecularly breakdown within the arc and contribute positively to the syngas being produced in the FRG reactor 114. The tar injector 1404 may replace or be in combination with the attachment 502 in the material injection system 112. The tar that is injected by the tar injector 1404 may come from the system of the present invention or could come from an external source of tar (ex. another industrial processing plant).

$CO_2$ is a greenhouse gas that is created as waste in many industrial processes. The process of the present invention produces some $CO_2$, which would be considered a contaminant within the output syngas. The syngas produced by the system of the present invention in some embodiments can be scrubbed to remove the $CO_2$. This $CO_2$ as well as the $CO_2$ from other industrial processes, which may include significant levels of other impurities, can be injected into the FRG reactor 114 at the $CO_2$ injector 1406. Within the arc, the $CO_2$ can molecularly breakdown and, when combined with an additional carbon atom, can produce two carbon monoxide CO molecules which are a positive component within syngas due to being combustible.

Although the water injector 1402, the tar injector 1404 and the $CO_2$ injector 1406 are shown within FIGS. 14A to 14D integrated with the electrode 224, this should not limit the scope of the present invention. In particular, one or more of the injectors could be located elsewhere in the FRG reactor 114 and/or could be independent of other mechanical elements.

In some embodiments of the present invention, a control system may be implemented to control one or more aspects of the system described above with reference to FIGS. 1 through 14. In particular, in some embodiments, the control system may monitor the syngas extracted from the FRG reactor 114 and control an element within the system in response to one or more monitored aspects of the syngas. Changes may need to be needed for a variety of reasons including the variability of the material input to the system.

In one embodiment, moisture content (level of gaseous water) within the syngas may be monitored and the amount of water injected into the FRG chamber may be controlled in response. Water injected to the FRG reactor 114 is used to create free radicals that can improve the generation of syngas from the input material but it is not desirable to have high moisture content within the extracted syngas. If the moisture content in the material is high, water may not have to be injected into the FRG reactor 114 to generate sufficient free radicals and any additional water may simply increase the moisture content within the extracted syngas. By monitoring the moisture content within the extracted syngas, a high moisture level can be adjusted by reducing or stopping the water injection into the FRG reactor 114 from the water injection pipe 706, the water attachment 500 and/or the water injector 1402. On the other hand, if the moisture content in the material is low, monitoring the moisture content within the extracted syngas can allow for an adjustment in the water injected to the FRG reactor 114 to compensate and ensure sufficient free radicals are formed.

In other embodiments, carbon compound content within extracted syngas may be monitored and the rate of speed of input of material into the FRG reactor 114 from the material injection system 112 and/or the rate of speed of movement of material within the FRG reactor 114 may be controlled. In particular, the rate of rotation of the MIS 400 and/or MFS 220 may be controlled in response to the carbon compound content within the extracted syngas. Further, the content of the material input to the FRG reactor 114, the level of tar injected into the FRG reactor 114 and/or the level of $CO_2$ injected into the FRG reactor 114 may be adjusted in response to the monitored level of carbon compound content within the extracted syngas.

In yet other embodiments, in response to monitored aspects of the extracted syngas, the location of extraction of the syngas, the location of injection of water, the positioning of the electrodes and/or the level of electrical current flowing through the electrodes may be adjusted.

The embodiments of the present invention as described herein above provide a number of advantages over prior architectures. In particular, embodiments of the present invention may provide improved flow of material through the system and therefore more efficient generation of syngas. Further, embodiments of the present invention may allow for improved control of the output syngas through the ability to adjust many variables including the amount of water input (and therefore the generation of additional free radicals), the rate of input of material, the level of electrical current applied to the electrodes 224, the location of extraction of the syngas, the location of injection of water, the injection of tar, the injection of $CO_2$, the positioning of the electrodes 224 etc. This control is especially useful when the material input to the system is significantly variable in terms of moisture content, carbon content, substances, etc, as it typically may be with MSW or MSS.

As described, embodiments of the present invention allow for an area of free radicals within the FRG chamber 114 which can be enhanced through the injection of a controlled amount of water. The FRG zone initiates breakdown of the input material within the FRG reactor 114 to generate syngas. Since the water injection is controlled, sufficient free radicals can be formed within the FRG chamber 114 while not adding unacceptable levels of moisture content (i.e. gaseous water) within the resulting syngas extracted from the FRG reactor 114. The free radicals combined with the high intensity light and high heat from the arc within the FRG reactor 114 can break down the input material in an efficient manner, reducing the energy required for each kilogram of input material processed. In the case of MSW being the input material, the resulting syngas can have a stored energy (in various forms: heat in gas, water vapor, heating value of gas), greater than the energy used in the electricity to create the arc within the FRG reactor 114 combined with the typical energy that could have been generated through heating and combusting of the input material.

An advantage of particular embodiments of the present invention is the ability within the system to reuse the waste materials from the system. In particular, as described, contaminants extracted from the syngas during a cleaning process can be re-injected into the FRG reactor 114 for processing and can be broken down in the arc. Further, $CO_2$ and contaminated water that may be generated in the processing of the input material both could be re-injected to the FRG reactor 114 and/or the material injection system 112 to be processed and broken down. Yet further, in some embodiments of the present invention, the system may be a net producer of water as water is one of the products of the molecular reductions that will occur in the arc of the FRG reactor 114.

Although various embodiments of the present invention have been described and illustrated, it will be apparent to those skilled in the art that numerous modifications and variations can be made without departing from the scope of the invention, which is defined in the appended claims.

What is claimed is:

1. A system comprising:

a reactor chamber operable to receive material;

a plurality of electrodes at least partially protruding into the reactor chamber, the electrodes operable to generate an arc capable to generate gas from breakdown of the material within the reactor chamber when electricity is applied to the electrodes;

a water injection system within the reactor chamber operable to inject water into the reactor chamber at a controlled rate while electricity is applied to the electrodes;

a gas removal system within the reactor chamber operable to extract the gas generated from breakdown of the material; and a control system operable to control the rate at which water is injected into the reactor chamber by the water injection system based upon a monitored aspect of the gas extracted by the gas removal system.

2. A system according to claim 1, wherein the water injection system is operable to inject water proximate to the plurality of electrodes.

3. A system according to claim 1, wherein the monitored aspect of the gas comprises a level of moisture within the gas extracted by the gas removal system; and wherein the control system is operable to control the rate of injection of water into the reactor chamber by the water injection system in response to the level of moisture within the extracted gas.

4. A system according to claim 1, wherein the monitored aspect of the gas comprises a level of one or more contaminants within the gas extracted by the gas removal system; and wherein the control system is operable to control the rate of injection of water into the reactor chamber, by the water injection system in response to the level of the one or more contaminants within the extracted gas.

5. A system according to claim 1, wherein the monitored aspect of the gas comprises a level of one or more component parts of syngas within the gas extracted by the gas removal system; and wherein the control system is operable to control the rate of injection of water into the reactor chamber by the water injection system in response to the level of the one or more component parts of syngas within the extracted gas.

6. A system according to claim 1 further comprising a material feed system within the reactor chamber operable to move material from a material input opening within the reactor chamber towards the electrodes.

7. A system according to claim 6, wherein the water injection system is integrated within the material feed system.

8. A system according to claim 7, wherein the material feed system comprises a material feed screw operable to move material from the material input opening towards the electrodes when rotated, the material feed screw comprising a central shaft and at least one flute connected to the central shaft; wherein the water injection system comprises a water injection pipe integrated within the central shaft of the material feed screw, the water injection pipe protruding out of an end of the material feed screw; wherein a portion of the water injection pipe that protrudes out of the end of the material feed screw comprises a water injection element.

9. A system according to claim 8, wherein the gas removal system comprises a gas removal pipe integrated within the central shaft of the material feed screw and the water injection pipe is integrated within the gas removal pipe; wherein at least one of a) the gas removal pipe comprises at least one hole aligned with a vent in the central shaft of the material feed screw and b) the gas removal pipe protrudes out of the end of the material feed screw and a portion of the gas removal pipe that protrudes out of the end of the material feed screw comprises a gas removal element.

10. A system according to claim 1, wherein the water injection system is coupled to a water source operable to heat water that is to be provided to the water injection system.

11. A system according to claim 10, wherein the gas removal system is coupled to a gas containing element operable to hold gas extracted from the reactor chamber; and wherein at least a portion of the water source is coupled to the gas containing element such that heat from the gas extracted from the reactor chamber heats the water that is to be injected into the reactor chamber.

12. A system comprising:

a reactor chamber operable to receive material;

a plurality of electrodes at least partially protruding into the reactor chamber, the electrodes operable to generate an arc capable to generate gas from breakdown of the material within the reactor chamber when electricity is applied to the electrodes;

a material feed system within the reactor chamber operable to move material from a material input opening within the reactor chamber towards the electrodes;

a water injection system within the reactor chamber and integrated within the material feed system operable to inject water into the reactor chamber while electricity is applied to the electrodes; and a gas removal system within the reactor chamber operable to extract the gas generated from breakdown of the material.

13. A system according to claim 12, wherein the material feed system comprises a material feed screw operable to move material from the material input opening towards the electrodes when rotated, the material feed screw comprising a central shaft and at least one flute connected to the central shaft; wherein the water injection system comprises a water injection pipe integrated within the central shaft of the material feed screw, the water injection pipe protruding out of an end of the material feed screw; wherein a portion of the water injection pipe that protrudes out of the end of the material feed screw comprises a water injection element.

14. A system according to claim 13, wherein the gas removal system comprises a gas removal pipe integrated within the central shaft of the material feed screw and the water injection pipe is integrated within the gas removal pipe.

15. A system according to claim 14, wherein at least one of a) the gas removal pipe comprises at least one hole aligned with a vent in the central shaft of the material feed screw and b) the gas removal pipe protrudes out of the end of the material feed screw and a portion of the gas removal pipe that protrudes out of the end of the material feed screw comprises a gas removal element.

16. A system according to claim 12, wherein the water injection system is operable to inject water into the reactor chamber at a controlled rate.

17. A system according to claim 16 further comprising a control system operable to control the rate at which water is injected into the reactor chamber by the water injection system based upon a monitored aspect of the gas extracted by the gas removal system.

18. A system according to claim 17, wherein the monitored aspect of the gas comprises a level of moisture within the gas extracted by the gas removal system; and wherein the control system is operable to control the rate of injection of water into the reactor chamber by the water injection system in response to the level of moisture within the extracted gas.

19. A system according to claim 17, wherein the monitored aspect of the gas comprises a level of one or more contaminants within the gas extracted by the gas removal system; and wherein the control system is operable to control the rate of injection of water into the reactor chamber by the water injection system in response to the level of the one or more contaminants within the extracted gas.

20. A system according to claim 17, wherein the monitored aspect of the gas comprises a level of one or more component parts of syngas within the gas extracted by the gas removal system; and wherein the control system is operable to control the rate of injection of water into the reactor chamber by the water injection system in response to the level of the one or more component parts of syngas within the extracted gas.

* * * * *